US006259196B1

(12) United States Patent
Misono et al.

(10) Patent No.: US 6,259,196 B1
(45) **Date of Patent: *Jul. 10, 2001**

(54) CRT DEFLECTION-DEFOCUSING CORRECTING MEMBER THEREFOR, A METHOD OF MANUFACTURING SAME MEMBER, AND AN IMAGE DISPLAY SYSTEM INCLUDING SAME CRT

(75) Inventors: Masayoshi Misono, Chousei-gun; Tutomu Tojyo; Hiroyuki Tamura, both of Mobara; Mitsuhiro Sugiyama, Chousei-gun, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/389,222

(22) Filed: Sep. 3, 1999

Related U.S. Application Data

(63) Continuation of application No. 08/806,423, filed on Feb. 26, 1997, now Pat. No. 6,005,340.

(30) Foreign Application Priority Data

Feb. 27, 1996 (JP) ..... 8-39673
Sep. 11, 1996 (JP) ..... 8-240611

(51) Int. Cl.[7] ..... H01J 29/70; H01J 29/46; H01J 29/50; H01F 7/00; H01F 3/12

(52) U.S. Cl. ..... 313/421; 313/443; 313/442; 313/414; 335/210; 335/211

(58) Field of Search ..... 313/409, 412–413, 313/414, 442, 443, 447; 335/210, 213, 211, 284; 315/368.27, 8, 368.11, 368.15; 29/602.1

(56) References Cited

U.S. PATENT DOCUMENTS 4,057,747 * 11/1977 Hamano ..... 313/413
4,209,702 6/1980 Shirai et al. .
4,329,618 5/1982 Chang .
4,346,327 8/1982 Barten .
4,473,773 * 9/1984 Sakurai et al. ..... 313/412
4,490,644 12/1984 Shimoma et al. .
4,556,819 12/1985 Chen et al. .
5,036,258 7/1991 Chen et al. .
5,066,891 * 11/1991 Harrold et al. ..... 335/284
5,107,238 4/1992 Leupold .
5,170,101 * 12/1992 Gorski et al. ..... 313/412 X
5,414,323 5/1995 Uchida et al. .
5,488,265 * 1/1996 Chen ..... 313/414
5,528,211 6/1996 Perreault et al. .
6,005,340 * 12/1999 Misono et al. ..... 313/443

FOREIGN PATENT DOCUMENTS 51-61766 5/1976 (JP) .
53-18866 6/1978 (JP) .
54-139372 10/1979 (JP) .
58-220339 12/1983 (JP) .
59-127346 7/1984 (JP) .
60-81736 5/1985 (JP) .

* cited by examiner

*Primary Examiner*—Nimeshkumar D. Patel
*Assistant Examiner*—Mack Haynes
(74) *Attorney, Agent, or Firm*—Antonelli, Terry, Stout & Kraus, LLP

(57) ABSTRACT

A cathode ray tube including an electron gun including a cathode and a plurality of electrodes and for generating an electron beam, a phosphor screen and an electron beam deflection device. The cathode ray tube includes a deflection-defocusing correcting member having laminated nonmagnetic and magnetic materials disposed in a deflection magnetic field produced by the electron beam deflection device for establishing at least one non-uniform magnetic field. The magnetic materials are disposed at positions with respect to a path of the electron beam where a magnetic flux density of said deflection magnetic field is more than five per cent of a maximum magnetic flux density of the deflection magnetic field.

16 Claims, 45 Drawing Sheets

Magnetic flux density distribution in a plane Y-Z

Direction of an electron beam travel

Magnetic flux density distribution in a plane Y-Z

Direction of an electron beam travel

Magnetic flux density distribution in a plane Y-Z

Magnetic flux density distribution in a plane Y-Z

Magnetic flux density distribution in a plane Y-Z

Direction of an electron beam travel

Magnetic flux density distribution in a plane Y-Z

Direction of an electron beam travel

CRT DEFLECTION-DEFOCUSING CORRECTING MEMBER THEREFOR, A METHOD OF MANUFACTURING SAME MEMBER, AND AN IMAGE DISPLAY SYSTEM INCLUDING SAME CRT

CROSS REFERENCE TO RELATED APPLICATION

This is a continuation of U.S. application Ser. No. 08/806,423, filed Feb. 26, 1997, now U.S. Pat. No. 6,005,340 the subject matter of which is incorporated by reference herein.

BACKGROUND OF THE INVENTION

The present invention relates to a cathode ray tube (CRT), and particularly to a cathode ray tube having an electron gun capable of improving focus characteristics, correcting deflection defocusing and thereby providing a sufficient resolution over the entire phosphor screen and over the entire electron beam current region; a deflection-defocusing correcting member, a method of manufacturing thereof, and an image display system including the cathode ray tube.

A cathode ray tube such as a picture tube or a display tube includes at least an electron gun having a plurality of electrodes and a phosphor screen (a screen having a phosphor film, which is also referred to as "a phosphor film" or simply to "screen" hereinafter), and it also includes a deflection device for scanning an electron beam emitted from the electron gun over the phosphor screen.

A cathode ray tube of this type has an evacuated envelope comprised of a panel portion, a neck portion and a funnel portion connecting the panel and neck portions, and a deflection device mounted exteriorly around the evacuated envelope. A shadow mask is disposed a short distance from the phosphor screen inside the panel portion to control an electron beam to impinge upon a phosphor dot of intended color.

With such a cathode ray tube, there have been known the following techniques for obtaining a desired reproduced image over the entire phosphor screen from the center to the peripheral portions.

In such a cathode ray tube, deflection defocusing occurs due to variations in a distance between an electron gun and a phosphor screen with deflection angle of an electron beam. An electron beam spot is almost circular at the center of the phosphor screen without deflection defocusing. But at edges and corners halo occurs due to deflection defocusing and blurs the electron beam spot, resulting in deterioration of resolution.

Japanese Patent Publication No. Hei 4-52586 discloses an electron gun emitting three inline electron beams in which a pair of parallel flat electrodes are disposed on the bottom face of a shield cup in such a manner as to be positioned above and below paths of the three electron beams in parallel to the inline direction and to extend toward a main lens.

U.S. Pat. No. 4,086,513 and its corresponding Japanese Patent Publication No. Sho 60-7345 disclose an electron gun emitting three inline electron beams in which a pair of parallel flat electrodes are disposed above and below paths of the three electron beams in parallel to the inline direction in such a manner as to extend from one of facing ends of one of a pair of main-lens-forming electrodes toward a phosphor screen, thereby shaping the electron beams before the electron beams enter a deflection magnetic field.

Japanese Patent Laid-open No. Sho 51-61766 discloses an electron gun in which an electrostatic quadrupole lens is formed between two electrodes and the strength of the electrostatic quadrupole lens is made to vary dynamically with the deflection of an electron beam, thereby achieving uniformity of an image over the entire screen.

Japanese Patent Publication No. Sho 53-18866 discloses an electron gun in which an astigmatic lens is provided in a region between a second grid electrode and a third grid electrode forming a prefocus lens.

U.S. Pat. No. 3,952,224 and its corresponding Japanese Patent Laid-open No. Sho 51-64368 discloses an electron gun emitting three inline electron beams in which an electron beam aperture of each of first and second grid electrodes is formed in an elliptic shape, and the degree of ellipticity of the aperture is made to differ for each beam path or the degree of ellipticity of the electron beam aperture of the center electron gun is made smaller than that of the side electron gun.

Japanese Patent Laid-open No. Sho 60-81736 discloses an electron gun emitting three inline electron beams in which a slit recess provided in a third grid electrode on the cathode side forms a non-axially-symmetrical lens, and an electron beam is made to impinge on the phosphor screen through at least one non-axially-symmetrical lens in which the axial depth of the slit recess is larger for the center beam than for the side beam.

Japanese Patent Laid-open No. Sho 54-139372 discloses a color cathode ray tube having an electron gun emitting three inline electron beams in which a soft magnetic material is disposed in fringe portions of the deflection magnetic field to form a pincushion-shaped magnetic field for deflecting the electron beams in the direction perpendicular to the inline direction of each electron beam, thereby suppressing a halo caused by the deflection magnetic field in the direction perpendicular to the inline direction.

FIG. 46 is a partially cut-away side view of an example of an electron gun for a cathode ray tube. Reference character K denotes a cathode, reference numeral 1 denotes a first grid electrode (G1), 2 a second grid electrode (G2), 3 a third grid electrode (G3), 4 a fourth grid electrode (G4), 5 a fifth grid electrode (G5), 6 a sixth grid electrode (G6), 30 a shield cup, and 38 a main lens. The electron gun is composed of the cathode, the first grid electrode 1, the second grid electrode 2, the third grid electrode 3, the fourth grid electrode 4, the fifth grid electrode 5 and the sixth grid electrode 6 arranged in the order named. The fifth grid electrode 5 is composed of two electrodes 51 and 52.

In FIG. 46, the length of different electrodes or the diameter of different electron beam apertures provide different effects of electric fields on the electron beam. For example, the shape of the electron beam aperture in the first grid electrode 1 close to the cathode 1 exerts an influence on the shape of the electron beam spot in a small-current region, while that in the second grid electrode 2 controls the shape of the electron beam spot in small- to large-current regions. In a main lens 38 formed between the fifth grid electrode 5 and the sixth grid electrode 6 supplied with an anode voltage, the shapes of the electron beam apertures in the fifth and the sixth grid electrodes 5 and 6 constituting the main lens exert an influence upon the shape of the electron beam in a large-current region, while they exert less influence on the shape of the electron beam in a small-current region compared with that in the large-current region.

The axial length of the fourth grid electrode 4 in the above-mentioned electron gun controls the magnitude of the optimum focus voltage and has a great influence upon a difference in optimum focus voltages between small-current and large-current operations, while the axial length of the fifth grid electrode 5 has markedly less influence compared with that of the fourth grid electrode 4.

For optimization of respective characteristics of the electron beam, the dimensions of a particular electrode most effective on the desired characteristics needs to be optimized.

When the aperture pitch in a direction perpendicular to the electron beam scanning line in a shadow mask is decreased, or the density of the scanning lines is increased, in order to enhance the resolution in a direction perpendicular to the scanning line, the scanning lines interferes with the periodic structures of the shadow mask and the contrast of resultant moire has to be suppressed. The prior art could not solve these problems.

FIG. 47A and 47B are schematic views, each showing an essential portion of an electron gun, for comparing the two structures of the electron guns depending on the manner of supplying the focus voltage; wherein FIG. 47A shows a fixed-focus-voltage type electron gun; and FIG. 47B shows a dynamic-focus-voltage type electron gun.

The configuration of the electron gun of the fixed-focus-voltage type shown in FIG. 47A is the same as that shown in FIGS. 46, and therefore, parts corresponding to those in FIGS. 46 are indicated by the same characters.

In the electron gun of the fixed-focus-voltage type shown in FIG. 47A, a focus voltage Vf1 having the same potential is applied to the electrodes 51 and 52 forming the fifth grid electrode 5.

SUMMARY OF THE INVENTION

The desirable focus characteristics of a cathode ray tube include a desirable resolution over the entire screen and over the entire electron beam current region, no occurrence of moire in a small-current region, and uniformity in resolution over the entire screen and over the entire electron beam current region. The design of an electron gun for simultaneously satisfying a plurality of these focus characteristics requires high technology.

The studies by the present inventors showed that an electron gun having a combination of an astigmatic lens and a large-diameter main lens is essential to obtain the above focus characteristics in a cathode ray tube.

In the above-described prior art, however, a dynamic focus voltage has been required to be applied to a focus electrode of an electron gun for obtaining a desirable resolution over the entire screen using electrodes forming an astigmatic lens, that is, non-axially-symmetrical lens in the electron gun.

Especially, for use in multimedia expected to be widely spread soon, a display system needs to be capable of being driven at a plurality of deflection frequencies. This requires dynamic focus voltage generators for respective deflection frequencies and phasing of a dynamic focus voltage to electron beam deflection at respective frequencies increases the cost of electrical circuits and set-up procedures, which increase exponentially with the screen size and maximum deflection angle of a cathode ray tube.

An object of the present invention is to solve the above-described problems of the prior art, and to provide a cathode ray tube which is capable of improving focus characteristics and providing a desirable resolution over the entire screen and over the entire electron beam current region, particularly, without dynamic focusing, or in combination with a reduced magnitude of a dynamic focusing voltage, and which is also capable of reducing moire in a small-current region and operation with a single fixed voltage regardless of deflection frequencies; a deflection-defocusing correcting member, a manufacturing method therefor and an image display system including the cathode ray tube.

Another object of the present invention is to solve the above-described problems of the prior art, and to provide a deflection defocusing correcting member for a cathode ray tube having an electron gun which is capable of improving focus characteristics and providing a desirable resolution over the entire screen and over the entire electron beam current region, particularly, with a low dynamic focusing voltage; a manufacturing method thereof a cathode ray tube employing the deflection defocusing correcting member, and an image display system including the cathode ray tube.

In a cathode ray tube, the maximum deflection angle (hereinafter, referred to as "deflection angle" or "deflection amount") is substantially in a specified range, and accordingly, as the size of a phosphor screen is enlarged, a distance between the phosphor screen and a main focus lens of an electron gun is extended, as a result of which mutual space-charge repulsion of an electron beam In such a space deteriorates focus characteristics.

Accordingly, resolution of a cathode ray tube can be improved by provision of a means for reducing deterioration in focus characteristics caused by space-charge repulsion, thereby providing a small electron beam spot as with a small size phosphor screen.

A further object of the present invention is to provide a deflection defocusing correcting member for a cathode ray tube which is capable of reducing deterioration in focus characteristics due to space-charge repulsion of an electron beam in a space between a phosphor screen and a main focus lens of an electron gun; a manufacturing method thereof, a cathode ray tube employing the deflection defocusing correcting member, a cathode ray tube employing the deflection defocusing correcting member, and an image display system including the cathode ray tube.

Still a further object of the present invention is to provide a deflection defocusing correcting member for a cathode ray tube which is capable of improving focus characteristics and of reducing the total length of the cathode ray tube, a cathode ray tube employing the deflection defocusing correcting member, and an image display system including the cathode ray tube.

An additional object of the present invention is to provide a deflection defocusing correcting member for a cathode ray tube which is capable of preventing deterioration in uniformity of an image over the entire screen even for a cathode ray tube of a wider deflection angle, a cathode ray tube employing the deflection defocusing correcting member, and an image display system including the cathode ray tube.

The total length of a cathode ray tube can be shortened by extending a deflection angle. The depth of the present-day TV receiver sets (hereinafter, referred to as "TV set") is dependent on the total length of the cathode ray tube, and it is desirable to be shortened as much as possible because the TV set is generally regarded as a piece of furniture. The shortening of the depth of a TV set is also advantageous in transportation efficiency at the time when a TV set maker transports a large number of TV sets.

To achieve the above object, according to one preferred embodiment of the present invention, there is provided a cathode ray tube including at least an electron gun having a plurality of electrodes, a deflection device, and a phosphor screen, wherein the cathode ray tube includes pole pieces in a deflection magnetic field for locally modifying the deflection magnetic field, and the pole pieces are provided by a deflection defocusing member composed of laminated magnetic and non-magnetic materials, thereby correcting deflection defocusing of an electron beam.

To achieve the above object, according to another preferred embodiment of the present invention, the deflection defocusing member is fabricated by press-forming from a sheet of soft magnetic material such as Permalloy, roller-pressed, welded, brazed, or the like on a non-magnetic sheet of material such as stainless steel, thereby correcting deflection defocusing of an electron beam. These laminated material can be called "clad metal" or "clad plate."

To achieve the above object, according to another preferred embodiment of the present invention, there is provided a cathode ray tube including at least an electron gun having a plurality of electrodes, a deflection device, and a phosphor screen, wherein the cathode ray tube includes pole pieces in a deflection magnetic field for locally modifying the deflection magnetic field, and the pole pieces are provided by a deflection defocusing member composed of non-magnetic and magnetic sheets joined edge to edge and disposed in a deflection magnetic field produced by said electron beam deflection device for establishing at least one non-uniform magnetic field on each of sides of a central path of said electron beam at zero deflection for correcting deflection defocusing of said electron beam by modifying locally said deflection magnetic field with magnetic pole pieces formed by said magnetic material.

To achieve the above object, according to another preferred embodiment of the present invention, the deflection defocusing member is fabricated by press-forming from a sheet of soft magnetic material such as Permalloy, and a non-magnetic sheet of material such as stainless steel, wherein the sheet of soft magnetic material and the non-magnetic sheet of material are welded by electron beam or laser beam, brazed with solder, or the like edge-to-edge. It is preferable for press-forming and bending in fabrication of the magnetic pole pieces for the two sheets to have equal thickness.

BRIEF DESCRIPTION OF THE DRAWINGS

In the drawings, which form an integral part of the specification and are to be read in conjunction therewith, and in which like reference numerals designate similar components throughout the figures; and in which:

FIGS. 3A to 3D are schematic views illustrating a fourth embodiment of a method of correcting deflection defocusing of a cathode ray tube according to the present invention, wherein FIGS. 3A and 3C are sectional views, and FIGS. 3B and 3D are magnetic distribution diagrams;

FIGS. 4A to 4D are schematic views illustrating a fifth embodiment of a method of correcting deflection defocusing of a cathode ray tube according to the present invention, wherein FIGS. 4A and 4C are sectional views, and FIGS. 4B and 4D are magnetic distribution diagrams;

FIGS. 10A and 10B are views illustrating an axial deflection magnetic field distribution of a deflection magnetic field in a cathode ray tube having a deflection angle of 100° or more, wherein FIG. 10A is the deflection magnetic field distribution, and FIG. 10B shows a positional relationship;

FIGS. 34A to 34D are illustrations of structures of two different electron guns having a deflection defocusing correcting member incorporated therein of the present invention, wherein FIGS. 34A and 34C are front views and FIGS. 34B and 34D are sectional views;

DETAILED DESCRIPTION OF THE PREFERRED EMBODIMENTS

A deflection defocusing correcting member of the present invention, a cathode ray tube employing the deflection defocusing correcting member, and an image display system including the cathode ray tube, have the following advantages:

A deflection defocusing amount in a cathode ray tube is, in general, rapidly increased with an increase in deflection amount. According to the present invention, deflection defocusing can be corrected by provision of a magnetic member in a deflection magnetic field for forming a locally modified non-uniform magnetic field having a variable focusing or diverging action on an electron beam when the electron beam is deflected and varied in its trajectory by a deflection magnetic field.

As one effective example of the locally modified non-uniform magnetic field capable of properly increasing a focusing or diverging action on an electron beam in accordance with a deflection amount when the electron beam is deflected and varied in its trajectory by a deflection magnetic field, locally modified non-uniform magnetic fields symmetrically distributed (as described hereinafter and illustrated in FIGS. 1A, 1B, 2A and 2B) or asymmetrically distributed (as described hereinafter and illustrated in FIGS. 3A–3D and FIGS. 4A–4D) depending upon a deflection direction may be disposed on opposite sides of a path of an undeflected electron beam.

The amount of the focusing or diverging action on an electron beam is increased as the electron beam is separated remotely from the path of the undeflected electron beam.

It is to be noted that the wording "locally modified non-uniform magnetic field" in the present invention means that magnetic flux densities vary.

Figure 1B:
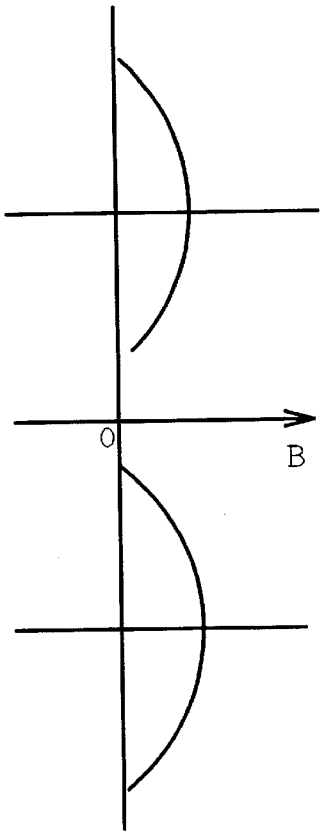
FIGS. 1A and 1B are respectively a schematic sectional view and a magnetic distribution diagram, illustrating a first embodiment of a method of correcting deflection defocusing of a cathode ray tube according to the present invention.
Figure 1A:
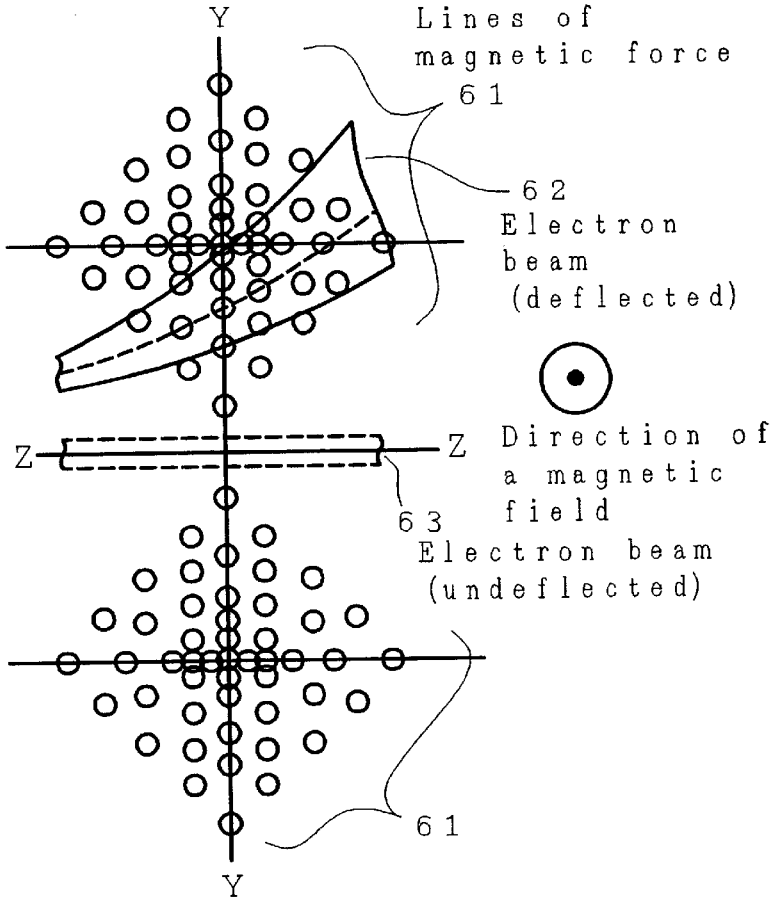

(1) Formation of Electron Beam-Diverging Magnetic Field Symmetrical with Respect to the Undeflected Beam Path (FIGS. 1A–1B)

The state of a deflected electron beam passing through each of the magnetic fields which are disposed on opposite sides of the path of the undeflected electron beam and which have a diverging action on the electron beam in synchronization with a deflection magnetic field, is compared with the state of the undeflected electron beam as follows: Namely, the electron beam passing through a portion remote from the path of the undeflected electron beam diverges as it travels in the locally modified non-uniform magnetic field, and the beam bundle is also separated remotely from the path of the undeflected electron beam.

The rate of change in trajectory is also larger on the side remote from the path of the undeflected electron beam. This is because the amount of correcting magnetic fluxes interlinked with the electron beam is increased at a position away from the path of the undeflected electron beam. The reason why the amount of the interlinked magnetic fluxes is increased is that an interval between lines of magnetic force becomes narrower (magnetic flux density is increased) and/or an area containing the interlinked magnetic field becomes wider.

In general, a distance from a main lens of an electron gun of a cathode ray tube to a phosphor screen is longer at a screen peripheral portion than at the screen center, so that when a deflection magnetic field has no focusing or diverging action on an electron beam, a focus voltage adjusted for the optimum focus of an electron beam at the screen center overfocuses the electron beam at the peripheral portion of the screen.

According to the present invention, the overfocusing of an electron beam at the peripheral portion of the screen can be reduced by forming, in a deflection magnetic field, a locally modified non-uniform magnetic field capable of increasing a diverging action in synchronization with an increase in deflection amount, thereby correcting the deflection defocusing in accordance with the deflection amount.

According to the present invention, when a deflection magnetic field has a focusing action on an electron beam, a locally modified non-uniform magnetic field capable of further increasing the strength of the diverging action is formed in the deflection magnetic field, so that the diverging action of the locally modified non-uniform magnetic field increased in synchronization with an increase in the deflection amount can overcome the increased focusing action of the deflection magnetic field, thereby correcting the deflection defocusing including overfocusing of an electron beam at a peripheral portion of the screen due to the geometrical structure of a cathode ray tube.

Figure 2B:
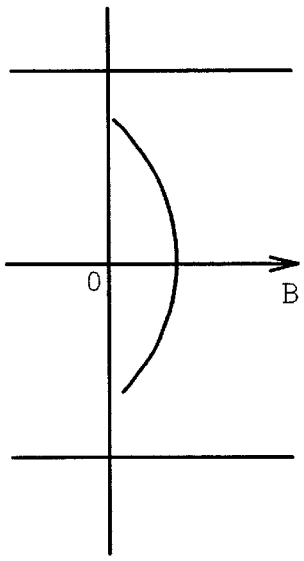
FIGS. 2A and 2B are respectively a schematic sectional view and a magnetic distribution diagram, illustrating a second embodiment of the method of correcting deflection defocusing of a cathode ray tube according to the present invention.
Figure 2A:
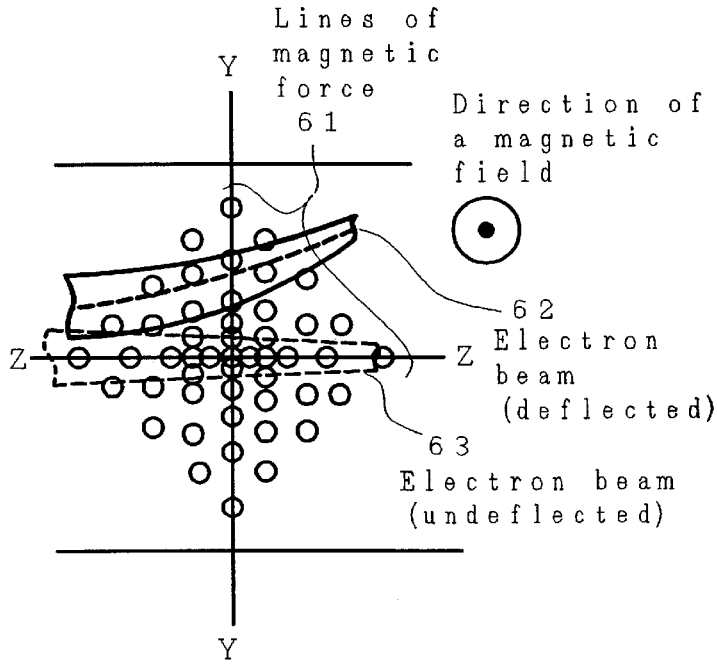

(2) Formation of Electron Beam-Focusing Magnetic Field Symmetrical with Respect to the Undeflected Beam Path (FIGS. 2A–2B)

In the case of forming a locally modified non-uniform magnetic field having a focusing action synchronized with a deflection magnetic field at a position substantially centered about a path of an undeflected electron beam, an electron beam deflected and passing through a portion remote from the path of the undeflected electron beam is compared with the undeflected electron beam as follows: Namely, the electron beam passing through a portion remote from the path of the undeflected electron beam focuses in an amount larger than that of the undeflected electron beam as it travels in the locally modified non-uniform magnetic field, and the beam bundle is also separated remotely from the path of the undeflected electron beam.

The rate of change in trajectory of the electron beam is smaller on the side remoter from the path of the undeflected electron beam. This is because the amount of magnetic fluxes interlinked with the electron beam is decreased at a position remoter from the path of the undeflected electron beam. The reason why the amount of the interlinked magnetic fluxes is decreased is that an interval between lines of magnetic force becomes wider (magnetic flux density is decreased) and/or an area providing the magnetic field becomes narrower.

When a deflection magnetic field has a diverging action on an electron beam, deflection defocusing can be corrected in accordance with a deflection amount by forming, in the deflection magnetic field, a locally modified non-uniform magnetic field capable of increasing a focusing action in synchronization with an increase in the deflection amount thereby reducing overfocusing of the electron beam at a peripheral portion of a phosphor screen.

In addition, technical means concerning deflection defocusing correction depending on the scanning direction, content of the correction, and amount of the correction, are generally independent from each other and are different in necessary cost; however, the present invention can simultaneously cope with them only by one technical means.

In a color cathode ray tube of the type having three inline guns disposed in a horizontal plane, a vertical deflection magnetic field having a barrel-shaped magnetic force line distribution and a horizontal deflection magnetic field having a pincushion-shaped magnetic force line distribution are used for eliminating or simplifying a circuit for controlling convergence of three electron beams on a phosphor screen.

The deflection defocusing amount of each side beam of three inline electron beams given by a deflection magnetic field is dependent on the intensity of the deflection magnetic field and on the direction of the horizontal deflection. For example, the magnetic flux distribution of the deflection magnetic field traversed by the right-hand electron beam of the inline arrangement (in the direction of the cathode ray tube seen from the phosphor screen side) differs between the case where it is deflected to the left half of the phosphor screen and the case where it is deflected to the right half, s, the deflection defocusing amount of the electron beam differs between the above two cases, and thereby the image quality differs between the right and left ends of the phosphor screen.

To eliminate the variation in the image quality at the right and left ends of the phosphor screen, the amount of a focusing or diverging action on each side electron beam is required to vary depending on whether the side electron beam is deflected rightward or leftward with respect to the axis of the side electron gun.

The present invention can effectively solve the above inconvenience of each side electron beam of the inline arrangement by forming, in the deflection magnetic field, locally modified non-uniform magnetic fields having distributions different on the right and left sides with respect to the axis of the electron gun.

(3) Formation of Electron Beam-Diverging Magnetic Field Asymmetrical with Respecting to the Underflected Beam Path (FIGS. 3A–3D)

In the case of forming locally modified non-uniform magnetic fields having diverging actions being different in strength and synchronized with a deflection magnetic field on opposite sides of a path of an undeflected electron beam, a deflected electron beam diverges in an amount larger than that of the undeflected electron beam as it travels in the locally modified non-uniform magnetic field, and the beam bundle of the deflected beam also moves away from the path of the undeflected electron beam.

The rate of change in trajectory of the electron beam is larger on the side remoter from the path of the undeflected electron beam. This is because the amount of magnetic fluxes interlinked with the electron beam is increased at a position away from the path of the undeflected electron beam. The reason why the amount of the interlinked magnetic fluxes is increased is that an interval between lines of magnetic force becomes narrower and/or an area having the magnetic field becomes wider. The rate of change in trajectory becomes larger as the degree of narrowing the interval in lines of magnetic force is increased and/or the degree of widening the area containing the magnetic field is increased.

In an area of the side where the rate of narrowing the interval in lines of magnetic force is decreased and/or the rate of widening the area containing the magnetic field is decreased with increasing distance from the path of the undeflected electron beam, a deflected electron beam diverges in an amount larger than that of the undeflected electron beam as it travels in the locally modified non-uniform magnetic field, and the beam bundle of the deflected electron beam also moves away from the path of the undeflected electron beam.

The rate of change in trajectory of the electron beam is larger on the side remoter from the path of the undeflected electron beam; however, the degree of the change in trajectory is smaller than that in the area of field side where the rate of narrowing the interval in lines of magnetic force is increased and/or the rate of widening the area having the magnetic field is increased with increasing distance from the path of the undeflected electron beam. This is because the rate of increasing the amount of the interlinked magnetic fluxes is small with increasing distance from the path of the undeflected electron beam. The reason why the degree of increasing the amount of the interlinked magnetic fluxes is small is that the degree of narrowing the interval between lines of magnetic force is small and/or the widening of the area having the magnetic field is small.

Accordingly, the deflection defocusing correction can be achieved by forming, in a deflection magnetic field, a magnetic field having a diverging action which increases in synchronization with an increase in a deflection amount in such a manner that the increasing degree thereof is dependent on the deflection direction.

(4) Formation of Electron Beam-Focusing Magnetic Field Asymmetrical with Respect to the Undeflected Beam Path (FIGS. 4A–4D)

When a deflection magnetic field has a diverging action on an electron beam gives a different deflection defocusing depending on the deflection direction to the electron beam, the deflection defocusing correction can be achieved by forming, in the magnetic field, a magnetic field with a distribution shown in FIGS. 4A to 4D, so that the focusing action of the magnetic field can increase in synchronization with an increase in a deflection amount in such a manner that the increasing degree thereof is dependent on the deflection direction.

In order to improve uniformity of resolution over the entire phosphor screen by forming a locally modified non-uniform magnetic field in a deflection magnetic field, an electron beam is required to be deflected in such a manner as to traverse a magnetic field area having a necessary distribution in an amount along the deflection direction. In other words, there is a suitable positional relationship between the locally modified non-uniform magnetic field and the deflection magnetic field.

At the same time, the effect of correcting deflection defocusing is dependent on the amount of the magnetic flux of the locally modified non-uniform magnetic field formed in the deflection magnetic field. The amount of the magnetic flux is dependent on a magnetic flux density and on an area having the magnetic field. The magnetic field is generated between at least two pole pieces. The magnetic flux density and the magnetic field area are determined by the combination of the structure and arrangement of the above pole pieces, and the magnetic flux density between the pole pieces, and further they are related to the practical diameter of an electron beam passing through the magnetic field and the practical magnitude of the magnetic flux density.

The above-described at least two pole pieces for forming a locally modified non-uniform magnetic field and correcting deflection defocusing in accordance with a deflection amount are referred to as "deflection defocusing correction pole pieces". The number of the pole pieces is not particularly limited, for example, may be three pieces or more, and part of the other electrode may be serves as the pole piece.

The amount of the magnetic flux necessary for deflection is dependent on a voltage on a phosphor screen, and these values can be consolidated into a single design parameter by dividing the magnetic flux amount by the square root of the voltage of the phosphor screen. The single design parameter makes clear the analysis of the trajectory of an electron beam in the non-uniform magnetic field, and is effective to improve the setting accuracy of the magnetic field and to achieve a suitable deflection defocusing correction.

The necessary magnetic flux is dependent on the area of the non-uniform magnetic field and the magnetic flux density thereof. The necessary magnetic density may be made smaller as an area providing the magnetic field is made wider. The magnetic flux density of the locally modified non-uniform magnetic field is also dependent on the positional relationship between a pair of the pole pieces for forming the locally modified non-uniform magnetic field, on the magnetic flux density between the pole pieces, and on the structure of the pole pieces. The intensity of the magnetic field near an electron beam is increased as the adjacent pole pieces come closer to the electron beam.

The intensity of the magnetic field can be increased by increasing the magnetic flux density between the adjacent pole pieces. The significantly increased intensity of the magnetic field, however, causes an inconvenience that a beam spot produced by an electron beam impinging on a portion near the screen center of the cathode ray tube is also largely distorted by the locally modified non-uniform magnetic field, with a result that deterioration in resolution near the screen center becomes intolerable. Accordingly, the magnetic density between the adjacent pole pieces has a limitation.

The narrowing of an interval between the above pole pieces may generate a focusing or diverging action on an electron beam with a slight change in trajectory of the electron beam; however, such an interval between the pole pieces is practically limited to 0.5 mm in consideration of the diameter of the electron beam. According to the present invention, in the case where the maximum deflection angle of the cathode ray tube is 100° or more, a desirable effect can be obtained when the above design parameter consolidating the magnetic flux density B and the voltage Eb on the phosphor screen satisfies the following equation:

$$B/\sqrt{Eb} \geqq 0.02\ \text{mT}\cdot(\text{kV})^{-1/2}$$

where B is in mT, and Eb is in kilovolts.

The distribution of a deflection magnetic field of a cathode ray tube concerns the structure of a deflection device. When the maximum deflection angle is specified, the maximum magnetic flux density among the magnetic flux densities divided by the square root of the voltage of the phosphor screen is substantially determined. The position of the locally modified non-uniform magnetic field formed in the deflection magnetic field may be set in the axial deflection magnetic field at an area having more than a specified level or more of the maximum magnetic density.

The above method of setting the position of the locally modified non-uniform magnetic field significantly simplifies the measurement of the magnetic flux density as compared with the case of setting the position of the locally modified non-uniform magnetic field on the basis of the absolute value of the magnetic flux density. Namely, the measurement of the magnetic flux density in this method may be relatively compared with the maximum magnetic flux density, and thereby this method is advantageous from the practical viewpoint. In this case, the maximum magnetic flux density varies depending on the shape of a magnetic material; however, an error due to such a variation is negligible.

According to the present invention, when the maximum deflection angle of a cathode ray tube is 100° or more, the effect can be practically achieved by specifying the level of the above magnetic flux density to be 5% or more of the maximum magnetic flux density of a deflection magnetic field distribution at the end portions, on the phosphor screen side, of the pole pieces for forming a locally modified non-uniform magnetic field, in consideration of the pole pieces and the positional relationship between the pole pieces.

Since the magnetic flux density is dependent on a relative permeability of the magnetic member (pole pieces), it is closely dependent on the position of a magnetic core of a coil for generating a deflection magnetic field. The area having a necessary magnetic flux density may be determined on the basis of a distance between pole pieces for forming a locally modified non-uniform magnetic field and the above core of the coil. This method, which is only based on the position of the core of the coil for generating a deflection magnetic field, can omit the measurement of a magnetic flux density, and thereby it is advantageous from the practical viewpoint.

In such a method, the magnetic flux density distribution varies depending on the shape of the core; however, an error due to such a variation is negligible.

According to the present invention, when the maximum deflection angle of a cathode ray tube is 100° or more, the effect can be practically achieved by specifying a distance between the end portion, on the side remote from a phosphor screen, of a core and end portions, on the phosphor screen side, of polepieces for forming a locally modified non-uniform magnetic field to be 50 mm or less, in consideration of the pole pieces and the positional relationship between the pole pieces.

In the case where the end portions, on the phosphor screen side, of the pole pieces have axial intention (irregularities) of the cathode ray tube, the above distance is determined as a value between the end portion, on the side remote from the phosphor screen, of the core and the longest end portions, on the phosphor screen side, of the pole pieces.

Similarly, according to the present invention, in the case where the maximum deflection angle of the cathode ray tube is 100° or less, a desirable effect can be obtained when the above design parameter consolidating the magnetic flux density B and the voltage Eb of the phosphor screen satisfies the following equation:

$$B/\sqrt{Eb} \geqq 0.004\ \text{mT}\cdot(\text{kV})^{-1/2}$$

where B is in mT, and Eb is in kilovolts.

The intensity of the above non-uniformity magnetic field in a cathode ray tube cannot be freely increased from the practical viewpoint, for example, in consideration of the entire configuration of the cathode ray tube, and the structure, easy of fabrication and easy of use of an electron gun used for the cathode ray tube.

In the present invention, to achieve the effect even for a magnetic field having a relatively low intensity in terms of easy of use, an electron beam is required to have a suitable diameter in such a region. In general, an electron beam has a large diameter at a portion near a main lens in a cathode ray tube. Accordingly, the position of the deflection defocusing correction pole pieces for forming a locally modified non-uniform magnetic field is related to a distance from a main lens. On the other hand, when the pole pieces are disposed at a position extremely shifted from the main lens portion toward the cathode side, the astigmatism is easy to be canceled by a focusing action of the main lens, and further there often occurs an inconvenience in that part of electron beams impinge on part of electrodes of an electron gun.

According to the present invention, the effect can be achieved by specifying a distance between end portions, on the phosphor screen side, of pole pieces for forming a locally modified non-uniform magnetic field and an end portion, facing a main lens, of an anode of an electron gun to be five times or less of an aperture diameter (in the direction perpendicular to the scanning direction) of the end portion of the anode or 180 mm or less; and a distance between the end portions, on the cathode side, of the pole pieces and the end portion of the anode to be three times or less of the above aperture diameter of the anode or 108 mm or less, in consideration of conditions that the maximum deflection angle of the cathode ray tube is less than 85°, the single electron beam is used, and a magnetic field is used for focusing an electron beam.

The present invention requires a magnetic flux density of a deflection magnetic field in an amount suitable to achieve the effect of the locally modified non-uniform magnetic field. The magnetic sheet laminated on, or butt-welded to the non-magnetic sheet and constituting the deflection defocusing correction pole pieces may be made of a soft magnetic material, and preferably, part of the pole pieces may be made of a magnetic material having a high magnetic permeability for enhancing the magnetic flux density and improving the effect of the deflection defocusing correction.

The deflection defocusing correction pole pieces of the present invention are required to be positioned near a path of an electron beam. For example, the pole pieces are disposed at opposite sides of a path of an electron beam. As previously described, locally modified non-uniform magnetic fields synchronized with a deflection magnetic field and symmetrically distributed (FIGS. 1A, 1B, 2A and 2B) or asymmetrically distributed (FIGS. 3A–3D and 4A–4D) in the deflection direction, are disposed on opposite sides of a path of an undeflected electron beam.

The above two kinds of locally modified non-uniform magnetic fields can be formed by provision of the above pole pieces having a specified structure. In general, an electrode part of an electron gun of a cathode ray tube is manufactured by press-forming of a metal plate.

In recent years, the requirement for the accuracy of the above electrode components for a cathode ray tube has been increased with the significantly improved focus characteristics of a cathode ray tube. The deflection defocusing correction magnetic pole pieces are also required to be improved in accuracy. The machining accuracy of the pole pieces can be improved at a low cost in mass-production by press-forming of a metal plate into the pole pieces.

The deflection defocusing correcting member according to one embodiment of the present invention is comprised of a non-magnetic sheet, such as a stainless steel sheet, clad with soft magnetic sheets, such as Permalloy sheets. Both the non-magnetic and magnetic sheets can be formed from long thin sheets. It is preferable to laminate a sheet of a soft magnetic material and of a width narrower than that of a non-magnetic sheet serving as a support, but slightly larger than a diameter of an electron beam aperture to be formed in the deflection defocusing correcting member, on the non-magnetic sheet. The deflection defocusing correcting member are formed by punching out in the clad (laminated) sheets an electron beam aperture and openings in the vicinity of the electron beam aperture forming pole pieces for generating a non-uniform magnetic field varying with beam deflection.

The deflection defocusing correcting member according to another embodiment of the present invention is formed from a pair of long non-magnetic sheets, such as a stainless steel sheet and a long soft magnetic sheet, such as Permalloy sheet alternately arranged and jointed long edge to long edge with each other. A width of a soft magnetic sheet is preferably smaller than that of the non-magnetic sheets, but slightly larger than a diameter of an electron beam aperture to be formed in the deflection defocusing correcting member. The deflection defocusing correcting member are formed by punching out in the butt-welded sheets an electron beam aperture and openings in the vicinity of the electron beam aperture forming pole pieces for generating a non-uniform magnetic field varying with beam deflection by locally modifying a deflection magnetic field.

The deflection in a cathode ray tube is often performed in such a manner as to form scanning lines as described above. In most cases, a phosphor screen of the cathode ray tube of the line scanning type deflection is formed in an approximately rectangular shape, and the scanning is generally performed substantially in parallel to the sides of the rectangular screen. An evacuated envelope of the cathode ray tube for supporting the phosphor screen is also formed in an approximately rectangular shape corresponding to the phosphor screen in terms of easy of assembly to an image display system.

The above two kinds of the locally modified non-uniform magnetic field of the present invention are thus desirable to be formed in association with the scanning line and the shape of the phosphor screen. The locally modified non-uniform magnetic fields can be formed in the scanning direction and in the direction perpendicular to the scanning direction in accordance with the application use of the cathode ray tube.

The interval between the magnetic pole pieces of the present invention is closely related to the intensity of the magnetic field produced by the pole pieces and the trajectory of an electron beam passing through the interval. An extremely large interval between the pole pieces fails to obtain a desirable effect.

The depth of an image display system including a cathode ray tube cannot be freely shortened because it is restricted by the axial length of the cathode ray tube.

One means for shortening the axial length of a cathode ray tube is to increase the maximum deflection angle of the cathode ray tube. The practical maximum deflection angle at present is 114° for a single-beam cathode ray tube, and a value near 114° for a cathode ray tube of the three inline electron beam type.

The maximum deflection angle tends to be further increased in the future. The increased maximum deflection angle significantly increases the maximum magnetic flux density of a deflection magnetic field. The maximum deflection angle is practically related to a diameter of a neck portion.

The desirable outside diameter of a neck portion is about 40 mm at maximum in order to save an electric power for generating a deflection magnetic field and to save a material of a mechanism portion for producing the deflection magnetic field.

In general, the maximum diameter of electrodes of an electron gun is smaller than the inside diameter of a neck portion of a cathode ray tube, and the neck portion requires a wall thickness of several mm for ensuring both a mechanical strength and an insulating performance and for preventing leakage of X-rays.

According to the present invention, the narrowest distance of the interval between the above deflection defocusing correction pole pieces in the scanning direction or in the direction perpendicular to the scanning direction is desirable to be 1.5 or less 5 times a diameter of an aperture in an end facing a focus electrode, of an anode of an electron gun measured in the direction perpendicular to the scanning direction or to be usually in a range of from 0.5 to 30 mm, in consideration of the limitations concerning the electrodes and magnetic field. Such a distance has an advantage in cost and it can sufficiently ensure the operating characteristic.

The locally modified non-uniform magnetic fields of the present invention can be formed by provision of pole pieces on opposite sides of a path of an electron beam.

The opposing direction of the pole pieces may be set in the scanning direction or in the direction perpendicular to the scanning direction for a cathode ray tube of performing deflection of the scanning direction type.

In the case where the deflection defocusing correction pole pieces for forming a locally modified non-uniform magnetic field synchronized with a deflection magnetic field are provided in such a manner as to increase a beam-diverging action increased in accordance with an increase in a deflection amount, the magnetic field between the opposed portions of the pole pieces must have a magnetic flux density higher than that of the neighborhood deflection magnetic field having a focusing action.

According to the present invention, the intensity of the magnetic field between the opposed portions of the pole pieces can be made higher than that of the neighborhood deflection magnetic field by specifying the shapes of the pole pieces. It is possible to omit electrodes disposed between opposing portions of two pole pieces facing each other.

The locally modified non-uniform magnetic field having a high intensity varying in synchronization with a variation in the deflection magnetic field can be formed between the opposed portions of the pole pieces by provision, in the deflection magnetic field having a sufficient magnetic flux density, of the pole pieces having both a suitably selected structure and a distance between the opposed portions, thereby forming a suitable magnetic path between the opposed portions.

When deflection defocusing is corrected by forming in a deflection magnetic field a locally modified non-uniform magnetic field synchronized with a deflection magnetic field, it is desirable that the locally modified non-uniform magnetic field can exhibit the effect even in a relatively low magnetic field from the practical viewpoint, and thereby an electron beam is required to have a suitable diameter in such a region.

In general, the diameter of an electron beam is large near a main lens in a cathode ray tube. The position of the deflection defocusing correction pole pieces is related to a distance from the main lens; however, the distance from the main lens is not made constant because the structure of the pole pieces varies depending on a deflection magnetic field, the structure of an electron gun, the suitability to a wide electron beam current region, and the suitability to a specified electron beam current region.

In a cathode ray tube, particularly, in a color cathode ray tube of the inline plural beam type or a color display tube, a deflection magnetic field for an electron beam is made inhomogeneous for simplifying convergence adjustment. In such a case, a main lens is desirable to be separated from a deflection magnetic field generating portion as much as possible for suppressing distortion of an electron beam due to the deflection magnetic field, and consequently, the deflection magnetic field generating portion is usually disposed at a position on the phosphor screen side from the main lens of an electron gun.

According to the present invention, when deflection defocusing is corrected by forming in a deflection magnetic field a locally modified non-uniform magnetic field synchronized with the deflection magnetic field, the deflection magnetic field generating portion and the main lens can be positioned to be close to each other by forming the locally modified non-uniform magnetic field while previously estimating a distortion of an electron beam due to the above inhomogeneous deflection magnetic field.

According to the present invention, when the maximum deflection angle of a cathode ray tube is 100° or more, the optimum distance between an end portion, on the side remote from a phosphor screen, of a magnetic material forming a core of a coil for forming the above deflection magnetic field and an end portion, facing a focus electrode, of an anode of an electron gun is 60 mm or less.

On the other hand, the length between a cathode and a main lens of an electron gun is desirable to be made longer for reducing an image magnification of the electron gun thereby making smaller a beam spot diameter on a phosphor screen.

A cathode ray tube having an excellent resolution in consideration of the above two functions thus tends to be increased in its axial length.

According to the present invention, however, the image magnification of the electron gun can be further reduced to further decrease the electron beam spot diameter on the phosphor screen and at the same time the axial length can be shortened by moving the position of the main focus electrode toward the phosphor screen without a change in the length between the cathode and the main lens of the electron gun.

The length of time the electron beam experiences mutual space-charge repulsion of electrons can be shortened by moving the position of the main lens toward the phosphor screen, so that a beam spot diameter on the phosphor screen can be further reduced.

According to the present invention, the optimum distance between the deflection magnetic field and the main lens in the case where the maximum deflection is 100° or more, make the end facing the main lens, of the anode of the electron gun lie within an region having a magnetic flux of 10% or more of the maximum magnetic flux density of the magnetic field for deflection in the scanning line direction and/or in the direction perpendicular to the scanning line direction.

According to the present invention, the optimum distance between the deflection magnetic field and the main lens in the case where the maximum deflection magnetic field is 100° or more includes a region in which a voltage Eb on the phosphor screen of the cathode ray tube, a magnetic flux density B of a magnetic field for deflecting an electron beam in the scanning direction or in the direction perpendicular to the scanning direction in the deflection magnetic field at an end portion, facing the main lens, of an anode of an electron gun, and an anode voltage Eb satisfy the following equation:

$$B/\sqrt{Eb} \geqq 0.004\ mT\cdot(kV)^{-1/2}$$

where B is in mT and Eb is in kilovolts.

According to the present invention, the optimum positions of the neck portion of the cathode ray and the main lens of the electron gun are set in such a manner that the position of an end portion, facing the main lens, of the anode of the electron gun is within 15 mm or less on the side remote from the phosphor screen with respect to the end portion, on the phosphor screen side, of the neck portion.

The main lens of the electron gun in the related art is located at a position separated remotely from the deflection magnetic field, and accordingly a voltage is supplied to the anode of the electron gun from the inner wall of the neck portion of the cathode ray tube.

On the contrary, according to the present invention, the main lens of the electron gun is not required to be separated from the deflection magnetic field and can be disposed near the phosphor screen, and thereby a voltage can be supplied to the anode of the electron gun from a portion other than the inner wall of the neck portion of the cathode ray tube.

Since a high electric field is formed in a narrow space in a cathode ray tube, it becomes important to stabilize a breakdown voltage characteristic for improving reliability. The maximum intensity of the electric field is generated near a main lens of an electron gun. The electric field near the main lens is dependent on a graphite film coated on the inner wall of a neck portion of the cathode ray tube for supplying a voltage to an anode of an electron gun, and on foreign matters remaining in the cathode ray tube and sticking to the inner wall of the neck portion.

According to the present invention, the main lens of the electron gun can be disposed to be closer to the phosphor screen side, so that it is possible to significantly stabilize the breakdown voltage characteristic.

An electron beam is not affected by a deflection magnetic field when it forms a beam spot at the center of a phosphor screen. Accordingly, in this case, a measure for preventing distortion of the electron beam due to the deflection magnetic field is not required and thereby the lens of the electron gun comes to be of an axially symmetrical focusing system, with a result that the diameter of an electron beam spot on the phosphor screen can be made smaller.

According to the present invention, in addition to a locally modified non-uniform magnetic field synchronized with a deflection magnetic field which is formed in the deflection magnetic field for correcting deflection defocusing, a dynamic voltage synchronized with the deflection can be applied to part of electrodes of an electron gun for further increasing a suitable focusing action on an electron beam over the entire screen, thereby obtaining a desirable resolution over the entire screen. The necessary dynamic voltage can be reduced.

According to the present invention, in addition to a locally modified non-uniform magnetic field synchronized with a deflection magnetic field which is formed in the deflection magnetic field for correcting deflection defocusing, at least one of electric fields of a plurality of electrostatic lenses formed of a plurality of electrodes of an electron gun can be made non-axially-symmetrical. This allows an electron beam spot at the screen center in a large-current region to be formed in an approximately circular or rectangular shape. The non-axially symmetrical electric field also forms an electrostatic lens having a focus characteristic having a higher focus voltage optimized for focusing an electron beam in the beam scanning line direction than a focus voltage optimized for focusing the electron beam in the direction perpendicular to the scanning line direction, and an electrostatic lens having a higher focus voltage optimized for focusing an electron beam in the scanning line direction than a focus voltage optimized for focusing the electron beam in a direction perpendicular to the scanning line direction and having a diameter in the direction perpendicular to the scanning line direction of an electron beam spot at the center of the phosphor screen in a small current region optimized for an aperture pitch in the direction perpendicular to the scanning line in a shadow mask and the density of the scanning lines rather than a diameter in the scanning line direction of the electron beam spot. These lenses formed by the non-axially symmetrical electric field give to an electron beam a desirable focus characteristic without any moire over the entire screen and over the entire current region.

It is to be noted that the wording "non-axially-symmetry" in the present specification means a plane curve other than a plane curve formed by the locus of points equidistant from a given fixed point, like a circle. For example, a "non-axially symmetric" beam spot means a non-circular beam spot.

Since a locally modified non-uniform magnetic field synchronized with a deflection magnetic field is formed in the deflection magnetic field in the present invention, a main lens of an electron gun can be disposed to be closer to the deflection magnetic field as compared with the related art.

Since the deflection magnetic field also penetrates into the main lens of the electron gun, electrodes on the side nearer to the phosphor screen than the prior art main lens are configured to have such a structure to prevent electrons from striking them. According to one embodiment, in the inline three-beam electron gun having a plurality of electrodes, a single hole 100A having no partition member and allowing three electron beams to pass therethrough is provided in a shield cup.

In the case where deflection defocusing correction pole pieces are disposed nearer to the phosphor screen than to an electron beam aperture formed in the bottom surface of the shield cup, it is desirable that a space is provided between the opposing portions of the pole pieces for reducing a probability of electron beams striking an electrode mounting the pole pieces even when the trajectory of the deflected electron beams extend deeper into the locally modified non-uniform magnetic field, thereby promoting the effect of the locally modified non-uniform magnetic field synchronized with the deflection magnetic field and improving uniformity of resolution over the entire phosphor screen.

According to the present invention, deflection defocusing of each of three electron beams in a three inline beam electron gun is corrected by forming in a deflection magnetic field a locally modified non-uniform magnetic field synchronized with the deflection magnetic field. In this case, pole pieces for forming the locally modified non-uniform magnetic fields can be so constructed that the structure of the pole piece for the center electron beam is different from that of the pole piece for each side electron beam. This makes it possible to adjust the balance of resolutions of the three electron beams on the phosphor screen.

The above pole piece for each side electron beam can be also so constructed that the structure on the center electron beam side in the inline direction is different from that on the opposite side. This makes it possible to reduce coma error due to the deflection magnetic field.

Although the effects of the individual techniques of the present invention have been described, present invention can further improve, by the combination of two or more of the techniques, uniformity of resolution over the entire phosphor screen of a cathode ray tube and resolution at the screen center over the entire current region, and can shorten the axial length of the cathode ray tube.

The present invention can also provide an image display system capable of improving uniformity of resolution over the entire phosphor screen and resolution at the screen center over the entire current region, and of shortening the depth of the system, by the use of the above cathode ray tube.

Next, the mechanism by means of which the focus characteristics and the resolution of a cathode ray tube using an electron gun of the present invention are improved will be described.

Figure 43:
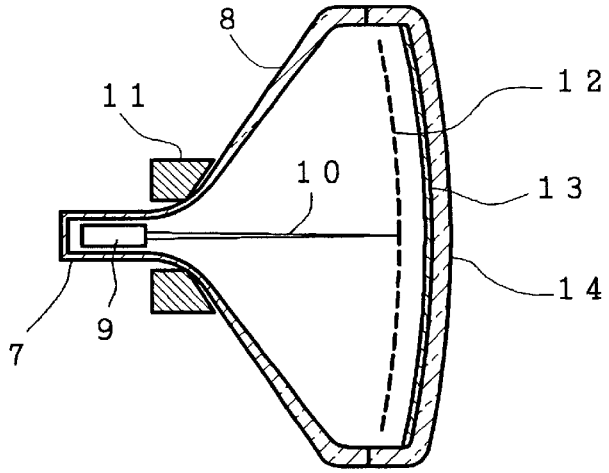
FIG. 43 is a schematic sectional view of a color cathode ray tube of the inline electron gun and shadow mask type.

FIG. 43 is a schematic sectional view of a color cathode ray tube of the inline electron gun and shadow mask type. In this figure, reference numeral 7 indicates a neck; 8 is a funnel; 9 is an electron gun contained in the neck 7; 10 is an electron beam; 11 is a deflection yoke; 12 is a shadow mask; 13 is a phosphor film forming a phosphor screen; and 14 is a panel (screen).

Referring to FIG. 43, the electron beam 10 emitted from the electron gun 9 is deflected in the horizontal and vertical directions by the deflection yoke 11, is passed through the shadow mask 12, and excites the phosphor film 13 to emit light. A pattern formed by the light-emitting phosphor film is observed as an image from the panel 14 side.

Figure 44:
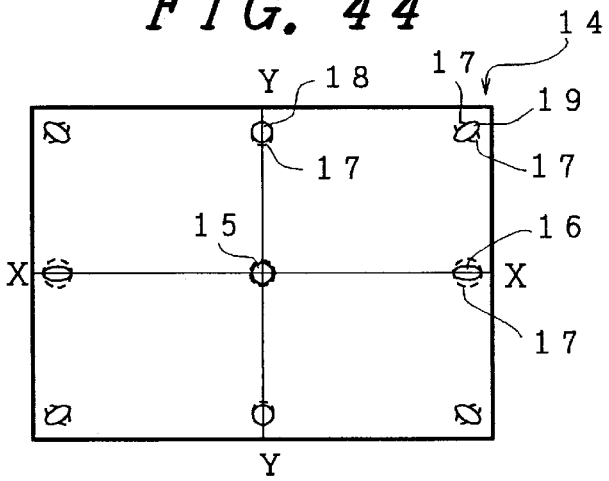
FIG. 44 is a view illustrating an electron beam spot in the case where peripheral phosphors are excited by an electron beam focused to a circular spot at the screen center.

FIG. 44 is a diagram illustrating electron beam spots at peripheral portions of the screen produced by an electron beam adjusted for a circular spot at the screen center. Reference numeral 14 indicates a screen; 15 is a beam spot at the screen center; 16 is a beam spot at each edge of the screen on the horizontal center line (X—X); 17 is a halo; 18 is a beam spot at each of the top and bottom of the screen on the vertical center line (Y—Y); and 19 is a beam spot at each end of diagonal lines of the screen (corner).

Figure 45:
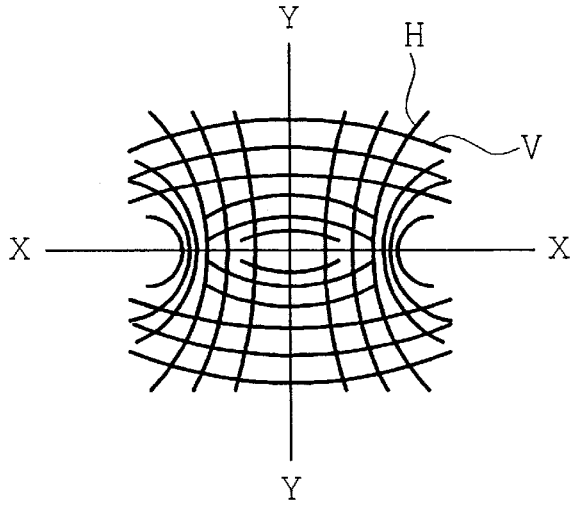
FIG. 45 is a view illustrating a deflection magnetic field distribution of a cathode ray tube.
Figure 46:
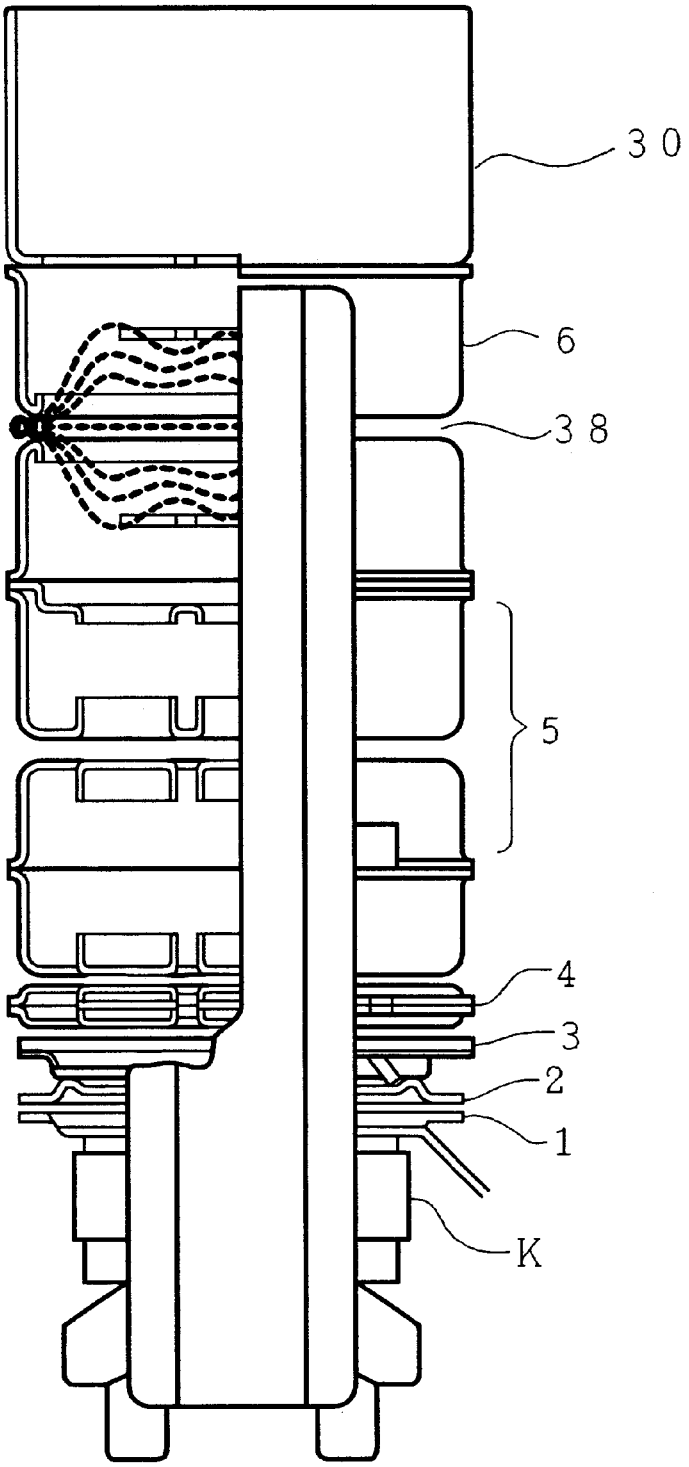
FIG. 46 (PRIOR ART)
FIG. 46 is a partially cutaway side view of an example of an electron gun for a cathode ray tube.
Figure 47A:
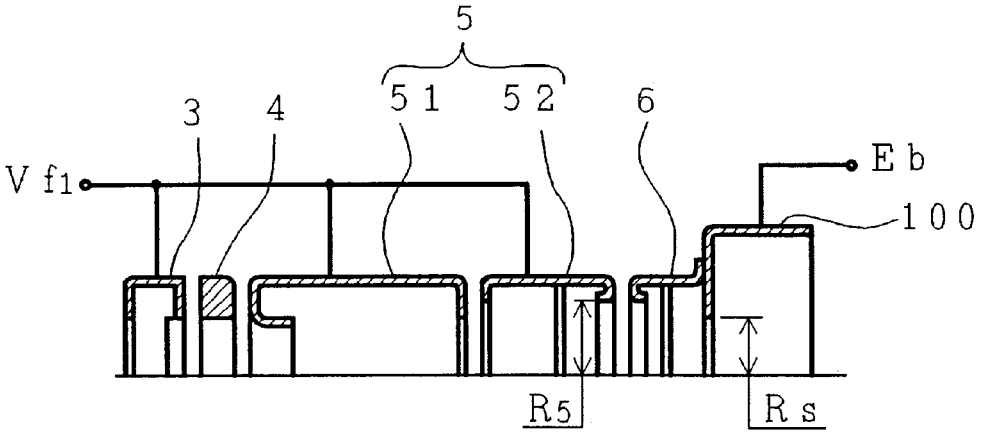
FIG. 47A (PRIOR ART)
FIGS. 47A and 47B are schematic sectional views of an electron gun for comparison of gun structures and the manner of supplying focus voltages, respectively.
Figure 47B:
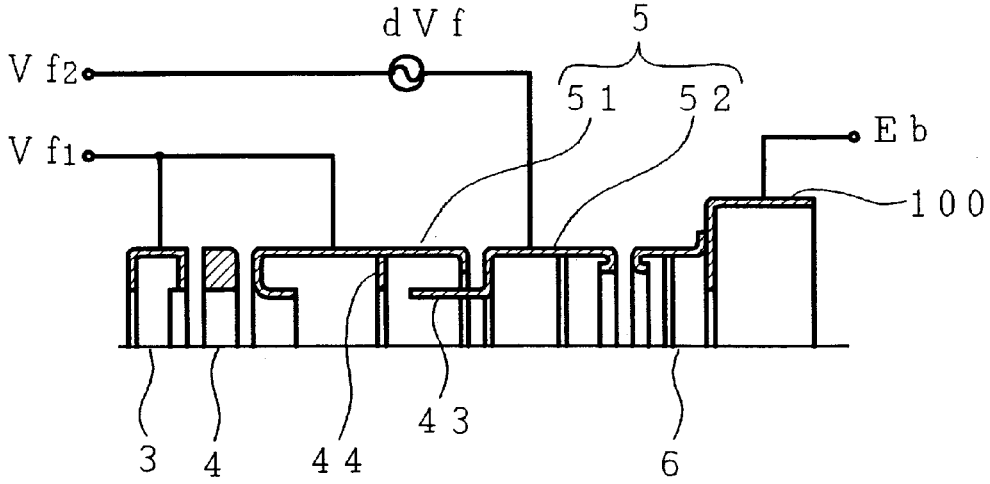
FIG. 47B (PRIOR ART)

FIG. 45 is a diagram illustrating a deflection magnetic field distribution of a cathode ray tube. In this figure, reference character H indicates a horizontal deflection magnetic field distribution, and V is a vertical deflection magnetic field distribution.

A recent color cathode ray tube uses a horizontal magnetic field H of a pincushion type inhomogeneous magnetic field distribution and a vertical magnetic field V of a barrel type inhomogeneous magnetic field distribution for simplifying convergence adjustment (see FIG. 45).

A light-emitting spot by the electron beam 10 is formed in a non-circular shape on a peripheral portion of the screen because of the above inhomogeneous magnetic field distribution, a difference in the path length of the electron beam 10 from a main lens to the phosphor screen between the center and the peripheral portion of the phosphor screen, and oblique impinging of the electron beam 10 on the phosphor film 13 at the peripheral portion of the screen.

As shown in FIG. 44, while the beam spot 15 at the screen center is circular, the beam spot 16 at each edge of the screen on the horizontal center line is horizontally elongated and a halo 17 is also generated thereat. As a result, the size of the beam spot 16 at the edge of the screen on the horizontal center line becomes larger, and further the contour of the spot 16 becomes unclear due to the generation of the halo 17. This degrades the resolution, resulting in the significantly reduced image quality.

In the case where the current of the electron beam 10 is small, the diameter of the electron beam 10 in the vertical direction is excessively reduced, and thereby the electron beam 10 interferes with the vertical aperture pitch of the shadow mask 12. This generates moire phenomenon and reduces the image quality.

The beam spot 18 at each of the top and bottom of the screen on the vertical center line is vertically compressed by vertical focusing of the electron beam 10 by the vertical deflection magnetic field and a halo 17 is also generated thereat, thus degrading the image quality.

The beam spot 19 at each of the corners of the screen is formed in a combined shape of the elongation as in the spot 16 and the vertically compression as in the spot 18, and further the rotation of the electron beam 10 is rotated thereat. Thus, at the corner of the screen, a halo 17 is generated and the diameter of the light-emitting spot is increased, thus significantly degrading the image quality.

As described above, in the usual application use of the cathode ray tube, each lens for forming a non-axially symmetrical electric field must be disposed at a position which differs between the large-current region and the small-current region for improving the resolution over the entire screen. The degree of non-axially-symmetry of each lens is also limited because of limited changes in the intensity of the electric field. The increase in intensity of the non-axially symmetrical electric field distorts the beam spot shape extremely at some portions of a lens, resulting in the reduced resolution.

Although the general means for suppressing the degradation in focus characteristics due to distortion of the electron beam spot diameter has been described, the actual electron gun has the above-described two types for suppressing the degradation in focus characteristics. One is a type in which a focus voltage is fixed; and the other is a type in which the optimum focus voltage at each position on the screen of the cathode ray tube is dynamically varied in accordance with a deflection angle of the electron beam.

The above two types have advantages and disadvantages. The type in which the focus voltage is fixed has an inexpensive structure of the electron gun and also has a simple and inexpensive power supply circuit for supplying a focus voltage; however, it is disadvantageous in that the optimum focus for astigmatism correction cannot be obtained at each position on the screen of the cathode ray tube, with a result that the diameter of the beam spot is made larger than that in the optimum focus.

On the other hand, the type in which the optimum focus voltage is dynamically supplied for an electron beam deflected to each position on the screen of the cathode ray tube in accordance with the deflection angle of the electron beam is advantageous in that a desirable focus characteristic can be obtained at each point on the screen; however, it is disadvantageous in that the structures of the electron gun and the power supply circuit for supplying a focus voltage are complicated and thereby it takes a lot of time to set a focus voltage in an assembling process of a TV receiver set or a terminal display system, resulting in the increased cost.

A dynamic focus voltage needs to be adjusted to be phased to electron beam deflection. Especially, for use in multimedia expected to be widely spread soon, a display system needs to be capable of being driven at a plurality of deflection frequencies. This requires dynamic focus voltage generators for respective deflection frequencies and phasing a dynamic focus voltage to electron beam deflection at respective frequencies, and increases the cost of electrical circuits and set-up procedures.

The present invention provides a cathode ray tube using an electron gun which has respective advantages of the above two types while eliminating the disadvantages thereof, and further has a new third advantage capable of shortening the axial length, a deflection defocusing correcting member, a manufacturing method thereof, and an image display system including the cathode ray tube.

Embodiments

Hereinafter, the embodiments of the present invention will be described in detail with reference to the accompanying drawings.

As a deflection amount is increased in a cathode ray tube, a deflection defocusing amount is rapidly increased.

The present invention is intended to suitably focus an electron beam deflected to change its trajectory and hence to improve uniformity of resolution over the entire phosphor screen, by forming in the deflection magnetic field a locally modified non-uniform magnetic field having a focusing or diverging action on the electron beam varying in synchronization with the deflection magnetic field.

The present invention is also intended to correct the deflection defocusing rapidly increased in synchronization with the deflection amount of an electron beam deflected to change it trajectory and hence to suitably focus the electron beam over the entire phosphor screen, by forming in the deflection magnetic field a locally modified non-uniform magnetic field capable of increasing rapidly the amount of deflection defocusing correction in synchronization with the deflection amount of the electron beam. This is effective for improving uniformity of resolution over the entire phosphor screen.

(1A) Formation of Electron Beam-Diverging Magnetic Field Symmetrical with Respect to the Undeflected Beam Path (FIGS. 1A and 1B)

As one example of the locally modified non-uniform magnetic field capable of properly increasing a diverging action on an electron beam deflected to change its trajectory in synchronization with the deflection amount, locally modified non-uniform magnetic fields are effectively disposed at substantially symmetric positions on opposite sides of a path of an undeflected electron beam.

The formation of the locally modified non-uniform magnetic fields synchronized with a deflection magnetic field at substantially symmetric positions on opposite sides of the path of the undeflected electron beam, causes the amount of a diverging action on an electron beam to be increased in synchronization with the deflection amount.

FIGS. 1A and 1B are schematic views illustrating an embodiment of a method of correcting deflection defocusing of a cathode ray tube according to the present invention. FIG. 1A shows an electron beam in cross-section, which diverges by the effect of locally modified non-uniform magnetic fields each having a diverging action synchronized with a deflection magnetic field as shown in FIG. 1B. In addition, the locally modified non-uniform magnetic fields are disposed at symmetric positions with respect to a center path Z-Z of an undeflected electron beam.

In FIG. 1A, reference numeral 61 indicates lines of magnetic force; 62 is an electron beam passing through a portion remote from the center path of the undeflected electron beam; and 63 is the path of the undeflected electron beam. In addition, the locally modified non-uniform magnetic fields having a diverging action in synchronization with the deflection magnetic field are not present at the center path of the undeflected electron beam 63, and the undeflected electron beam 63 is shown by broken lines for differentiation from the electron beam 62.

The electron beam 62 deflected and passing through a portion remote from the center path of the undeflected electron beam 63 diverges in an amount larger than that of the undeflected electron beam 63 while it travels in the magnetic field. The beam bundle also moves away from the center path of the undeflected electron beam 63. The rate of change in the trajectory of the electron beam 62 is larger on the side remoter from the center path of the undeflected electron beam 63. This is because an interval between lines of magnetic force is narrower as the lines of magnetic force are remoter from the center path of the undeflected electron beam 63.

The formation of the above locally modified non-uniform magnetic fields synchronized with the deflection amount of an electron beam in the deflection magnetic field, causes a diverging action on the electron beam deflected and varied in the trajectory to be increased in synchronization with the deflection amount. This makes it possible to correct deflection defocusing in the case where deflection defocusing increases the focusing of the electron beam.

For example, in a cathode ray tube, a distance from a main lens of an electron gun to a phosphor screen is generally longer at a peripheral portion than the center. As a result, even in the case where a deflection magnetic field has no focusing action, adjustment for the optimum focusing of an electron beam at the screen center causes overfocusing of the electron beam at the screen peripheral portion.

In this embodiment, the formation of the locally modified non-uniform magnetic fields synchronized with the deflection amount of an electron beam in a deflection magnetic field as shown in FIGS. 1A and 1B, causes a diverging action on the electron beam to be increased in synchronization with the deflection amount. This enables the correction of deflection defocusing (2A) Formation of Electron Beam-Focusing Magnetic Field Symmetrical with Respect to the Undeflected Beam Path (FIGS. 2A and 2B)

As one example of the locally modified non-uniform magnetic field capable of properly increasing a focusing action on an electron beam deflected and varied in the trajectory in synchronization with the deflection amount, a locally modified non-uniform magnetic field synchronized with the deflection amount is effectively formed in such a manner as to be centered on the path of the undeflected electron beam.

The formation of the above locally modified non-uniform magnetic field synchronized with the deflection magnetic field in such a manner as to be centered on the path of the undeflected electron beam, allows a focusing action on an electron beam to be increased in synchronization with the deflection amount.

FIGS. 2A and 2B are schematic views illustrating another embodiment of the method of correcting deflection defocusing of a cathode ray tube according to the present invention. FIG. 2A shows an electron beam in cross-section, which focuses by the effect of a locally modified non-uniform magnetic field having a focusing action. In addition, the locally modified non-uniform magnetic field is disposed in such a manner as to be centered on a center path Z-Z of an undeflected electron beam.

In FIG. 2A, reference numeral 61 indicates lines of magnetic force forming the locally modified non-uniform magnetic field synchronized with a deflection magnetic field shown in FIG. 2B; 62 is an electron beam passing through a portion remote from the center path Z-Z of the undeflected electron beam; and 63 is an undeflected electron beam, which is shown by broken lines as the undeflected electron beam shown in FIG. 1A.

The electron beam 62 passing through a portion remote from the center path of the undeflected electron beam 63 focuses in an amount larger than that of the undeflected electron beam 63 as it travels in the magnetic field. The beam bundle also becomes emote from the center path of the undeflected electron beam. The rate of change in trajectory is smaller on the side remote from the center path of the undeflected electron beam. This is because the interval in lines 61 of magnetic force is wider as lines 61 of magnetic force are remote from the center path Z-Z of the undeflected electron beam.

The formation of the above locally modified non-uniform magnetic field in the deflection magnetic field, causes a focusing action on the electron beam deflected and varied in trajectory to be increased in synchronization with the deflection amount. This makes it possible to correct deflection defocusing in the case where the deflection defocusing increases divergence of the electron beam.

In most cases, the deflection of a cathode ray tube is performed for causing an electron beam to linearly scan. A linear scanning locus 60 is called scanning line. Most deflection magnetic fields differ between in the scanning line direction and in the direction perpendicular to the scanning line direction.

The electron beam often receives a focusing action which differs between in the scanning direction and the direction perpendicular to the scanning direction, by the effect of at least one of a plurality of electrodes of an electron gun before it largely receives the action of the locally modified non-uniform magnetic field synchronized with the deflection magnetic field which is formed in the deflection magnetic field.

Moreover, it is dependent on the application of a cathode ray tube whether deflection defocusing correction is emphasized in the scanning direction or in the direction perpendicular to the scanning line direction.

Accordingly, the content of the locally modified non-uniform magnetic field, which is synchronized with a deflection magnetic field and is formed in the deflection magnetic field for correcting deflection defocusing and improving uniformity of resolution over the entire phosphor screen, cannot be simply determined.

The technical content and the required cost are dependent on the direction of deflection defocusing correction with respect to the scanning line direction, content of the correction, and the correction amount, and accordingly, it is important for improving characteristics of an image display system and reducing the cost to clarify the desired content of the deflection defocusing correction in accordance with respective factors.

According to another embodiment of a method of correcting deflection defocusing of a cathode ray tube of the present invention, deflection defocusing in the scanning direction and/or in the direction perpendicular to the scanning direction is corrected by forming, in a deflection magnetic field, the locally modified non-uniform magnetic fields shown in FIGS. 1A, 1B and FIGS. 2A, 2B.

In a color cathode ray tube of the type having three inline guns disposed in a horizontal plane, a vertical deflection magnetic field having a barrel-shaped magnetic field distribution and a horizontal deflection magnetic field having a pincushion-shaped magnetic field distribution are used as shown in FIG. 45 (described later) for eliminating or simplifying a circuit for controlling convergence of three electron beams on a phosphor screen.

The amount of deflection defocusing of side electron beams of three inline electron beams by a deflection magnetic field is dependent on the intensity of the deflection magnetic field and on the direction of the horizontal deflection. For example, the magnetic flux distribution of the deflection magnetic field, which the right-hand electron beam of the inline arrangement (seen from the phosphor screen side) traverses, differs between the case where the right-hand electron beam is deflected to the left half side of the phosphor screen and the case where it is deflected to the right half side thereof. As a result, the amount of the deflection defocusing of the right-hand electron beam differs between the above two cases, and thereby the image quality produced by the right-hand electron beam differs between the right and left ends of the phosphor screen.

(3A) Formation of an Electron Beam-Diverging Magnetic Field Asymmetrical with Respect to the Undeflected Beam Path (FIGS. 3A–3D)

To correct deflection defocusing of a side electron beam, it is effective that a locally modified non-uniform magnetic field synchronized with the deflection magnetic field and asymmetric in the direction of the horizontal deflection is disposed in the deflection magnetic field on opposite sides of the center electron gun axis.

FIGS. 3A to 3D are schematic views illustrating another embodiment of the method of correcting deflection defocusing of a cathode ray tube according to the present invention. In this embodiment, locally modified non-uniform magnetic fields, each having a different magnetic field distribution and a diverging action on an electron beam, are provided on opposite sides of an electron gun axis.

Figure 3B:
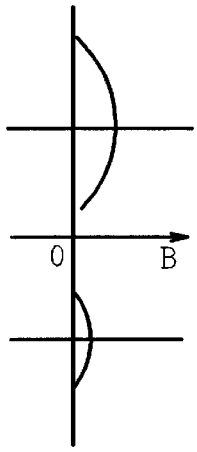
Figure 3A:
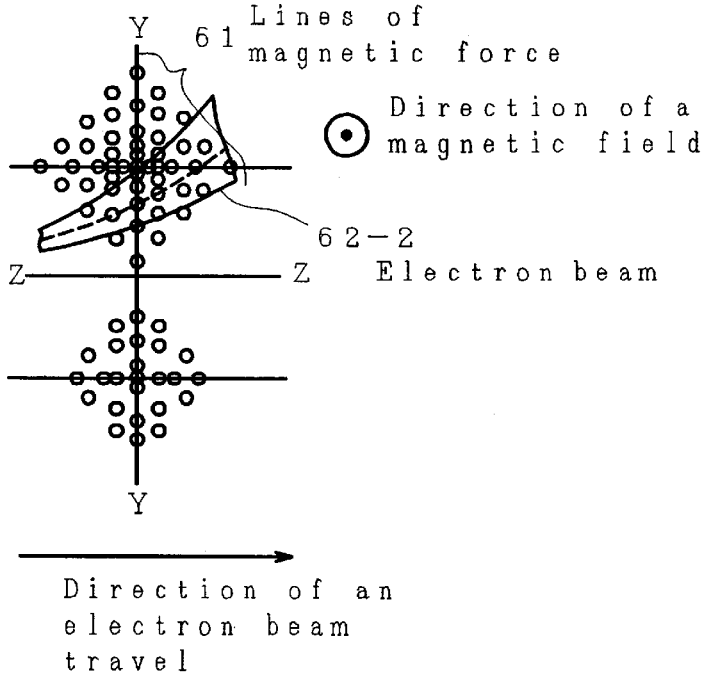

FIGS. 3A and 3B are schematic views illustrating divergence of an electron beam on the side in which the density of lines of magnetic force is high. An electron beam 62-2 passing through a portion remote from the center axis Z-Z of the electron gun on the side in which the density of lines 61 of magnetic force is high diverges as it travels in the correction magnetic field. The beam bundle also moves away from the center axis Z-Z of the electron gun. The rate of change in trajectory is larger on the side remoter from the center axis Z-Z of the electron gun. This is because an interval between the lines 61 of magnetic force is narrower as the lines 61 of magnetic force are remoter from the center axis Z-Z of the electron gun.

Figure 3D:
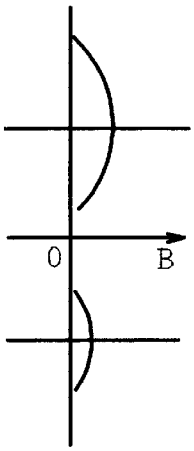
Figure 3C:
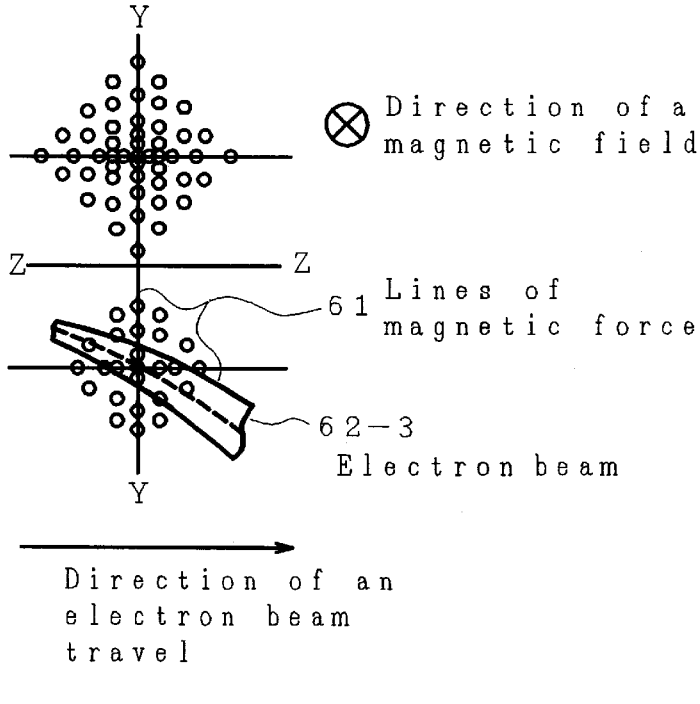

FIGS. 3C and 3D are schematic views illustrating the divergence of an electron beam on the side where the density of lines of magnetic force is low. An electron beam 62-3 passing through a portion remote from the center axis Z-Z of the electron gun diverges like the electron beam 62-2 as it travels in the correction magnetic field, and the beam bundle also becomes remote from the center axis Z-Z. The rate of change in trajectory of the electron beam 62-3 is larger on the side remoter from the center axis Z-Z; however, the rate of the change of the trajectory of the electron beam 62-3 is lower than that of the electron beam 62-2. This is because the interval between the lines 61 of magnetic force is not so narrower as the lines 61 of magnetic force are remoter from the center axis Z-Z.

The above locally modified non-uniform magnetic fields synchronized with the deflection amount, which is formed in the deflection magnetic field, allows the degree of increasing a diverging action exerted on an electron beam deflected and varied in the trajectory in synchronization with the deflection amount to vary depending on the deflection direction. This is effective to correct deflection defocusing in the case of such a focusing action that the amount of deflection defocusing is dependent on the deflection direction.

In practice, the deflection defocusing correction is dependent on, for example, the structure of a cathode ray tube having a specified maximum deflection angle; the structure of a deflection magnetic field generating portion assembled in the cathode ray tube; pole pieces for forming the locally modified non-uniform magnetic fields; the structure of the electron gun other than the pole pieces; the drive condition of the cathode ray tube; and the application of the cathode ray tube.

(4A) Formation of an Electron Beam-Focusing Magnetic Field Asymmetrical with Respect to the Undeflected Beam Path (FIGS. 4A–4D)

Figure 4B:
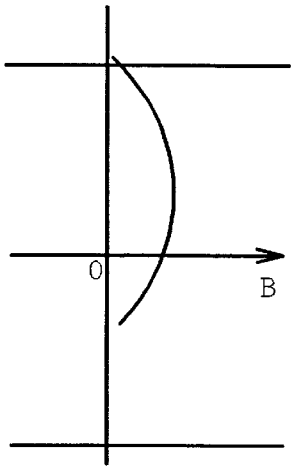
Figure 4A:
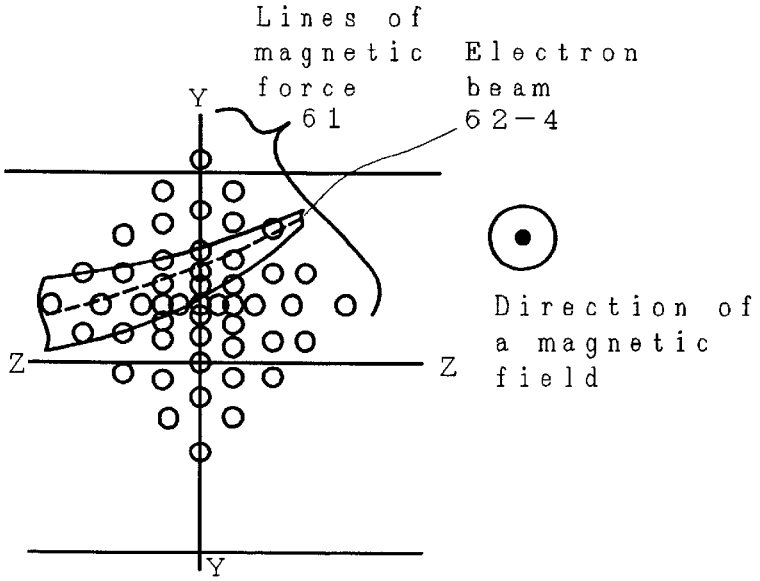
Figure 4D:
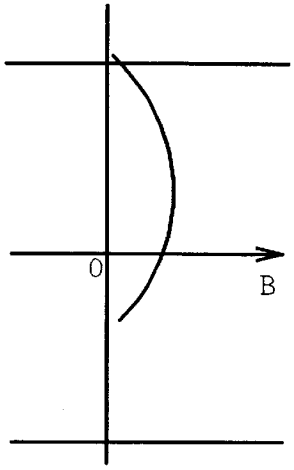
Figure 4C:
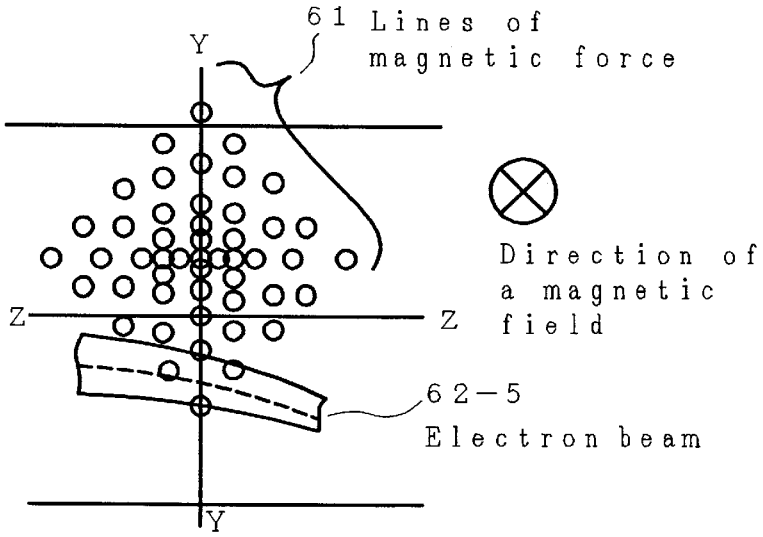

FIGS. 4A to 4D are schematic views illustrating another embodiment of a method of correcting deflection defocusing of a cathode ray tube according to the present invention. In this embodiment, a locally modified non-uniform magnetic field having an asymmetric focusing action on an electron beam is provided near the center axis of an electron gun. An electron beam 62-4 is deflected and passes through a portion remote from the center axis Z-Z of the electron gun on the side where the magnetic flux density is high in the magnetic field formed by lines 61 of magnetic force (FIG. 4A), and an electron beam 62-5 is deflected and passes through a portion remote from the center axis of the electron gun on the side where the magnetic flux density is low in the magnetic field formed by the lines 61 of magnetic force (FIG. 4C).

The electron beam 62-4 passing through the portion remote from the center axis Z-Z on the side where the magnetic flux density is high focuses as it travels in the magnetic field (see FIG. 4A). The beam bundle also moves away from the center axis Z-Z. The rate of change in the trajectory of the electron beam 62-4 is larger on the side nearer the center axis Z-Z. This is because an interval between the lines 61 of the magnetic force is wider as the lines 61 of magnetic force are remoter from the center axis Z-Z.

The electron beam 62-5 passing through the portion remote from the center axis Z-Z on the side where the magnetic flux density is low focuses like the electron beam 62-4 as it travels in the magnetic field (see FIG. 4B). The beam bundle also moves away from the center axis Z-Z. The rate of the change in the trajectory of the electron beam 62-5 is larger on the side near the center axis Z-Z; however, the rate of change in trajectory of the electron beam 62-5 is smaller than that of the electron beam 62-4. This is because the interval between the lines 61 of magnetic force does not change so much with increasing distance from the center axis Z-Z.

The above locally modified non-uniform magnetic fields synchronized with the deflection amount, which is formed in the deflection magnetic field, causes the rate of increase in a focusing action exerted on a deflected electron beam to vary depending on the deflection direction. This is effective to correct deflection defocusing in the case of such a diverging action that the amount of deflection defocusing is dependent on the deflection direction.

In practice, the deflection defocusing correction is dependent on, for example, the structure of a cathode ray tube having a specified maximum deflection angle; the structure of a deflection magnetic field generating portion assembled into the cathode ray tube; pole pieces for forming the locally modified non-uniform magnetic fields; the structure of the electron gun other than the pole pieces; the drive condition of the cathode ray tube; and the application of the cathode ray tube.

In a color cathode ray tube of the type having three inline guns disposed in a horizontal plane, a vertical deflection magnetic field having a barrel-shaped magnetic line distribution and a horizontal deflection magnetic field having a pincushion-shaped magnetic field distribution are used as shown in FIG. 45 (described later) for eliminating or simplifying a circuit for controlling convergence of three electron beams on a phosphor screen.

In such a color cathode ray tube, the inline direction, that is, the horizontal direction becomes the scanning line direction. The amount of deflection defocusing of each side electron beam of three inline electron beams caused by a deflection magnetic field is dependent on the intensity of the deflection magnetic field and on the direction of the horizontal deflection.

For example, the magnetic flux distribution of the deflection magnetic field, which the right-hand electron beam of the inline arrangement (seen from the phosphor screen side) traverses, differs between the case where the right-hand electron beam is deflected to the left half side of the phosphor screen and the case where it is deflected to the right half side thereof. As a result, the amount of the deflection defocusing of the right-hand electron beam differs between the above two cases.

According to a further embodiment of a method of correcting deflection defocusing of a cathode ray tube of the present invention, deflection defocusing of each of side electron beams is corrected by forming, in the deflection magnetic field for the side electron beam, the locally modified non-uniform magnetic field synchronized with the deflection magnetic field in such a manner as to be asymmetric with respect to the center axis of the electron gun as shown in FIGS. 3A to 3D or FIGS. 4A and 4D.

In practice, the deflection defocusing correction is dependent on, for example, the structure of a cathode ray tube having a specified maximum deflection angle; the structure of a deflection magnetic field generating portion assembled into the cathode ray tube; pole pieces for forming the locally modified non-uniform magnetic fields; the structure of the electron gun other than the pole pieces; the drive condition of the cathode ray tube; and the application of the cathode ray tube.

Figure 5:
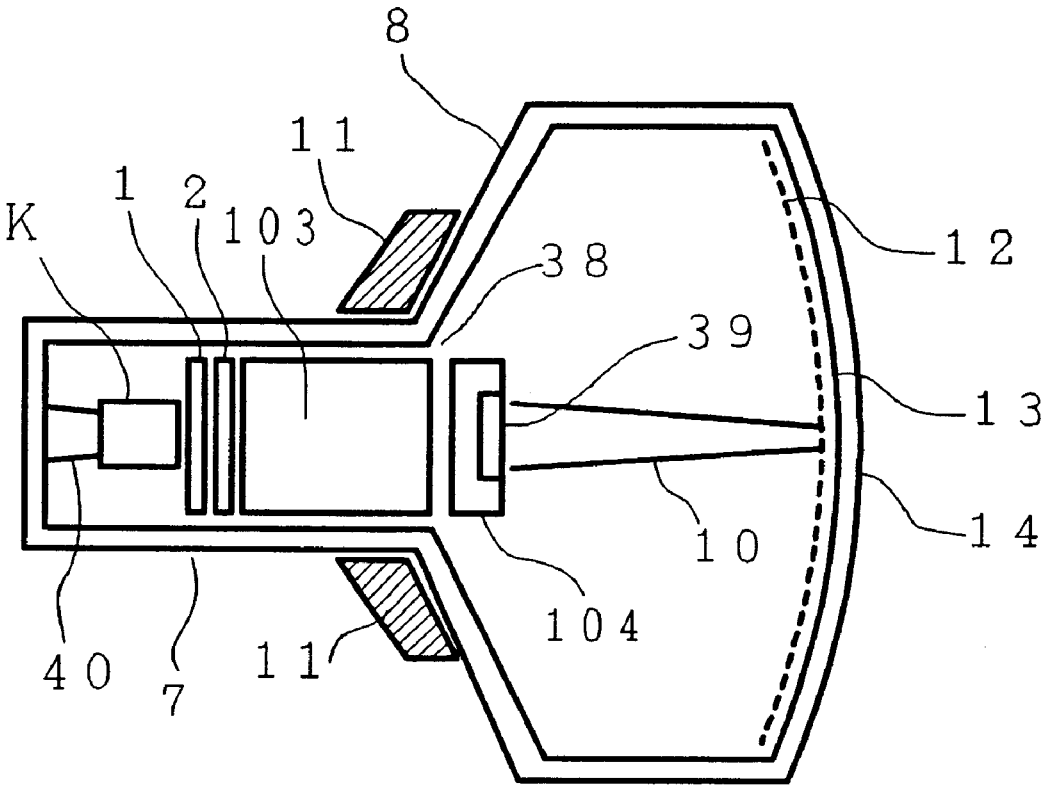
FIG. 5 is a schematic sectional view illustrating a first embodiment of a cathode ray tube of the present invention.

FIG. 5 is a schematic sectional view illustrating an embodiment of a cathode ray tube of the present invention. Reference numeral 1 indicates a first grid electrode (G1) of an electron gun; 2 is a second grid electrode (G2); 103 is a third grid electrode (G3) which is a focus electrode in this embodiment.

Reference numeral 104 indicated a fourth grid electrode (G4) which is an anode in this embodiment; 7 is a neck portion of the cathode ray tube for containing the electron gun; 8 is a funnel portion; and 14 is a panel portion. These portions 7, 8 and 14 constitute an evacuated envelop of the cathode ray tube.

Reference numeral 10 indicates an electron beam emitted from the electron gun, which passes through an aperture of a shadow mask 12 and impinges on a phosphor film 13 formed on the inner surface of the panel 14 to emit light for displaying an image on the screen of the cathode ray tube. Reference numeral 11 indicates a deflection yoke for deflecting the electron beam 10, which generates a magnetic field in synchronization with a video signal for controlling a point of impingement of the electron beam 10 on the phosphor film 13.

Reference numeral 38 indicates a main lens of the electron gun. The electron beam 10 emitted from a cathode K passes through the first grid electrode (G1) 1, the second grid electrode (G2) 2, the third grid electrode (G3) 103, and then it focuses on the phosphor screen 13 by the electric field of the main lens 38 formed between the third grid electrode (G3) 103 and the anode 104.

Reference numeral 39 indicates a deflection defocusing correcting member positioned in the magnetic field of the deflection yoke 11, for forming at least one locally modified non-uniform magnetic field synchronized with the deflection field, thereby correcting deflection defocusing of the electron beam 10 deflected by the magnetic field of the deflection yoke 11 in synchronization with the deflection angle. Two of the deflection defocusing correction pole pieces 39 are mechanically fixed on the anode 104 at positions above and below of the electron beam 10, that is, in the direction perpendicular to the paper surface. These pole pieces 39 form a locally modified non-uniform magnetic field having a diverging action on the electron beam 10 passing through the interval between the pole pieces 39. In addition, reference numeral 40 indicates a cord for connecting the electrode of the electron gun to a stem pin (not shown).

The vertical interval between the two pole pieces of the deflection defocusing correcting member 39 spaced from each other is actually determined by the combined effects of the mounting position of each pole piece; the length thereof extending toward the phosphor film 13; the distribution of the deflection magnetic field; the diameter of the electron beam passing through the interval; and the maximum deflection angle of the cathode ray tube. As shown in FIG. 5, the main lens 38 of the electron gun is located at the position shifted to the phosphor film 13 from the deflection yoke mounting position in the deflection magnetic field of the deflection yoke 11; however, it is not particularly limited in the mounting position shown in the figure so long as being positioned in the magnetic field of the deflection yoke.

Figure 6:
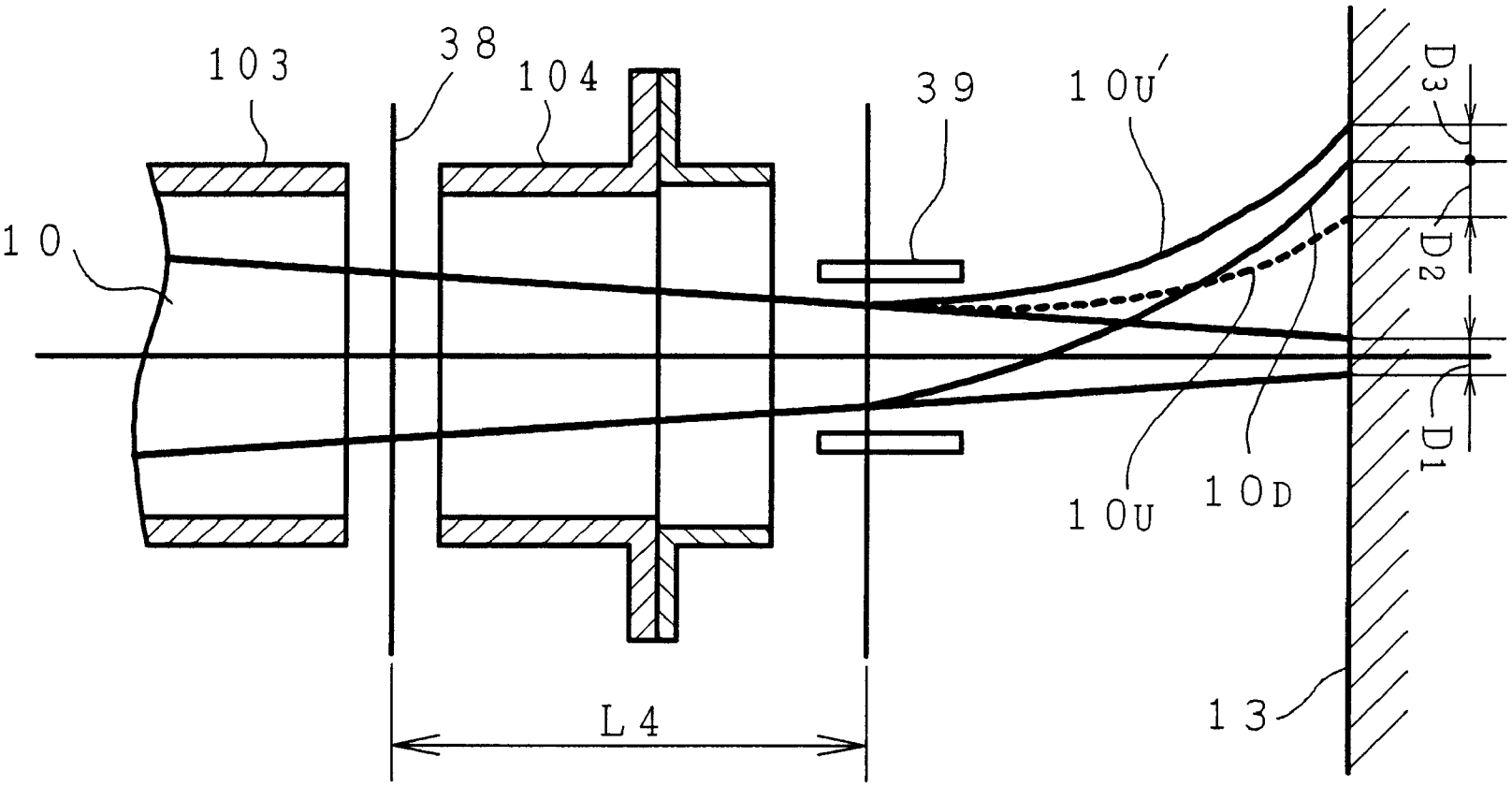
FIG. 6 is a schematic sectional view of an essential portion of the cathode ray tube of the present invention, illustrating an operation of the cathode ray tube.

(1B) Effects of an Electron Beam-Diverging Deflection Defocusing Correcting Member in a Cathode Ray Tube FIG. 6 is a schematic sectional view illustrating the operation of the cathode ray tube of the present invention, particularly, illustrating the operation of the deflection defocusing correcting member 39. The pole pieces of the deflection defocusing correcting member 39 positioned in the magnetic field of the deflection yoke 11 shown in FIG. 5 form a locally modified non-uniform magnetic field for correcting deflection defocusing of the electron beam 10 deflected by the magnetic field of the deflection yoke 11 in synchronization with the deflection angle.

In this example, the electron beam 10 diverges by the locally modified non-uniform magnetic field. In FIG. 6, parts corresponding to those shown in FIG. 5 are indicated by the same characters.

Figure 7:
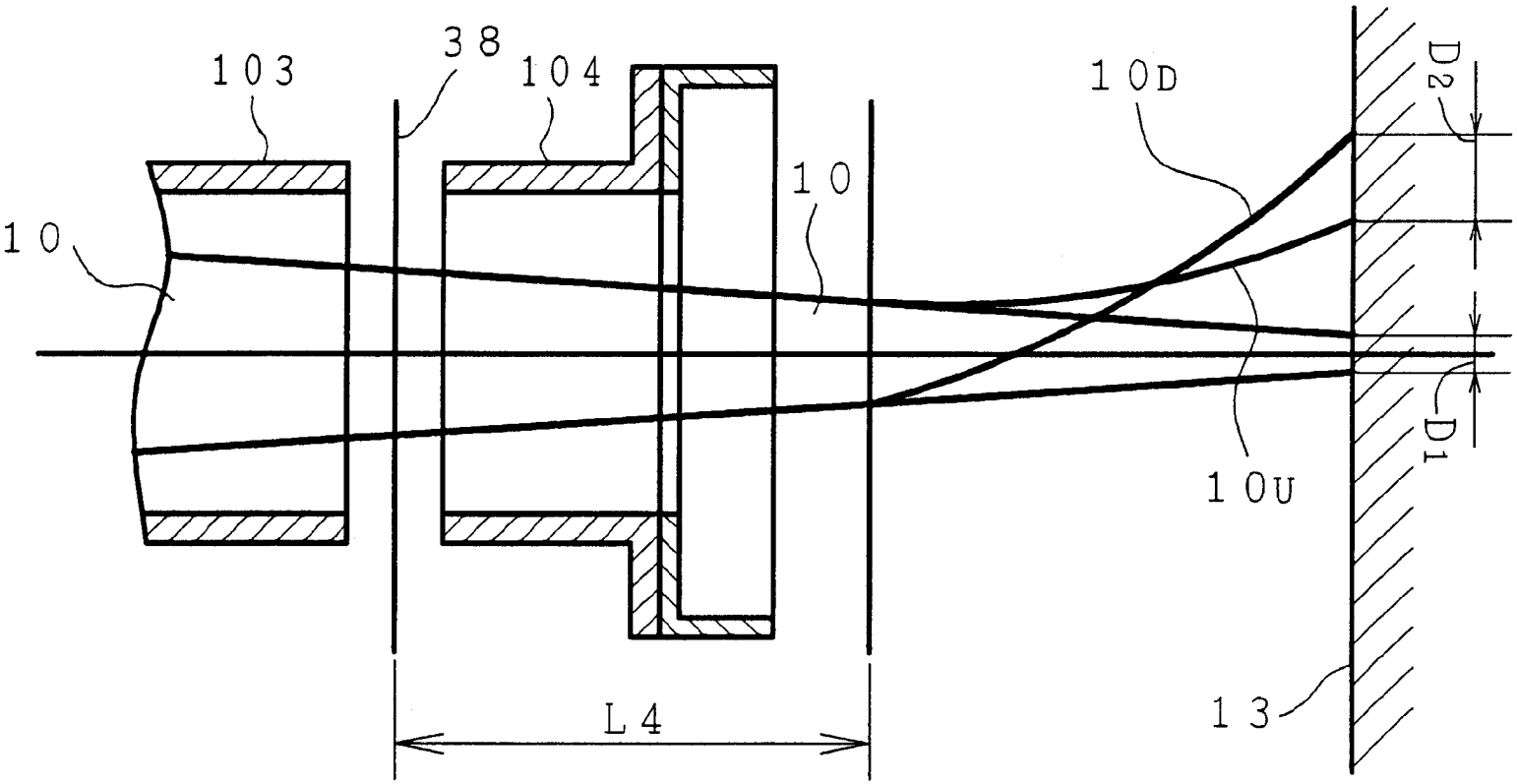
FIG. 7 is a schematic sectional view, similar to FIG. 6, of an essential portion of a cathode ray tube in which deflection defocusing correction pole pieces are not provided, illustrating the effect of the deflection defocusing correction pole pieces for forming a locally modified non-uniform magnetic field in the cathode ray tube of the present invention in comparison with a related art.

FIG. 7 is a schematic sectional view, similar to FIG. 6, of a cathode ray tube having no pole piece for illustrating the operation of the pole pieces of the present invention in comparison with the related art.

Referring to FIGS. 6 and 7, the electron beam 10 passes through the third grid electrode (G3) 103 of the electron gun focuses by a main lens 38 formed between the third grid electrode (G3) 103 and the fourth grid electrode (G4) 104. When being deflected by a deflection magnetic field formed by the deflection yoke 11, the electron beam 10 travels straight and forms a beam spot having a diameter of D1 on a phosphor film 13.

Here, it will be qualitatively described how the trajectory of the electron beam 10 is changed by the presence (FIG. 6) or absence (FIG. 7) of the pole pieces of the deflection defocusing correcting member 39 in the case where the electron beam 10 is deflected to the upper side of the phosphor film 13.

Referring to FIG. 7, the lowermost ray trajectory of the electron beam 10 is shown by reference numeral 10D because the pole pieces 39 are not provided. The uppermost ray trajectory of the electron beam 10 is shown by reference numeral 10U because the pole pieces 39 are not provided and it crosses the lowermost ray trajectory 10D before reaching the phosphor film 13. As a result, a beam spot having a diameter D2 shown in FIG. 7 is formed on the phosphor film 13.

As shown in FIG. 6, when the pole pieces of the deflection defocusing correcting member 39 are provided, the uppermost ray trajectory of the electron beam 10 travels as shown by reference numeral 10U' by the effect of lines of magnetic force formed by the pole pieces of the deflection defocusing correcting member 39. The lowermost ray trajectory of the electron beam 10 is shown by reference numeral 10D because the deflection magnetic field in the trajectory is reduced by the magnetic path formed by the pole pieces of the deflection defocusing correcting member 39, and thereby it reaches the phosphor film 13 without crossing the uppermost ray trajectory before the phosphor film 13.

As a result, a beam spot having a diameter D3 smaller than the diameter D2 is formed on the phosphor film 13. This is due to the fact that the locally modified non-uniform magnetic fields are formed as shown in FIGS. 1A and 1B.

The shape of the beam spot having the diameter D3 on the phosphor film 13 can be suitably adjusted by the combination of the mounting positions of the pole pieces 39; the length of the pole piece 39 to the phosphor film 13; the distribution of the deflection magnetic field; the diameter of the electron beam passing through the interval between the pole pieces 39; and the maximum deflection angle. Uniform resolution over the entire screen can be thus obtained by making smaller the difference between the diameter D3 and the diameter D1 of the beam spot at the screen center.

Figure 8A:
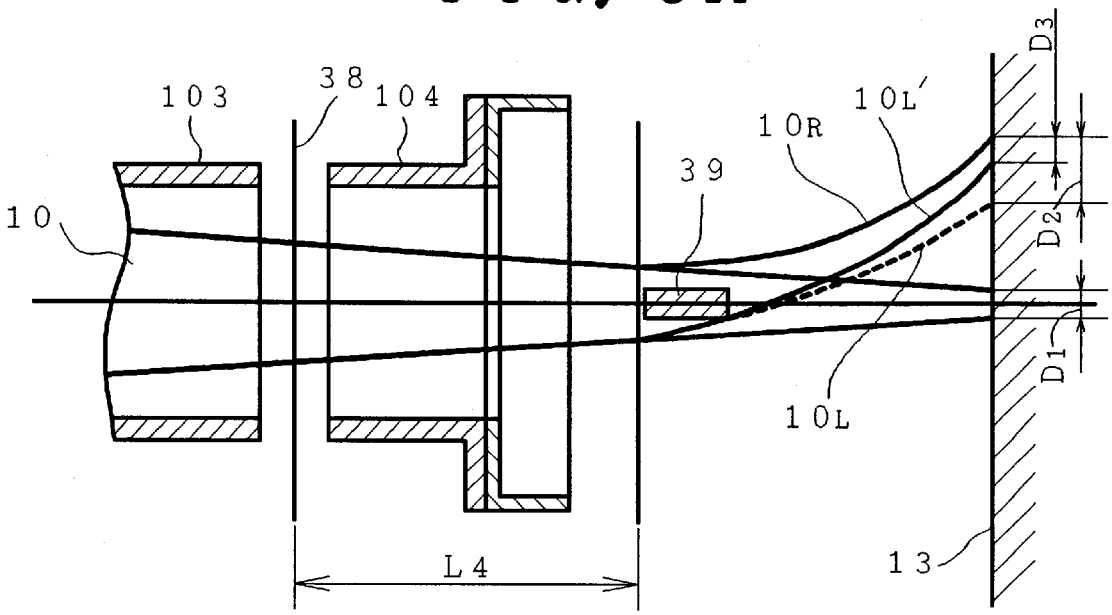
FIGS. 8A and 8B are respectively a sectional top view and a sectional side view, of an essential portion of the cathode ray tube of the present invention, illustrating another operation of the cathode ray tube.
Figure 8B:
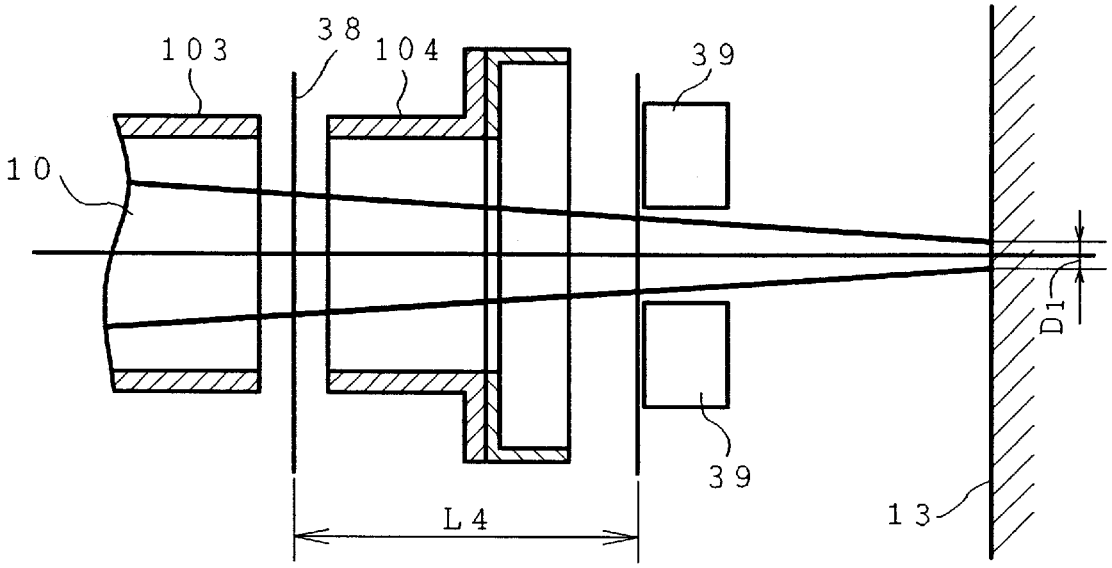

(2B) Effects of an Electron Beam-Focusing Deflection Defocusing Correcting Member in a Cathode Ray Tube FIGS. 8A and 8B are schematic sectional views illustrating the operation of another embodiment of the cathode ray tube of the present invention, particularly, illustrating another operation of the deflection defocusing correction pole pieces 39, wherein FIG. 8A is a sectional top view and FIG. 8B is a sectional side view. The deflection defocusing correcting member 39 positioned in the magnetic field of the deflection yoke 11 shown in FIG. 5 form a locally modified non-uniform magnetic field for correcting deflection defocusing of the electron beam 10 deflected by the magnetic field of the deflection yoke 11 in synchronization with the deflection angle.

In this example, the electron beam 10 focuses by the above locally modified non-uniform magnetic field. In these figures, parts corresponding to those shown in FIG. 5 are indicated by the same characters.

Figure 9:
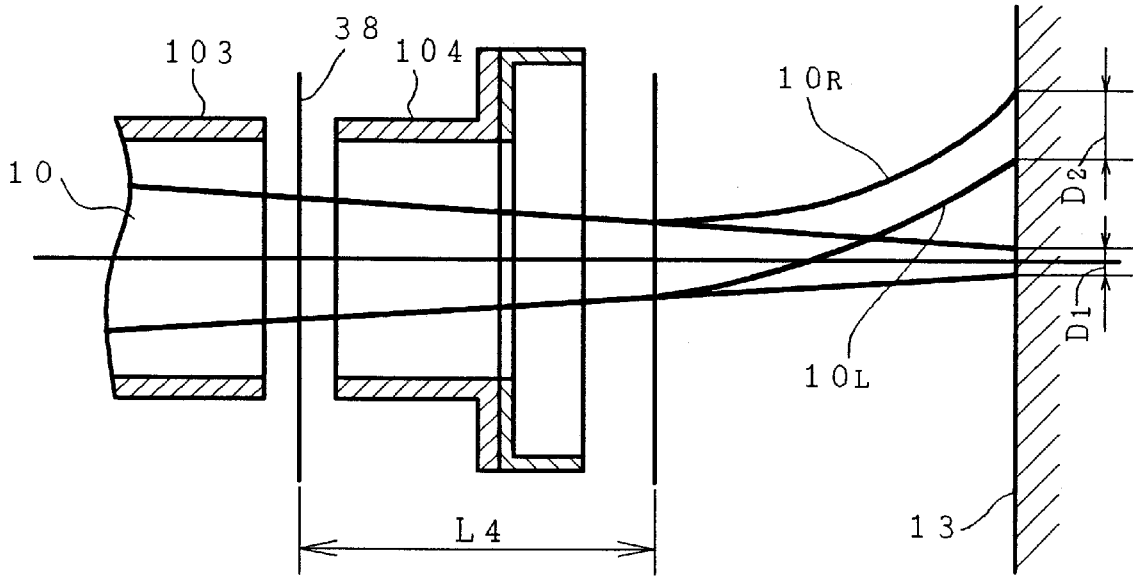
FIG. 9 is a schematic sectional view, similar to FIGS. 8A and 8B, of an essential portion of a cathode ray tube in which deflection defocusing correction pole pieces are not provided, illustrating the effect of the deflection defocusing correction pole pieces for forming a locally modified non-uniform magnetic field in the cathode ray tube of the present invention in comparison with a related art.

FIG. 9 is a schematic sectional view, similar to FIG. 8A, of a cathode ray tube having no pole piece for illustrating the operation of the deflection defocusing correcting member of the present invention in comparison with the prior art.

Referring to FIGS. 8A, 8B and FIG. 9, the electron beam 10 passes through the third grid electrode (G3) 103 of the electron gun focuses by a main lens 38 formed between the third grid electrode (G3) 103 and the fourth grid electrode (G4) 104. When being not deflected by a deflection magnetic field formed by the deflection yoke 11, the electron beam 10 travels straight and forms a beam spot having a diameter of D1 on the central portion of the phosphor film 13.

Here, it will be qualitatively described how the trajectory of the electron beam 10 is changed by the presence (FIGS. 8A and 8B) or the absence (FIG. 9) of the deflection defocusing correcting member 39 (see FIGS. 8A, 8B and FIG. 9) in the case where the electron beam 10 is deflected on the right-half side seen from the phosphor screen side.

Referring to FIG. 9, the rightmost trajectory of the electron beam 10 travels as shown by the reference numeral 10R because the deflection defocusing correcting member 39 are not provided; and the leftmost trajectory also travels as shown by the reference numeral 10L because the deflection defocusing correcting member 39 are not provided and it diverges on the phosphor film 13, to form a beam spot having a diameter D2.

On the contrary, as shown in FIG. 8A, when the deflection defocusing correcting member 39 are provided, the leftmost trajectory of the electron beam travels as shown by the reference numeral 10L' by the effect of lines of magnetic force formed by the deflection defocusing correcting member 39.

The rightmost trajectory of the electron beam travels shown by the reference numeral 10R because the deflection magnetic field in the trajectory portion is reduced by the magnetic path formed by the deflection defocusing correcting member 39, and thereby it focuses on the phosphor film 13.

As a result, a beam spot having a diameter D3 smaller than the diameter D2 is formed on the phosphor film 13. This is due to the fact that the locally modified non-uniform magnetic field is formed as shown in FIGS. 2A and 2B.

The shape of the beam spot having the diameter D3 on the phosphor film 13 can be suitably adjusted by the combination of the mounting positions of the pole pieces of the deflection defocusing correcting member 39; the length of the pole piece of the deflection defocusing correcting member 39 extending toward the phosphor film 13; the length of the pole piece of the deflection defocusing correcting member 39 extending substantially in parallel to the phosphor film 13; the distribution of the deflection magnetic field; the diameter of the electron beam passing through the interval between the pole pieces 39; and the maximum deflection angle. Uniform resolution over the entire screen can be thus obtained by making smaller the difference between the diameter D3 and the diameter D1 of the beam spot at the screen center.

As a result, the present invention can provide an inexpensive cathode ray tube enabling the focusing control synchronized with the deflection angle on the phosphor screen without dynamic focusing in synchronization with the deflection angle of an electron beam, leading to a uniform display over the entire screen. The detail conditions in the embodiments of the present invention are actually dependent on, for example, the structure of the cathode ray tube having a specified maximum deflection angle; the structure of a deflection magnetic field generating portion assembled in the cathode ray tube; the structure of the pole pieces of the deflection defocusing correcting member for forming a locally modified non-uniform magnetic field; the structure of an electron gun other than the pole pieces; the drive condition of the cathode ray tube; and the application of the cathode ray tube.

To improve uniformity of resolution over the entire phosphor screen by forming in a deflection magnetic field a locally modified non-uniform magnetic field synchronized with the deflection magnetic field, the trajectory of an electron beam must be deflected to pass through the different magnetic field areas even in the locally modified non-uniform magnetic field. Accordingly, there presents a positional relationship between the locally modified non-uniform magnetic field and the deflection magnetic field.

Figure 10A:
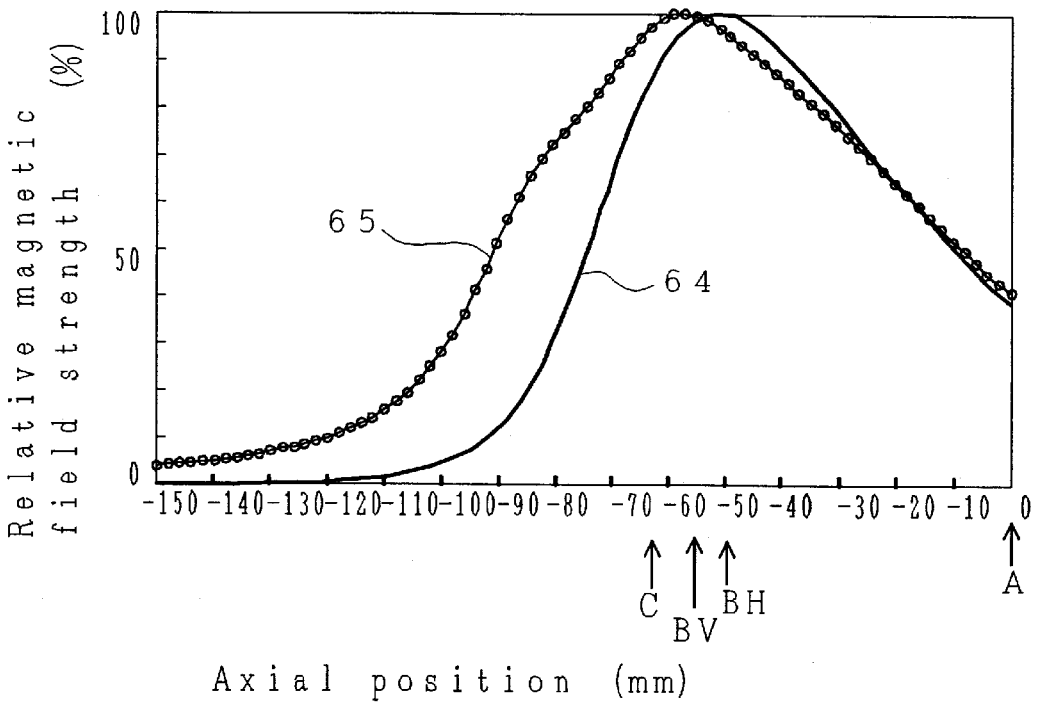
Figure 10B:
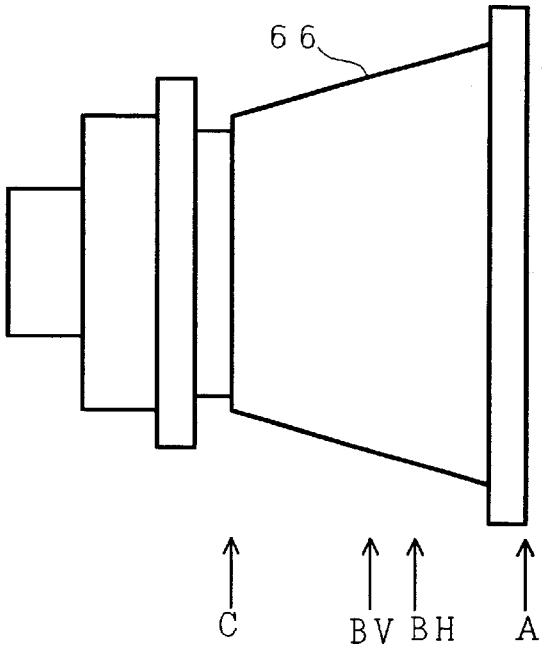

FIGS. 10A and 10B are a graph and a view illustrating a deflection magnetic field distribution, respectively; wherein FIG. 10A is a graph illustrating the deflection magnetic field distribution on the axis of the cathode ray tube having the deflection angle of 100° or more; and FIG. 10B is a view illustrating the positional relationship between the deflection magnetic field distribution shown in FIG. 10A and the deflection magnetic field generating mechanism.

The right-hand in FIG. 10B is the side near the phosphor screen and the left-hand in FIG. 10B is the side remote from the phosphor screen.

In FIGS. 10A and 10B, reference character A indicates a reference position for measurement of the magnetic field; BH is a position having the maximum value of the magnetic flux density 64 of the magnetic field for deflection in the scanning direction; BV is a position having the maximum value of the magnetic flux density of the magnetic field for deflection in the direction perpendicular to the scanning direction; and C is an end portion, on the side remote from the phosphor screen, of a magnetic material forming a core of a coil for forming the magnetic field.

In the case where a portion of the pole piece on the phosphor screen side has axial indention in the axial direction of the cathode ray tube, a distance of the longest portion is taken as its distance.

Figure 11:
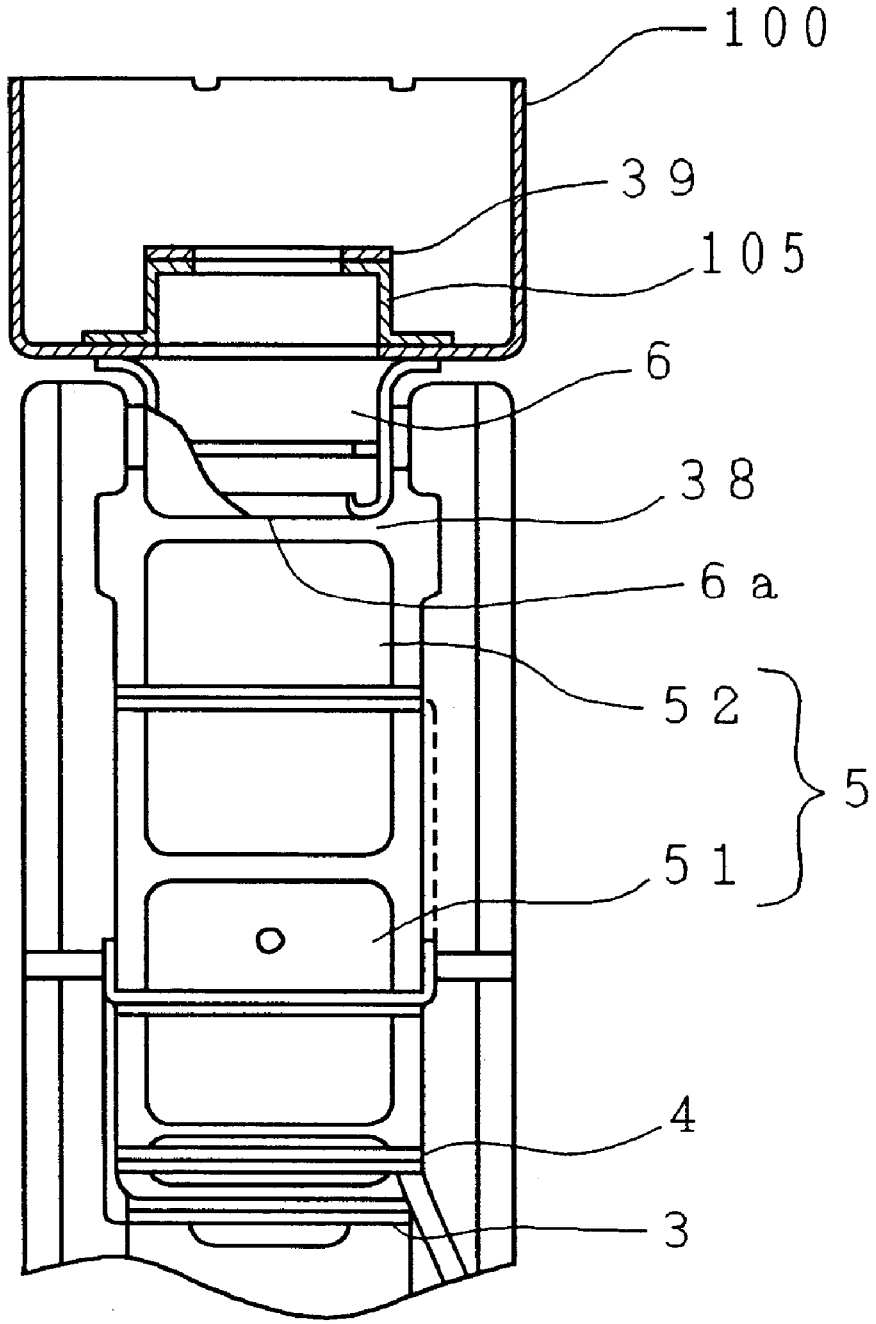
FIG. 11 is a sectional view of an essential portion of one example of an electron gun used for the cathode ray tube of the present invention.

FIG. 11 is a sectional view of an essential portion of one example of an electron gun used for a cathode ray tube of the present invention. Referring to this figure, an anode 6 forming a main lens 38 is disposed in the cathode ray tube on the side near a phosphor screen and a focusing electrode 5 is disposed on the side remote from the phosphor screen.

In FIG. 11, deflection defocusing correction correcting member 39 for forming in a deflection magnetic field a locally modified non-uniform magnetic field synchronized with the deflection magnetic field are located at positions shifted to the phosphor screen from a facing surface 6*a* between the anode 6 and the main lens 38 of the electron gun. Reference numeral 100 indicates a shield cup; and 105 is a pole piece support.

(5) Structural Examples of Deflection Defocusing Correcting Memebers

Figure 12A:
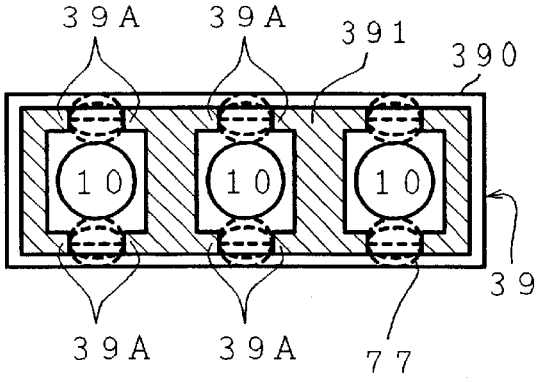
FIGS. 12A to 12D are views illustrating in detail defocusing correction lines of magnetic force in the vertical (FIGS. 12A and 12C) and horizontal (FIGS. 12C and 12D) directions in two different configuration examples of deflection defocusing correcting member used for a color cathode ray tube of the three inline electron beam type of the present invention, respectively.
Figure 12B:
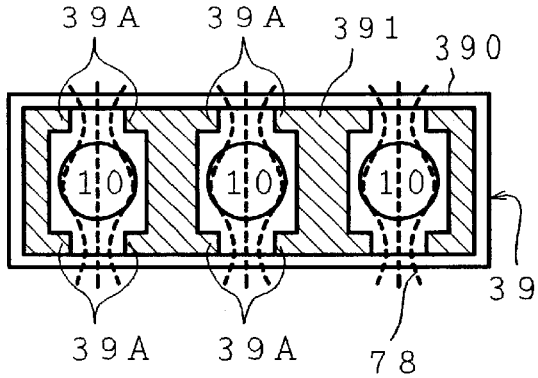
Figure 12C:
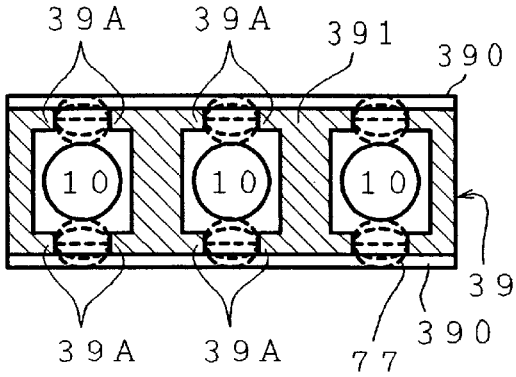
Figure 12D:
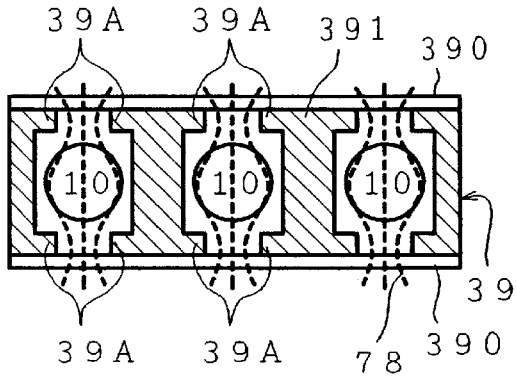

FIGS. 12A–12D are views illustrating one structure of the deflection defocusing correcting member used for a three inline beam type color cathode ray tube of the present invention; wherein FIGS. 12A and 12C are views illustrating lines of magnetic force for deflection defocusing correction in the vertical direction; and FIGS. 12B and 12D are views illustrating lines of magnetic force for deflection defocusing correction in the horizontal direction.

In FIG. 12A, the deflection defocusing correcting member 39 is formed of a laminated sheet (clad sheet) of a non-magnetic sheet 390 and soft magnetic sheets 391 and the pole pieces of the correcting member 39 are positioned on opposite sides, in the inline direction, of each electron beam 10 in such a manner that the opposed portions of each pole piece tip 39*a* of the pole piece 39 are positioned in the direction perpendicular to the inline direction of the electron beam 10 for concentration of magnetic fluxes at the opposed portions.

In addition, reference numeral 77 in FIG. 12A indicates lines of magnetic force for deflecting the electron beam in the direction perpendicular to the inline direction. The provision of the pole pieces 39 of the deflection defocusing correcting member made of a magnetic material for forming in a deflection magnetic field locally modified non-uniform magnetic fields synchronized with the deflection magnetic field, causes lines 77 of magnetic force to be concentrated near portions positioned on opposite sides of a path of an undeflected electron beam 10 and hence to perform deflection defocusing correction.

In FIG. 12B, reference numeral 78 indicates lines of magnetic force for deflecting an electron beam 10 in the inline direction. The provision of pole pieces of the deflection defocusing correcting member 39 made of a magnetic material for forming in a deflection magnetic field, locally modified non-uniform magnetic fields synchronized with the deflection magnetic field allows the lines 78 of magnetic force to be converged near portions positioned on opposite sides of the path of the undeflected electron beam and hence to perform deflection defocusing correction.

In FIGS. 12C and 12D, the deflection defocusing correcting member 39 is formed of a composite butt-welded (edge-to-edge welded) sheet of non-magnetic sheets 390 and soft magnetic sheets 391 and the pole pieces of the correcting member 39 are positioned on opposite sides, in the inline direction, of each electron beam 10 in such a manner that the opposing portions of each pole piece tip 39*a* of the pole piece 39 are positioned in the direction perpendicular to the inline direction of the electron beam 10 for concentration of magnetic fluxes at the opposing portions. The mechanism of deflection defocusing correction is the same with FIGS. 12A and 12B.

Figure 13A:
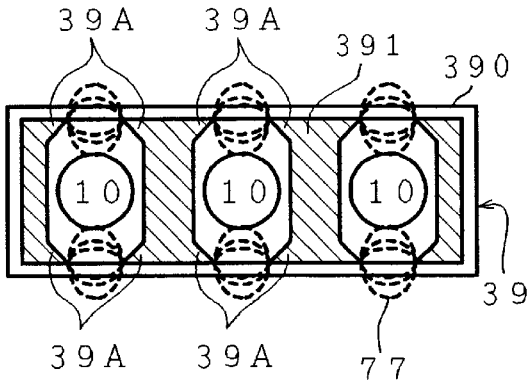
FIGS. 13A to 13D are views illustrating in detail defocusing correction lines of magnetic force in the vertical (FIGS. 13A and 13C) and horizontal (FIGS. 13B and 13D) directions in other two different configuration examples of the deflection defocusing correcting member used for the color cathode ray tube of the three inline electron beam type of the present invention, respectively.
Figure 13B:
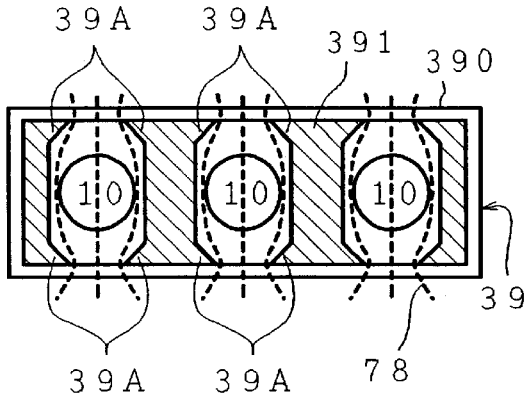
Figure 13C:
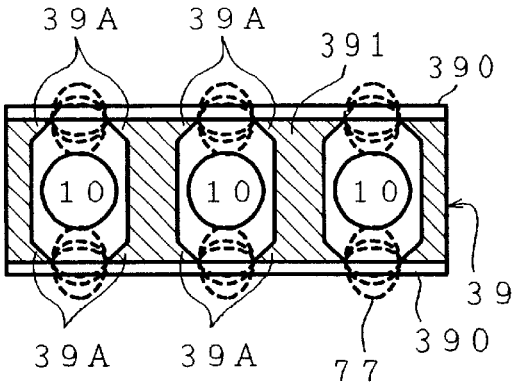
Figure 13D:
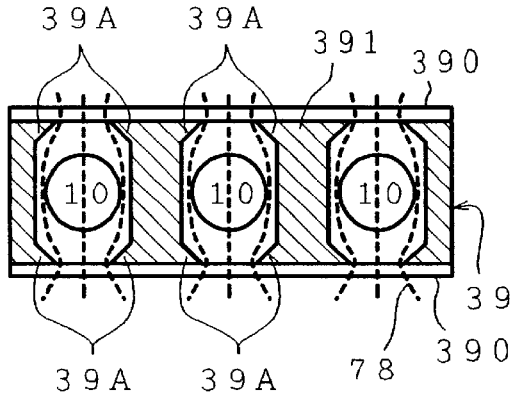

FIGS. 13A to 13D are views illustrating other structures of deflection defocusing correcting members used for a three inline beam type color cathode ray tube of the present invention; wherein FIGS. 13A and 13C are views illustrating lines of magnetic force for defocusing correction in the vertical direction; and FIGS. 13B and 13D are views illustrating lines of magnetic force for deflection defocusing correction in the horizontal direction.

In FIG. 13A, the deflection defocusing correcting member is formed of a laminated sheet of a non-magnetic sheet 390 and soft magnetic sheets 391, and the pole pieces of the deflection defocusing correcting member 39 are positioned on opposite sides, in the inline direction, of each electron beam 10 in such a manner that the opposed portions of each pole tip 39A of the pole piece are positioned in the direction perpendicular to the inline direction of the electron beam 10 for concentration of magnetic fluxes at the opposing portions.

In addition, reference numeral 77 in FIG. 13A indicates lines of magnetic force for deflecting the electron beam in the direction perpendicular to the inline direction. The provision of the pole pieces of the deflection defocusing correcting member 39 made of a magnetic material for forming in a deflection magnetic field locally modified non-uniform magnetic fields synchronized with the deflection magnetic field, causes lines 77 of magnetic force to be concentrated near and on opposite sides of a path of an undeflected electron beam 10 and hence to perform deflection defocusing correction.

In FIG. 13B, the pole pieces 39 of the deflection defocusing correcting member are positioned on opposite sides, in the inline direction, of each electron beam 10 in such a manner that the opposed portions of each pole tip 39*a* of the pole piece are positioned in the inline direction of the electron beam 10 for concentration of magnetic fluxes at the opposing portions. Reference numeral 78 indicates lines of magnetic force for deflecting an electron beam 10 in the inline direction. The provision of the pole pieces of the deflection defocusing correcting member 39 made of a magnetic material for forming in a deflection magnetic field locally modified non-uniform magnetic fields synchronized with the deflection magnetic field, causes the lines 78 of magnetic force to be concentrated near and on opposite sides of the path of the undeflected electron beam and hence to perform deflection defocusing correction.

This configuration in which portions near the electron beam, of the pole pieces of the deflection defocusing correcting member 39 are tapered, is suitable for the case where the lines 77 of magnetic force of the deflection magnetic field in the direction perpendicular to the inline direction are not required to be reduced near portions on opposite sides of the path of the undeflected electron beam, as compared with the configuration shown in FIGS. 12A to 12D.

In FIGS. 13C and 13D, the deflection defocusing correcting member 39 is formed of a composite butt-welded (edge-to-edge welded) sheet of non-magnetic sheets 390 and soft magnetic sheets 391. The mechanism of deflection defocusing is the same with FIGS. 13A and 13B.

Figure 14A:
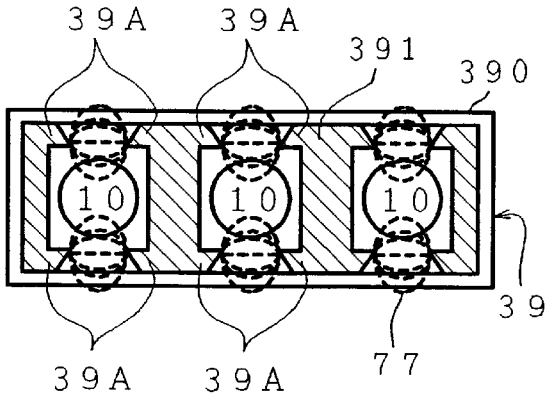
FIGS. 14A to 14D are views illustrating in detail defocusing correction lines of magnetic force in the vertical (FIGS. 14A and 14C) and horizontal (FIGS. 14B and 14D) directions in two further different configuration examples of the deflection defocusing correcting member used for the color cathode ray tube of the three inline electron beam type of the present invention, respectively.
Figure 14B:
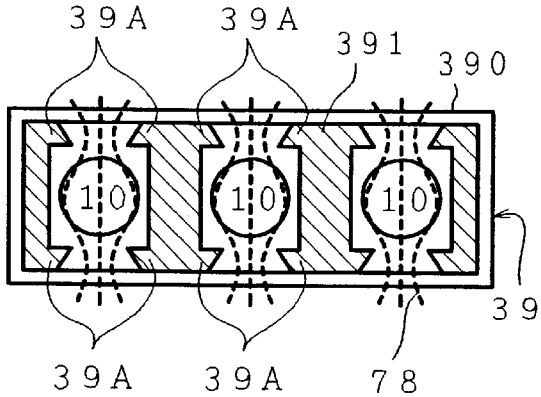
Figure 14C:
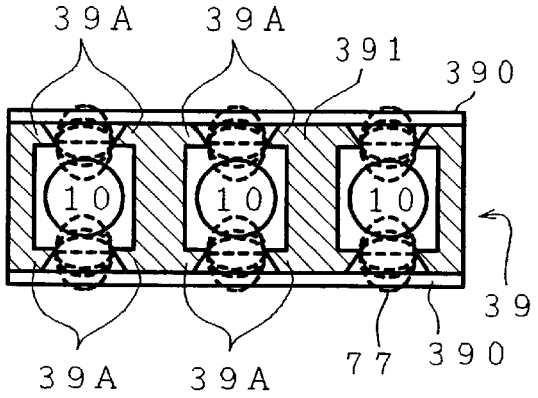
Figure 14D:
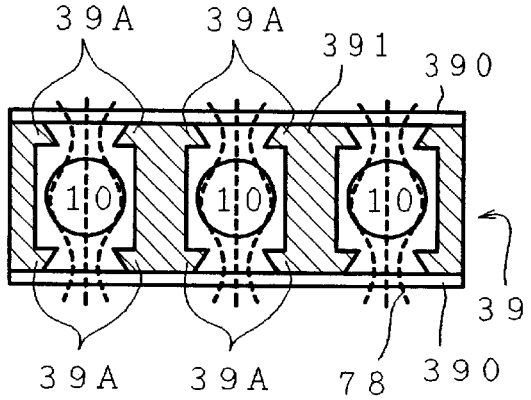

FIGS. 14A to 14D are views illustrating further structures of deflection defocusing correcting members used for a three inline beam type color cathode ray tube of the present invention; wherein FIGS. 14A and 14C are views illustrating lines of magnetic force for defocusing correction in the vertical direction; and FIGS. 14B and 14D are views illustrating lines of magnetic force for defocusing correction in the horizontal direction.

In FIG. 14A, the deflection defocusing correcting member 39 is formed of a laminated sheet (clad sheet) of a non-magnetic sheet 390 and soft magnetic sheets 391 the pole pieces of the correcting member 39 are positioned on opposite sides, in the inline direction, of each electron beam 10 in such a manner that the opposed portions of each pole tips 39A of the pole pieces of the deflection defocusing members 39 are positioned in the direction perpendicular to the inline direction of the electron beam 10 for concentration of magnetic fluxes at the opposing portions.

In addition, reference numeral 77 in FIG. 14A indicates lines of magnetic force for deflecting the electron beam in the direction perpendicular to the inline direction. The provision of the pole pieces of the correcting member 39 made of a magnetic material for forming in a deflection magnetic field locally modified non-uniform magnetic fields synchronized with the deflection magnetic field, causes lines 77 of magnetic force to be concentrated near and on opposite sides of a path of an undeflected electron beam 10 and hence to perform deflection defocusing correction.

In FIG. 14B, the pole pieces of the deflection defocusing correcting members 39 are positioned on opposite sides, in the inline direction, of each electron beam 10 in such a manner that the opposing portions of each pole tip 39A of the pole piece are positioned in the inline direction of the electron beam 10 for concentration of magnetic fluxes at the opposing portions. Reference numeral 78 indicates lines of magnetic force for deflecting an electron beam 10 in the inline direction. The provision of the pole pieces 39 made of a magnetic material for forming in a deflection magnetic field locally modified non-uniform magnetic fields synchronized with the deflection magnetic field, allows the lines 78 of magnetic force to be concentrated near and on opposite sides of the path of the undeflected electron beam and hence to perform deflection defocusing correction.

This configuration in which portions remote from the electron beam, of the pole pieces of the deflection defocusing correcting members 39 are tapered, is suitable for the case where the lines 77 of magnetic force of the deflection magnetic field in the direction perpendicular to the inline direction are required to be increased near portions positioned on opposite sides of the path of the undeflected electron beam, as compared with the configuration shown in FIGS. 12A to 12D.

In FIGS. 14C and 14D, the deflection defocusing correcting member 39 is formed of a composite butt-welded (edge-to-edge welded) sheet of non-magnetic sheets 390 and soft magnetic sheets 391. The mechanism of deflection defocusing correction is the same with FIGS. 14A and 14B.

Figure 15A:
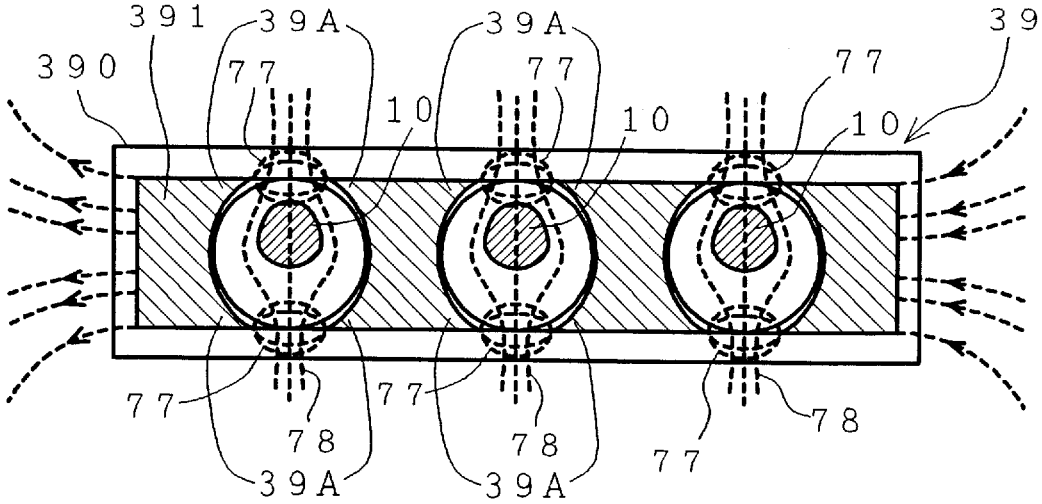
FIGS. 15A and 15B are views illustrating in detail two further different configuration examples of the deflection defocusing correcting member used for the color cathode ray tube of the three inline electron beam type of the present invention.
Figure 15B:
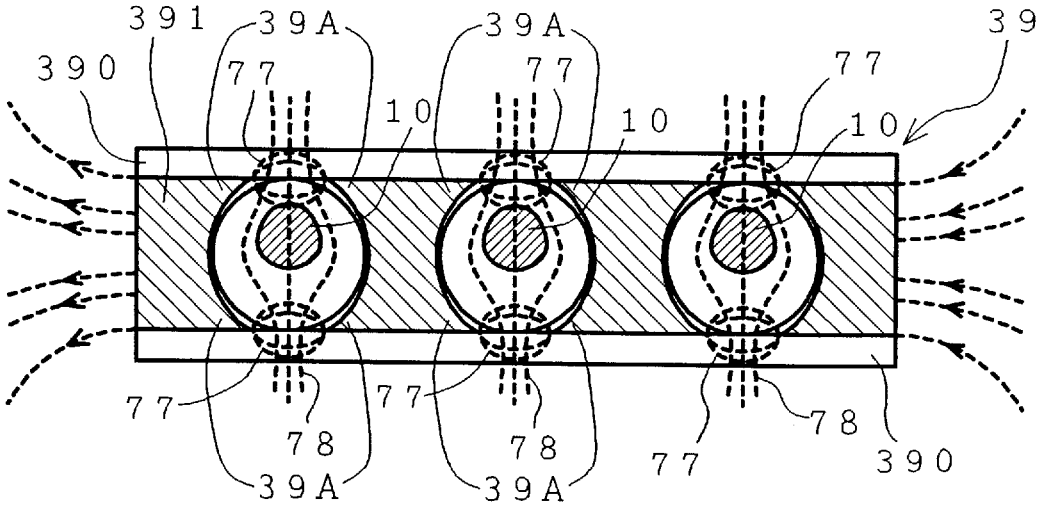

FIGS. 15A and 15B are views illustrating further structures of deflection defocusing correcting member used for a three inline beam type color cathode ray tube of the present invention.

In FIG. 15A, the deflection defocusing correcting member 39 is formed of a laminated sheet (clad sheet) of a non-magnetic sheet 390 and soft magnetic sheets 391 and the pole pieces of the correcting member 39 are positioned on opposite sides, in the inline direction, of each electron beam 10 in such a manner that the opposing portions of each pole tip 39A of the pole piece of the correcting member 39 are positioned in the direction perpendicular to the inline direction of the electron beam 10 for convergence of a magnetic flux at the opposed portions.

In addition, reference numeral 77 in FIG. 15A indicates lines of magnetic force for deflecting the electron beam in the direction perpendicular to the inline direction. The provision of the pole pieces of the correcting members 39 made of soft magnetic sheets 391 and non-magnetic sheets 390 for forming in a deflection magnetic field locally modified non-uniform magnetic fields synchronized with the deflection magnetic field, causes lines 77 of magnetic force to be concentrated near portions on opposite sides of a path of an undeflected electron beam 10 and hence to perform deflection defocusing correction.

Referring to FIG. 15A, it is also possible to increase the lines 78 of magnetic force for deflecting the electron beam in the inline direction near the path of the undeflected electron beams.

In FIG. 15B, the deflection defocusing correcting member 39 is formed of a composite butt-welded (edge-to-edge welded) sheet of non-magnetic sheets 390 and soft magnetic sheets 391. The mechanism of deflection defocusing correction is the same with FIG. 15A.

Figure 16A:
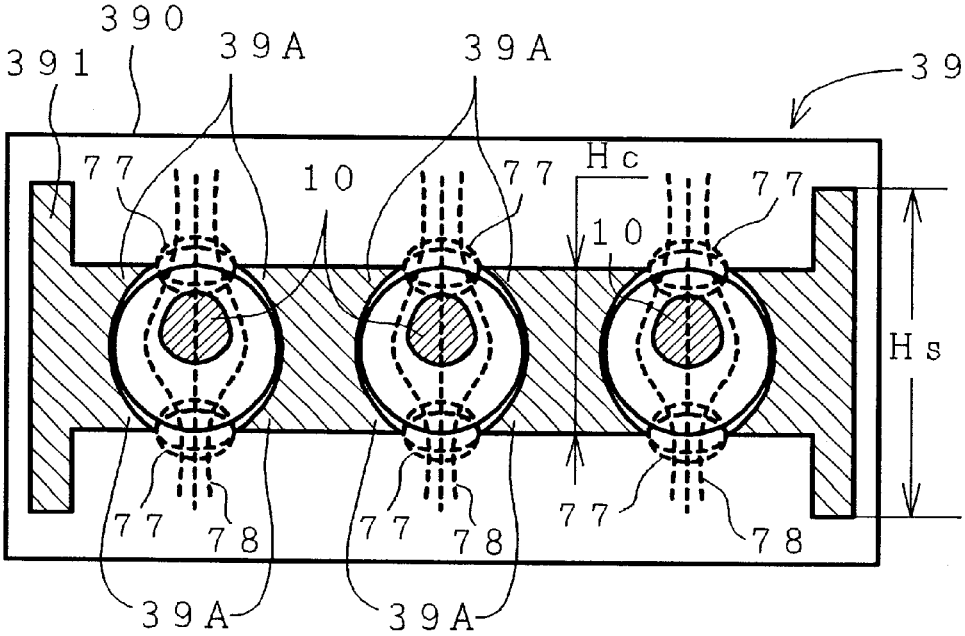
FIGS. 16A and 16B are views illustrating in detail two further different configuration example of the deflection defocusing correcting member used for the color cathode ray tube of the three inline electron beam type of the present invention.
Figure 16B:
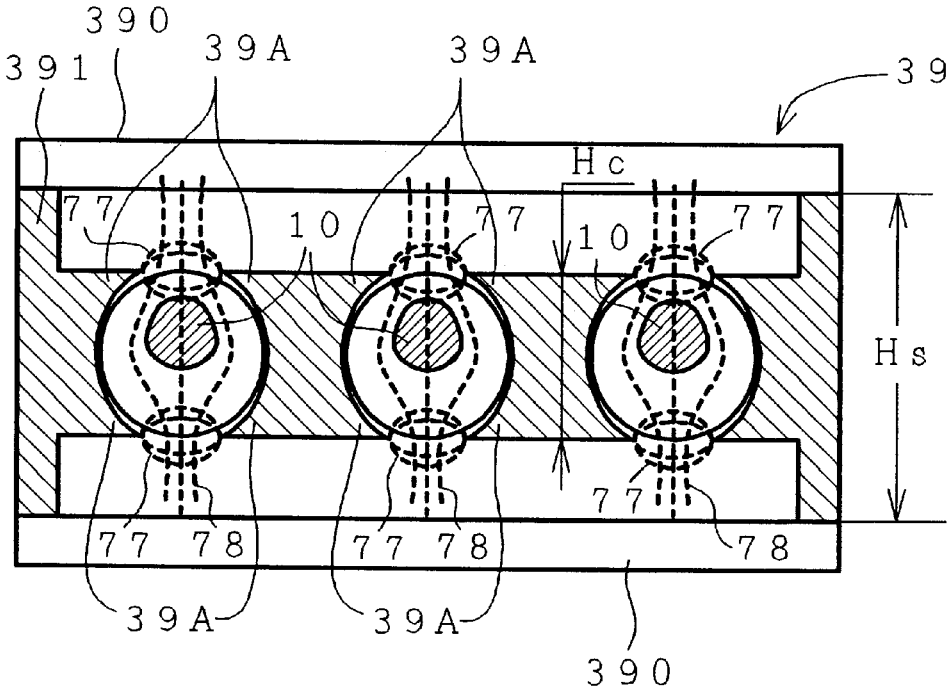

FIGS. 16A and 16B are views illustrating further structures of deflection defocusing correcting members for a three inline beam type color cathode ray tube of the present invention.

In FIG. 16A, the deflection defocusing correcting member 39 is formed of a laminated sheet (clad sheet) of a non-magnetic sheet 390 and soft magnetic sheets 391 and the pole pieces of the correcting member 39 are positioned on opposite sides, in the inline direction, of each electron beam 10 in such a manner that the opposing portions of each pole tip 39A of the pole piece of the correcting member 39 are positioned in the direction perpendicular to the inline direction of the electron beam 10 for convergence of a magnetic flux at the opposed portions.

In addition, reference numeral 77 in FIG. 16A indicates lines of magnetic force for deflecting the electron beam in the direction perpendicular to the inline direction. The provision of the pole pieces made of a magnetic material for forming in a deflection magnetic field locally modified non-uniform magnetic fields synchronized with the deflection magnetic field, causes lines 77 of magnetic force to be concentrated near and on opposite sides of a path of an undeflected electron beam 10 and hence to perform deflection defocusing correction.

The concentration of the lines 77 of magnetic force can be increased by making larger the length Hs (in the direction perpendicular to the inline direction) of the end portion, on the side near the neck portion from each side electron beam, of the side pole piece than the length Hc of each of the central pole pieces.

In FIG. 16B, the deflection defocusing correcting member 39 is formed of a composite butt-welded (edge-to-edge welded) sheet of non-magnetic sheets 390 and soft magnetic sheets 391. The mechanism of deflection defocusing correction is the same with FIG. 16A.

FIGS. 17 to 23B are schematic views illustrating further structures of deflection defocusing correcting members 39 formed of a laminated sheet (clad sheet) or a butt-welded sheet (edge-to-edge welded sheet) of a non-magnetic sheet 390 and a soft magnetic sheet 391, according to the present invention, respectively. In these figures, structures of cladding or laminating of a non-magnetic sheet and a soft magnetic sheet are omitted and arrangements of pole pieces made of soft magnetic material only are illustrated.

Figure 17:
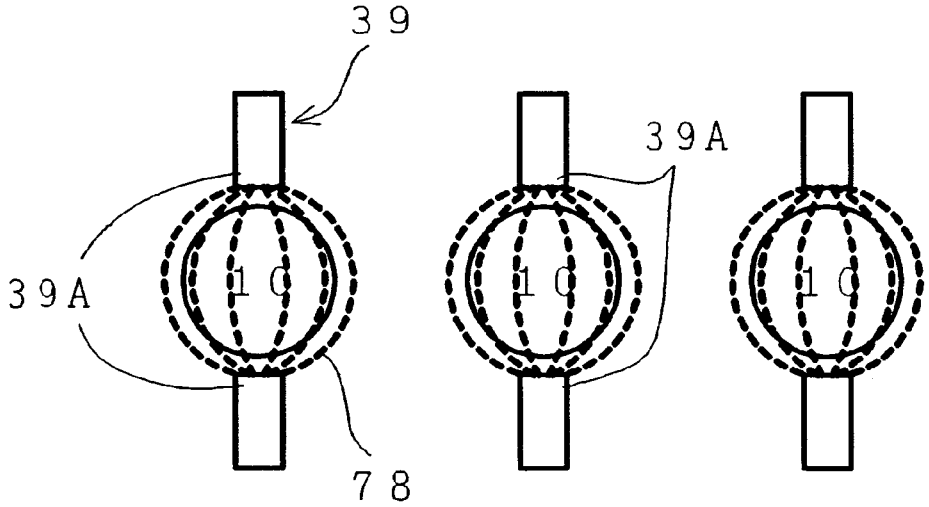
FIG. 17 is a view illustrating in detail a further configuration example of the deflection defocusing correcting member used for the color cathode ray tube of the three inline electron beam type of the present invention.

FIG. 17 is a view illustrating a further structure of deflection defocusing correcting member used for a three inline beam type color cathode ray tube of the present invention, and particularly illustrating lines of magnetic force for defocusing correction by a horizontal deflection magnetic field.

Referring to FIG. 17, opposing portions of pole tips 39A of magnetic pole pieces of the deflection defocusing correcting member 39 are disposed in the direction perpendicular to the inline direction of each electron beam 10 for concentrating magnetic fluxes between the opposing portions, thereby correcting deflection defocusing.

Figure 18:
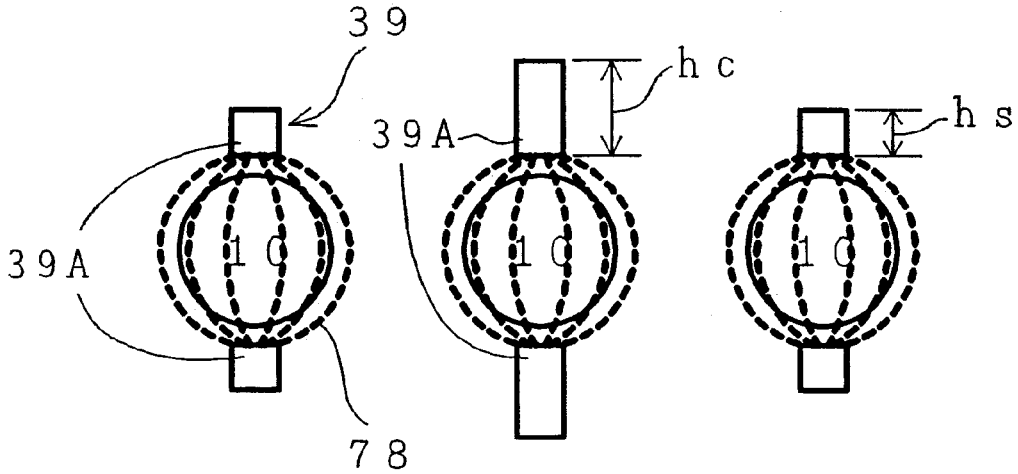
FIG. 18 is a view illustrating in detail a further configuration example of the deflection defocusing correcting member used for the color cathode ray tube of the three inline electron beam type of the present invention.

FIG. 18 is a view illustrating a further structure of deflection defocusing correcting member used for a three inline beam type color cathode ray tube of the present invention, and particularly illustrating lines of magnetic force for defocusing correction by a horizontal deflection magnetic field.

Referring to FIG. 18, opposing portions of pole piece tips 39A of pole pieces of the correcting member 39 are disposed in the direction perpendicular to the inline direction of each electron beam 10 for concentrating magnetic fluxes between the opposing portions, thereby correcting deflection defocusing.

When the center electron gun is different from each side electron gun in amount of deflection defocusing, concentration of magnetic fluxes is changed by changing the length of the pole pieces in the direction perpendicular to the inline direction for the electron gun, thereby suitably controlling the correction amount in each electron gun.

Figure 19:
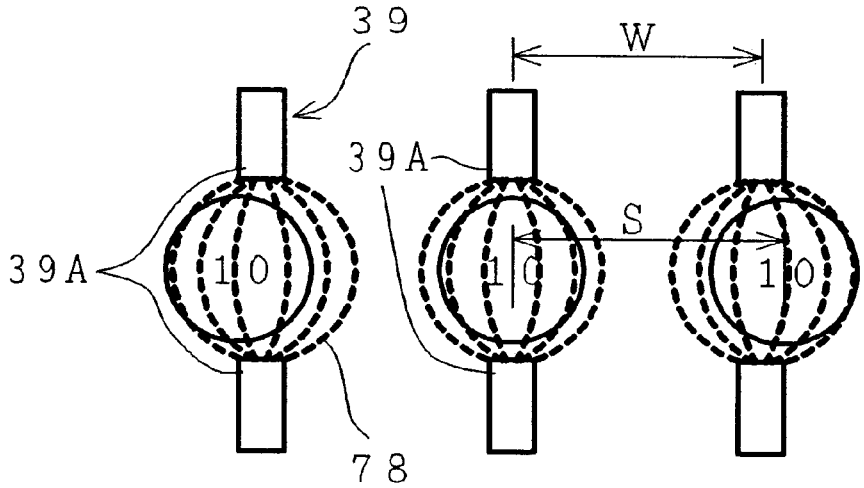
FIG. 19 is a view illustrating in detail a further configuration example of the deflection defocusing correcting member used for the color cathode ray tube of the three inline electron beam type of the present invention.

FIG. 19 is a view illustrating a further structure of deflection defocusing correcting member used for a three inline beam type color cathode ray tube of the present invention, and particularly illustrating lines of magnetic force for defocusing correction by a horizontal deflection magnetic field.

Referring to FIG. 19, opposing portions of pole piece tips 39A of pole pieces of the correcting member 39 are disposed in the direction perpendicular to the inline direction of each electron beam 10 for concentrating magnetic fluxes between the opposing portions, thereby correcting deflection defocusing.

When a horizontal diverging state of an electron beam from each side electron gun differs between on the center electron gun side and on the opposite side, the diverging state can be suitably controlled by changing each distance between the electron guns and each distance W between the pole pieces of the correcting member 39.

Figure 20:
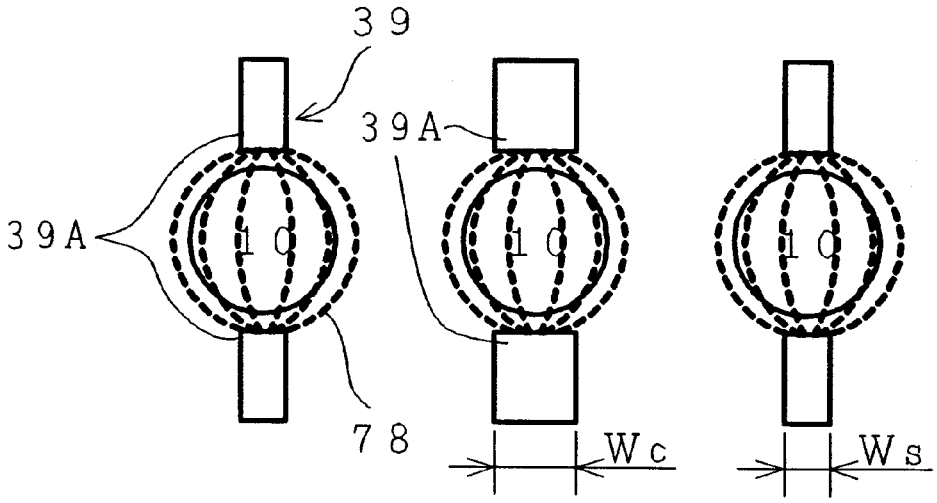
FIG. 20 is a view illustrating in detail a further configuration example of the deflection defocusing correcting member used for the color cathode ray tube of the three inline electron beam type of the present invention.

FIG. 20 is a view illustrating a further structure of deflection defocusing correcting member used for a three inline beam type color cathode ray tube of the present invention, and particularly illustrating lines of magnetic force for defocusing correction by a horizontal deflection magnetic field.

Referring to FIG. 20, opposing portions of pole tips 39A of pole pieces of the correcting member 39 are disposed in the direction perpendicular to the inline direction of each electron beam 10 for concentrating magnetic fluxes between the opposing portions, thereby correcting deflection defocusing.

When horizontal diverging states of an electron beam of side electron guns are different from each other, the diverging state can be suitably controlled by changing the length of the pole pieces for each electron gun in the inline direction.

Figure 21:
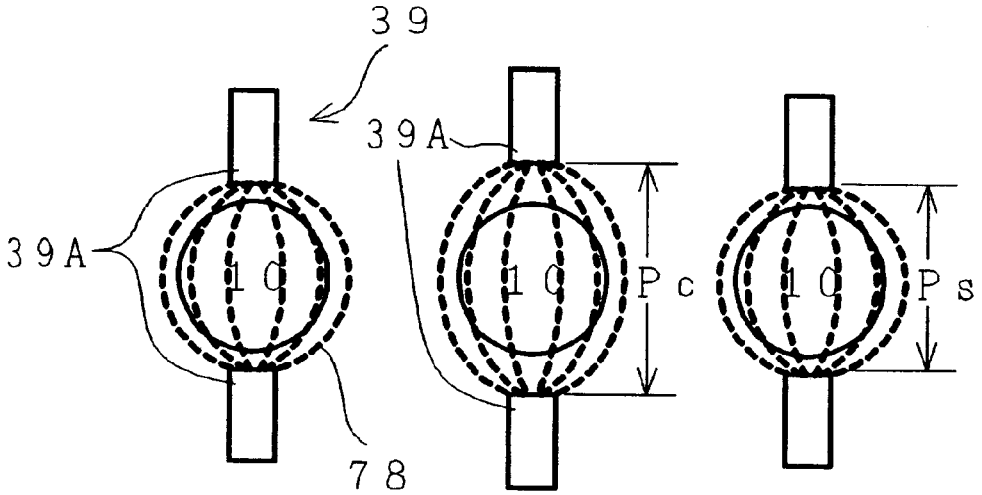
FIG. 21 is a view illustrating in detail a further configuration example of the deflection defocusing correcting member used for the color cathode ray tube of the three inline electron beam type of the present invention.

FIG. 21 is a view illustrating a further structure of deflection defocusing correcting member used for a three inline beam type color cathode ray tube of the present invention, and particularly illustrating lines of magnetic force for defocusing correction by a horizontal deflection magnetic field.

Referring to FIG. 21, opposing portions of pole tips 39A of pole pieces of the correcting member 39 are disposed in the direction perpendicular to the inline direction of each electron beam 10 for concentrating magnetic fluxes between the opposing portions, thereby correcting deflection defocusing.

When a horizontal diverging state of an electron beam differs between each side electron gun and the center electron gun, the diverging state can be suitably adjusted by changing the lengths Pc and Ps of the opposing portions of the pole tips 39A corresponding to each electron gun.

Figure 22:
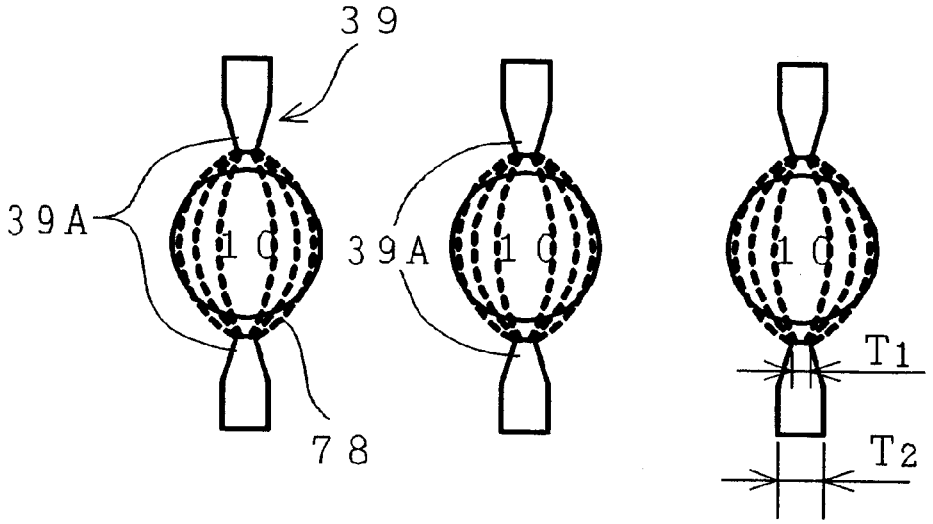
FIG. 22 is a view illustrating in detail a further configuration example of the deflection defocusing correcting member used for the color cathode ray tube of the three inline electron beam type of the present invention.

FIG. 22 is a view illustrating a further structure of deflection defocusing correcting member used for a three inline beam type color cathode ray tube of the present invention, and particularly illustrating lines of magnetic force for defocusing correction by a horizontal deflection magnetic field.

Figure 24:
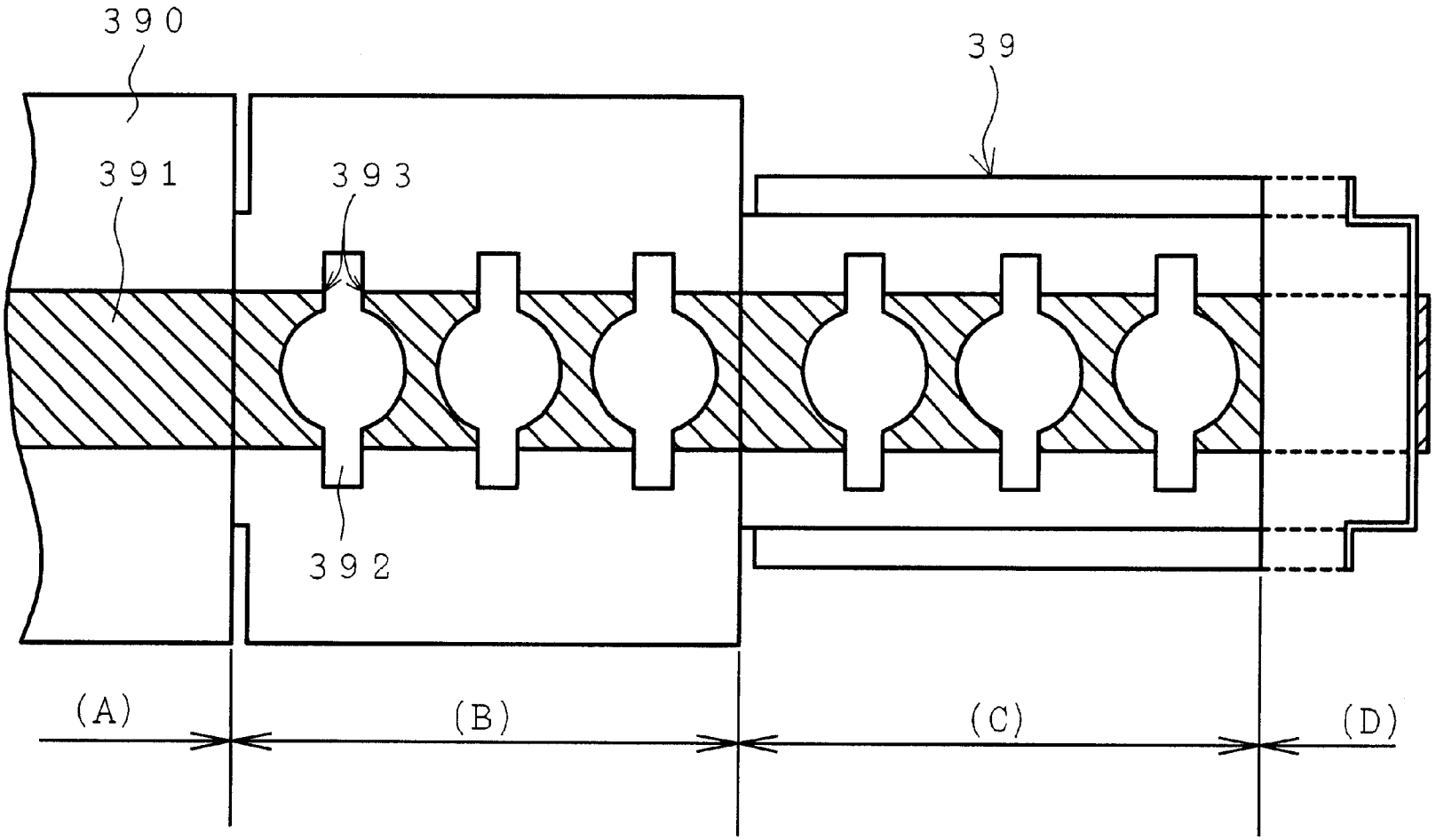
FIG. 24 is a top view illustrating an embodiment of a deflection defocusing correcting member and a manufacturing method thereof of the present invention.

Referring to FIG. 22, opposing portions of pole piece tips 39A of pole pieces of FIG. 24 is a top view illustrating an embodiment of a deflection defocusing correcting member and a manufacturing method thereof of the present invention; the correcting member 39 are disposed in the direction perpendicular to the inline direction of each electron beam 10 for concentrating magnetic fluxes between the opposing portions, thereby correcting deflection defocusing.

The concentration of magnetic fluxes can be suitably controlled by changing the length of the pole piece of the correcting member 39 in the inline direction between on the opposing portion side of the pole tips 39A and on the side remote from the opposing portion side.

Figure 23A:
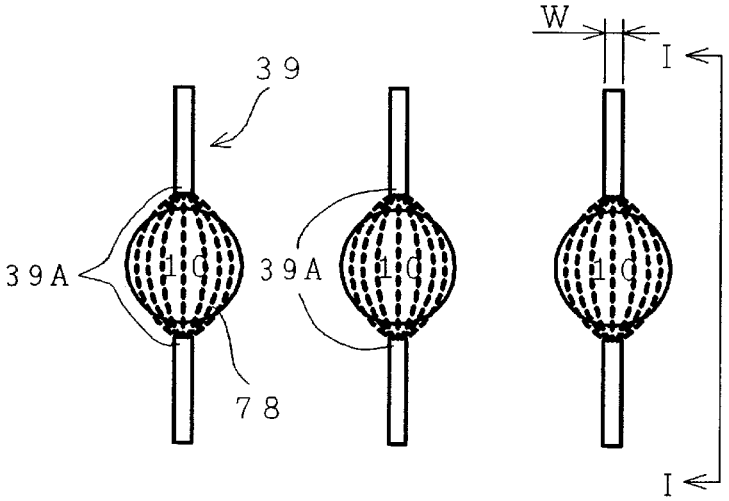
FIGS. 23A and 23B are respectively a front view and a side view illustrating in detail a further configuration example of the deflection defocusing correcting member used for the color cathode ray tube of the three inline electron beam type of the present invention.
Figure 23B:
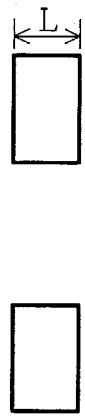

FIGS. 23A and 23B is views illustrating a further structure of deflection defocusing correcting member used for a three inline beam type color cathode ray tube of the present invention, FIG. 23A is a front view and FIG. 23B is a side view along the line I—I viewed in the direction of the arrows of FIG. 23A.

FIGS. 23A and 23B are views illustrating a further structure of deflection defocusing correcting member used for a three inline beam type color cathode ray tube of the present invention, and particularly illustrating lines of magnetic force for defocusing correction by a horizontal deflection magnetic field.

Referring to FIGS. 23A and 23B, opposing portions of pole piece tips 39A of pole pieces of the correcting member 39 are disposed in the direction perpendicular to the inline direction of each electron beam 10 for concentrating magnetic fluxes between the opposing portions, thereby correcting deflection defocusing.

The correction amount in the horizontal direction can be increased while suppressing the effect on the vertical deflection magnetic field by shortening the length of the magnetic pole pieces in the inline direction and extending the length L of the pole pieces in the axial direction for forming, near the center of the electron beam, an area where a magnetic field is high and is longer in influencing the electron beam.

(6) Embodiments of Deflection Defocusing Correcting Members of Cladding (Laminated) Structures and Manufacturing Methods Thereof FIGS. 24 to 28 are top views illustrating embodiments of deflection defocusing correcting members of the cladding (laminated) structure and manufacturing methods thereof of the present invention.

FIG. 24 illustrates a state of a clad sheet and that of a punched clad sheet for one embodiment of the deflection defocusing correcting member of the present invention, the portion "A" illustrates a plan view of part of a clad sheet before processing, the portion "B" illustrates a plan view of the subsequent punched state of a portion corresponding to a piece of the deflection defocusing correcting member, the portion "C" illustrates a plan view of the subsequent press-formed state and the portion "D" illustrates a side view corresponding to the portion "C".

The portion "A" shows the clad sheet is a sheet comprised of a long thin non-magnetic stainless sheet 390 and a soft magnetic Permalloy sheet 391 laminated on the stainless sheet 390. The portion "B" shows the electron beam apertures 392 and the pole tip portion 393 are formed by punching. Subsequently the deflection defocusing correcting member 39 is completed by press-forming as shown in the portions "C" and "D". It is possible to punch out the electron beam apertures 392 and the pole piece portions 393 in the "C" and to press-form at the same time.

Figure 25:
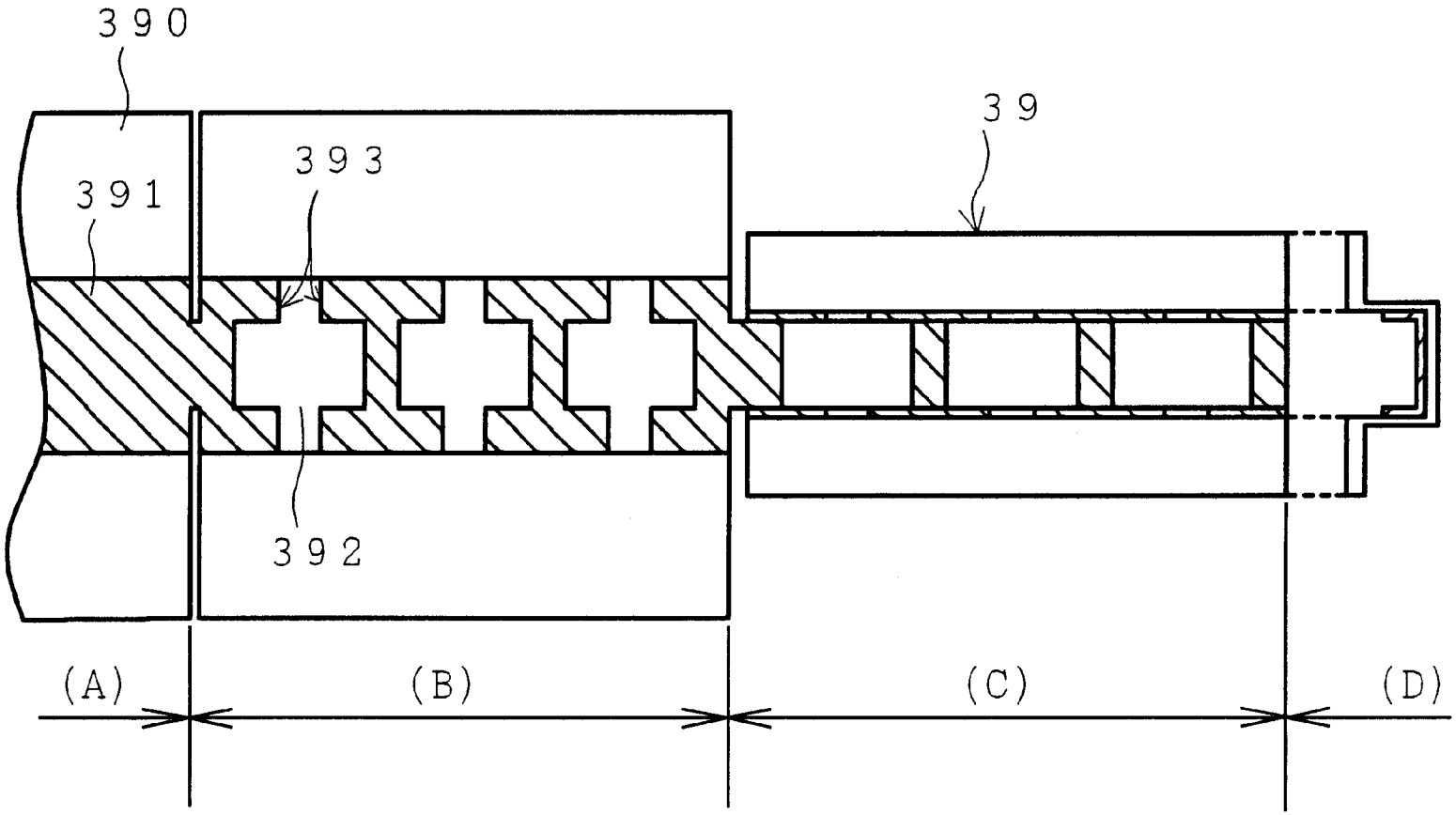
FIG. 25 is a top view illustrating another embodiment of a deflection defocusing correcting member and a manufacturing method thereof of the present invention.

FIG. 25 illustrates a state of a clad sheet and that of a punched clad sheet for another embodiment of the deflection defocusing correcting member of the present invention, the portion "A" illustrates a plan view of part of a clad sheet before processing, the portion "B" illustrates a plan view of the subsequent punched state of a portion corresponding to a piece of the deflection defocusing correcting member, the portion "C" illustrates a plan view of the subsequent press-formed state and the portion "D" illustrates a side view corresponding to the portion "C".

The portion "A" shows the clad sheet is a sheet comprised of a long thin non-magnetic stainless sheet 390 and a soft magnetic Permalloy sheet 391 laminated on the stainless sheet 390 like in FIG. 24. The portion "B" shows the electron beam apertures 392 and the pole tip portion 393 are formed by punching. Subsequently the deflection defocusing correcting member 39 is completed by press-forming as shown in the portions "C" and "D". In the portion "C", the clad sheet is bent toward the soft magnetic sheet side 391 such that the non-magnetic sheet 390 encloses the magnetic sheet 391.

Figure 26:
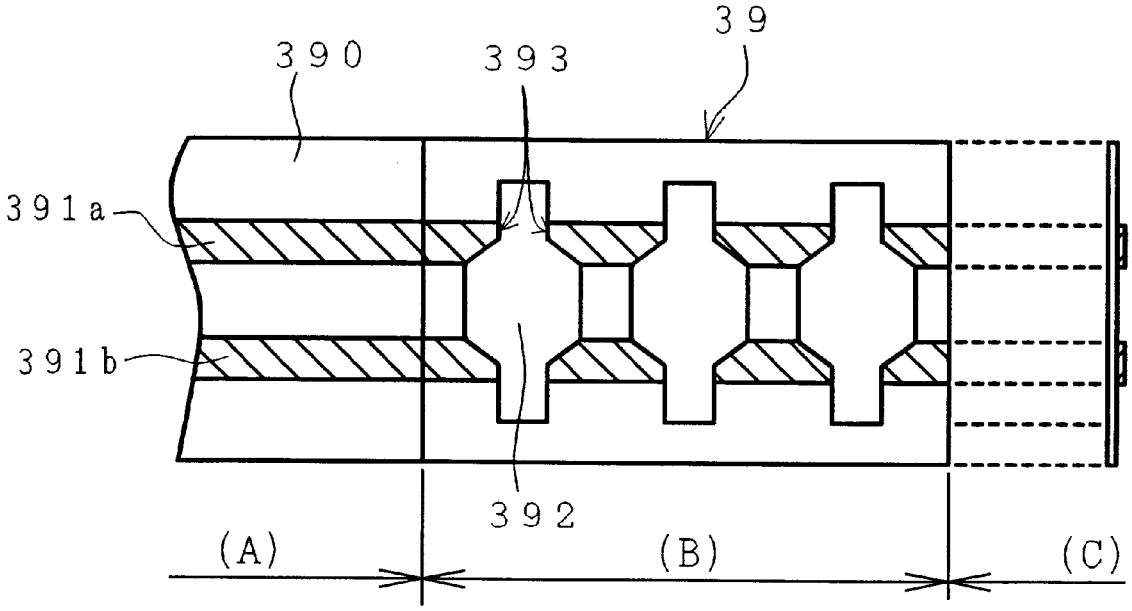
FIG. 26 is a top view illustrating an embodiment of a deflection defocusing correcting member and a manufacturing method thereof of the present invention.

FIG. 26 illustrates states of a clad sheet and a punched clad sheet for another embodiment of the deflection defocusing correcting member of the present invention, the portion "A" illustrates a plan view of part of a clad sheet before processing, the portion "B" illustrates a plan view of the subsequent punched state of a portion corresponding to a piece of the deflection defocusing correcting member, the portion "C" illustrates a plan view of the subsequent press-formed state and the portion "D" illustrates a side view corresponding to the portion "C".

The portion "A" shows the clad sheet is a sheet comprised of a long thin non-magnetic stainless sheet 390 and a pair of soft magnetic Permalloy sheets 391*a* and 391*b* arranged parallel with each other and laminated on the stainless sheet 390. The portion "B" shows the electron beam apertures 392 and the pole tip portions 393 are formed by punching. The pair of the Permalloy sheets 391*a* and 391*b* are positioned such that the pole tips are formed in the Permalloy sheets. Subsequently the deflection defocusing correcting member 39 is completed by press-forming as shown in the portions "C" and "D"

Figure 27A:
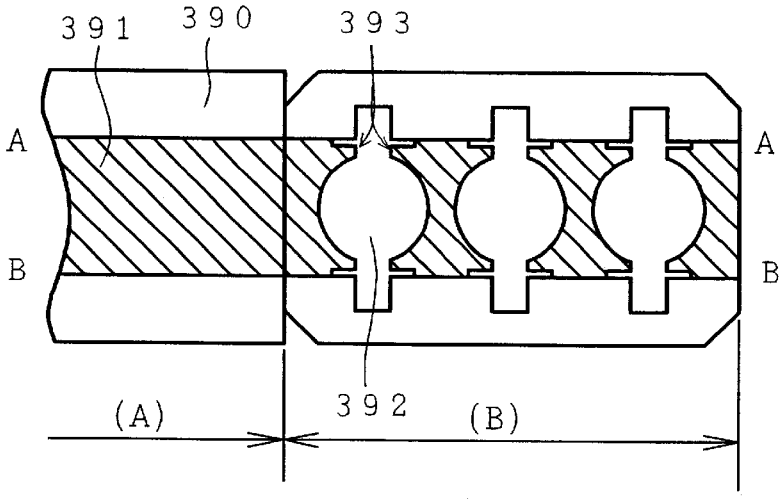
FIG. 27A is a top view illustrating an embodiment of a deflection defocusing correcting member.

FIG. 27A illustrates states of a clad sheet and of a punched clad sheet for another embodiment of the deflection defocusing correcting member of the present invention, the portion "A" illustrates a plan view of part of a clad sheet before processing, the portion "B" illustrates a plan view of the subsequent punched state of a portion corresponding to a piece of the deflection defocusing correcting member.

The portion "A" shows the clad sheet is a sheet comprised of a long thin non-magnetic stainless sheet 390 and a soft magnetic Permalloy sheet 391 laminated on the stainless sheet 390 like in FIG. 24. The portion "B" shows the electron beam apertures 392 and the pole tip portion 393 are formed by punching.

The pole tips 393 are positioned spaced from lines passing through long sides A—A and B—B of the Permalloy sheet 391 toward the electron beam apertures 392. This positional relationship eliminates variations of the shape of the pole tips 393 caused by errors in positioning a punching die with respect to the long sides A—A and B—B of the Permalloy sheet 392 in a direction perpendicular to the long sides A—A and B—B.

Figure 27B:
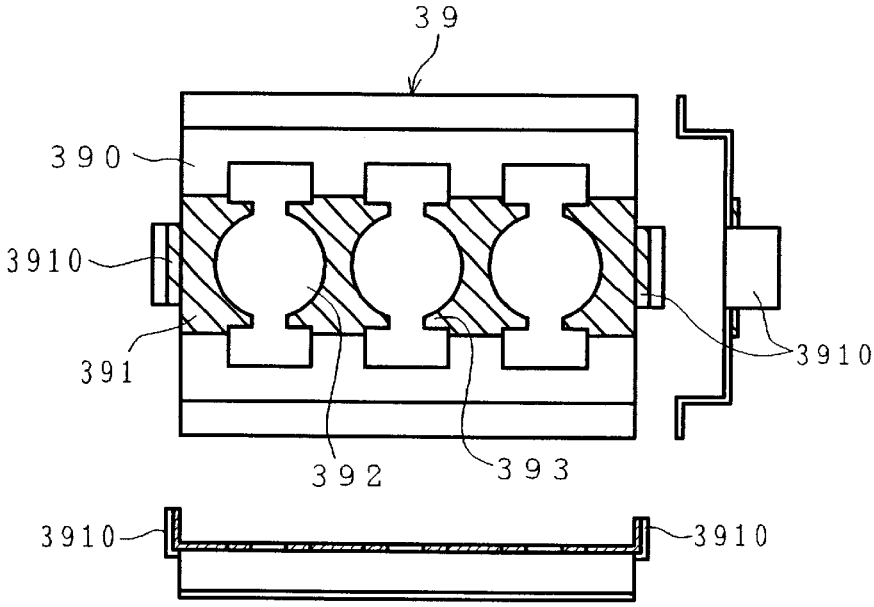
FIG. 27B is top and side views of a modification of the deflection defocusing correcting member of FIG. 27A with tongue portions added.

The deflection defocusing correcting member 39 shown in FIG. 27B is a modification of that shown in FIG. 27A with Permalloy tongue portions 3910 extending along a cathode ray tube axis added. FIG. 27C illustrates the manufacturing steps for the deflection defocusing correcting member 39 of FIG. 27B; punching out of apertures, enlarging of the apertures, forming pole pieces and folding of tongues 3910, folding of top and bottom edges 3920, and cutting.

Figure 27D:
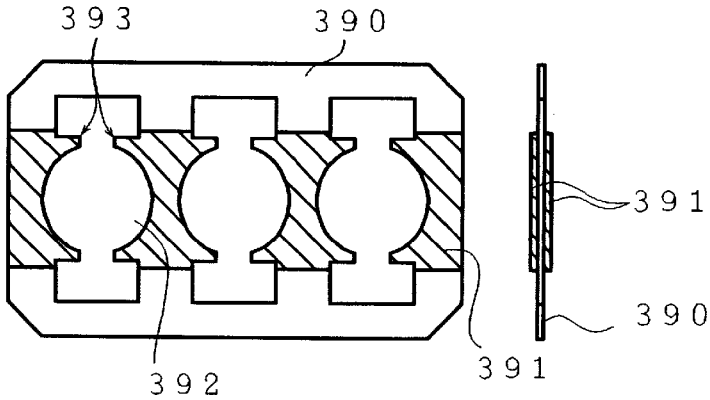
FIG. 27D is a top view of a modification of the deflection defocusing correcting member of FIG. 27A with another magnetic thin sheet added.
Figure 27C:
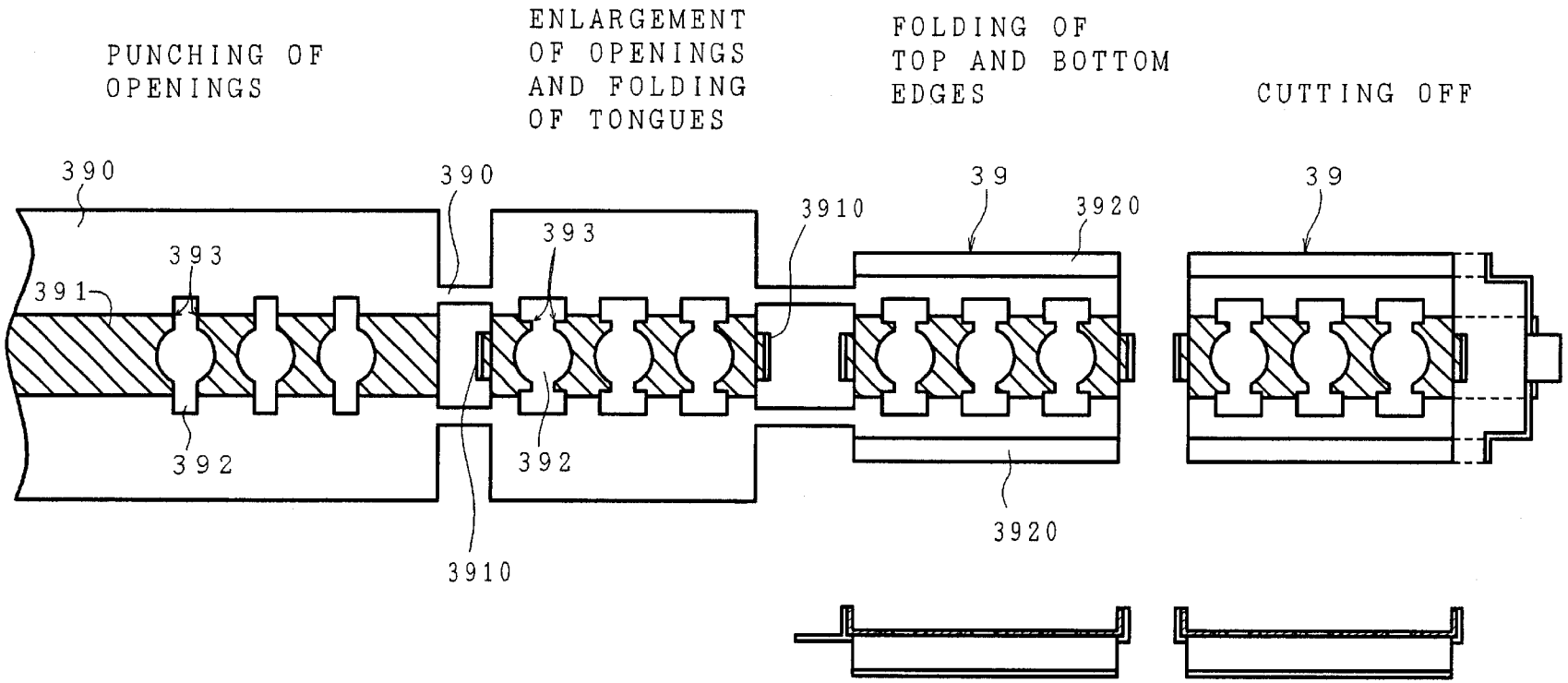
FIG. 27C is an illustration of manufacturing sequences of the deflection defocusing correcting member of FIG. 27B.

The deflection defocusing correcting member 39 shown in FIG. 27D is a modification of that shown in FIG. 27A with another Permalloy sheet 391 added on the opposite surface of the non-magnetic sheet 390.

Figure 28:
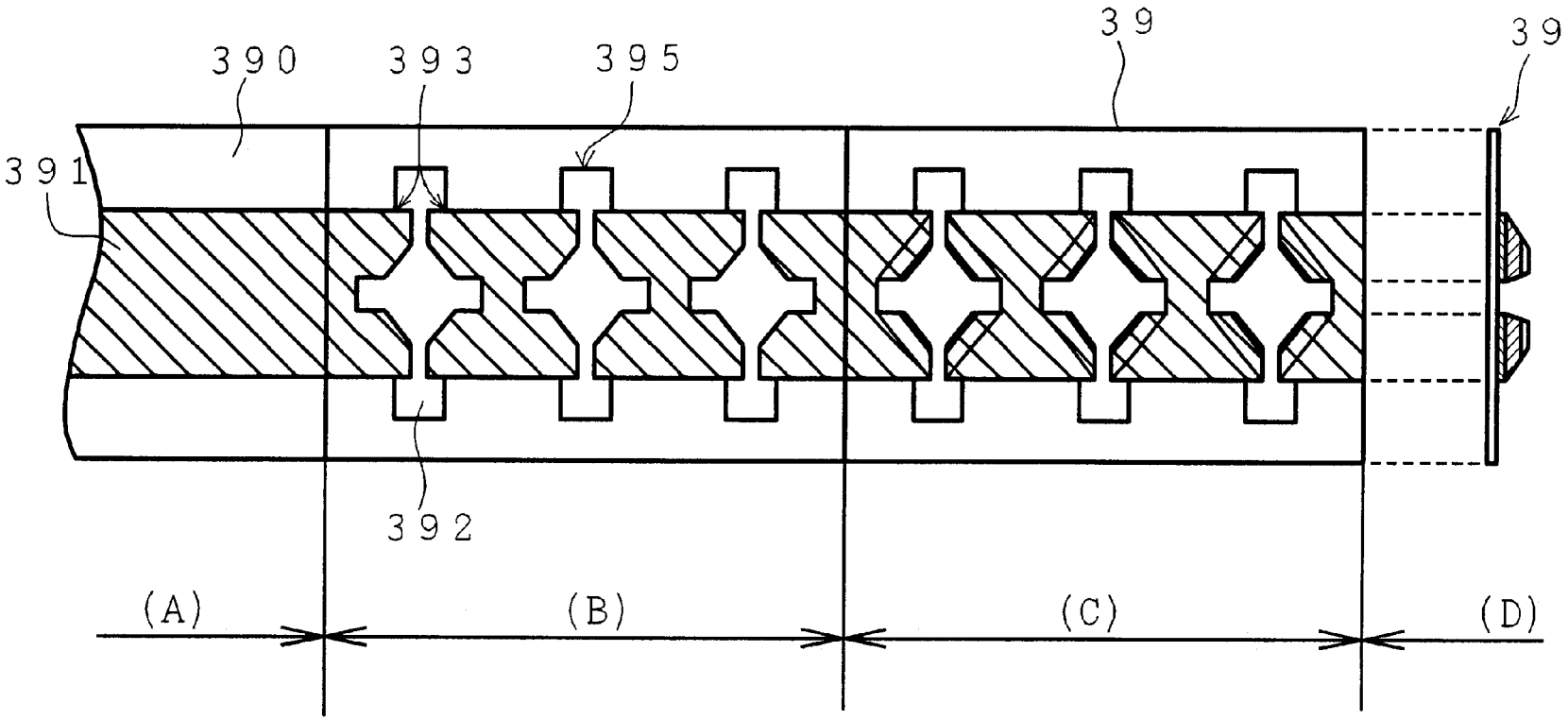
FIG. 28 is a top view illustrating an embodiment of a deflection defocusing correcting member and a manufacturing method thereof of the present invention.

FIG. 28 illustrates states of a clad sheet and a punched clad sheet for another embodiment of the deflection defocusing correcting member of the present invention, the portion "A" illustrates a plan view of part of a clad sheet before processing, the portion "B " illustrates a plan view of the subsequent punched state of a portion corresponding to a piece of the deflection defocusing correcting member, the portion "C" illustrates a plan view of the subsequent press-formed state and the portion "D" illustrates a side view corresponding to the portion "C".

The portion "A" shows the clad sheet is a sheet comprised of a long thin non-magnetic stainless sheet 390 and a soft magnetic Permalloy sheet 391 laminated on the stainless sheet 390. The portion "B" shows the electron beam apertures 392 and the pole tip portions 393 are formed by punching. Subsequently the deflection defocusing correcting member 39 is completed by press-forming the vicinity of the electron beam apertures 392 of the soft magnetic sheet 391 as protruding along the electron gun axis, as shown in the portions "C" and "D". It is possible to punch out the electron beam apertures 392 and the pole tip portions 393 in the portion "B" and to press-form in the portion "C" at the same time.

Figure 48A:
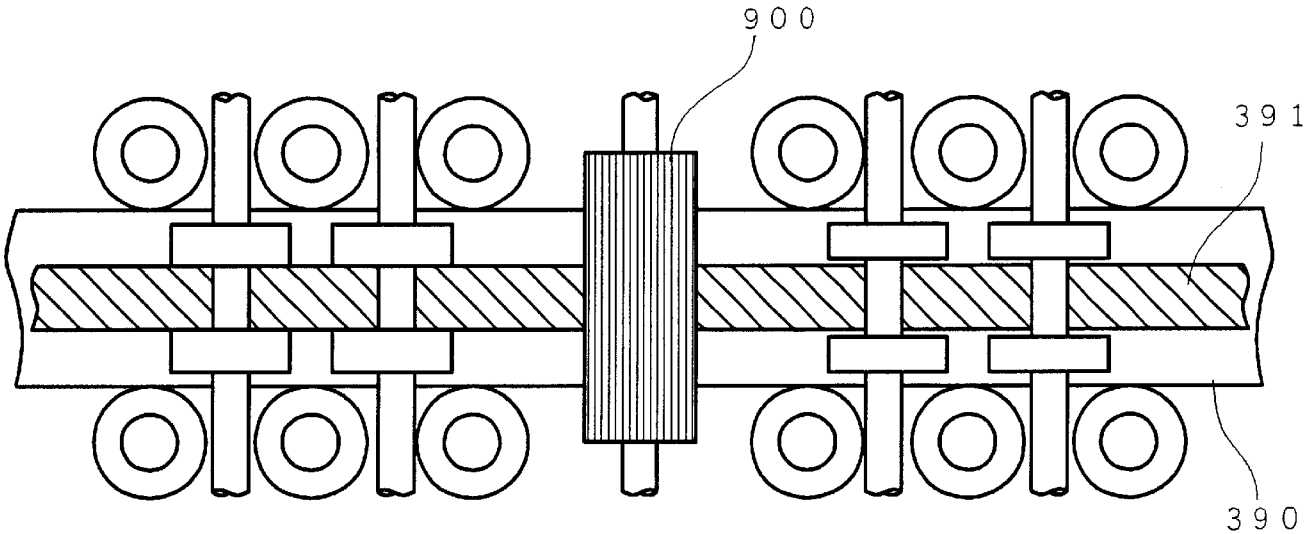
FIGS. 48A and 48B are top and side views of sequences for fabricating laminated (clad) sheets of the present invention by using rotating roller welding electrodes, respectively.
Figure 48B:
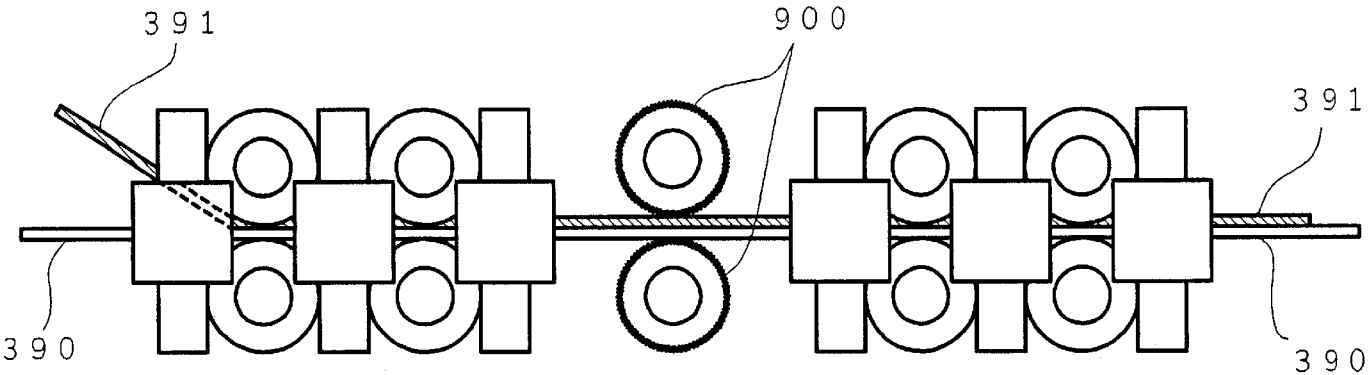

FIGS. 48A and 48B are top and side views for illustrating manufacturing steps for a clad sheet by using rotating roller welding electrodes, respectively. A long thin stainless sheet 390 and a long thin Permalloy sheet 391 are pressed and welded together as they are moved.

Figure 49A:
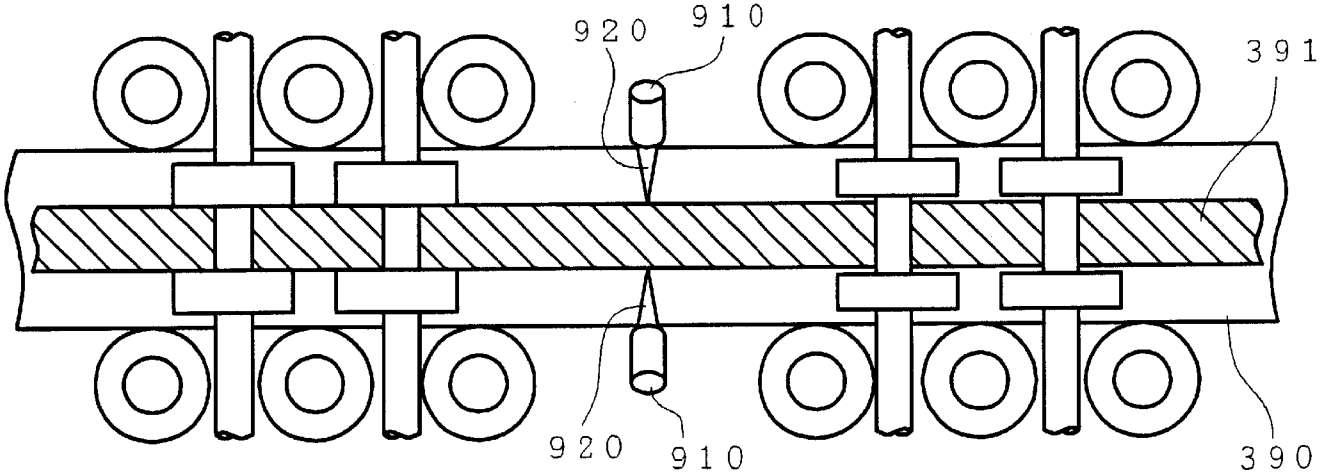
FIGS. 49A and 49B are top and side views of sequences for fabricating laminated (clad) sheets of the present invention by electron beam welding, respectively.
Figure 49B:
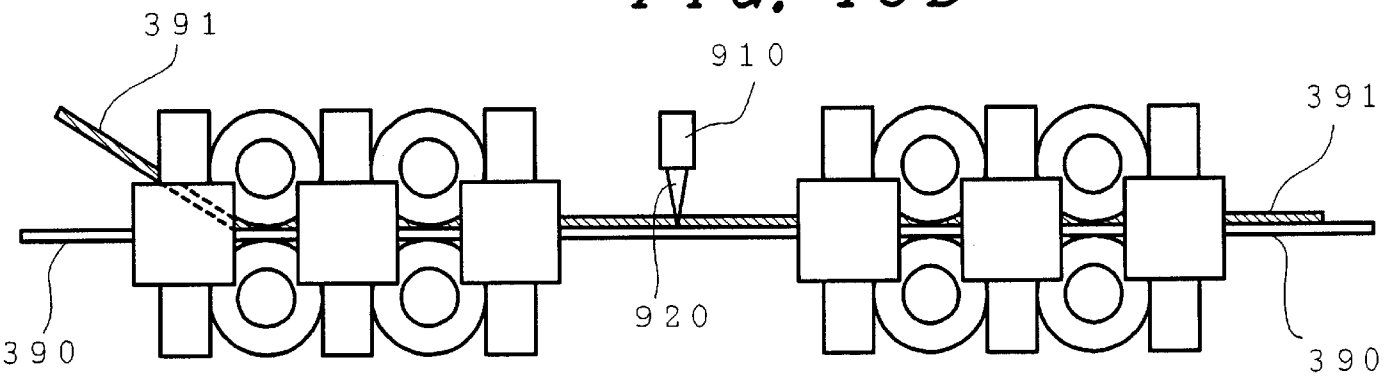

FIGS. 49A and 49B are top and side views for illustrating manufacturing steps for a clad sheet by using electron beam welding, respectively. A long thin stainless sheet 390 and a long thin Permalloy sheet 391 are pressed and welded together as they are moved. The electron beams 920 from the electron guns 910 are projected onto the edges of the Permalloy sheet for welding the Permalloy sheet and the stainless sheet together.

(7) Embodiments of Deflection Defocusing Correcting Members of Butt-Welded (Edge-to-Edge Welded) Structures and Manufacturing Methods Thereof FIGS. 29 to 33 are top views illustrating embodiments of deflection defocusing correcting members of the butt-welded (edge-to-edge welded) structures and manufacturing methods thereof of the present invention.

Figure 29:
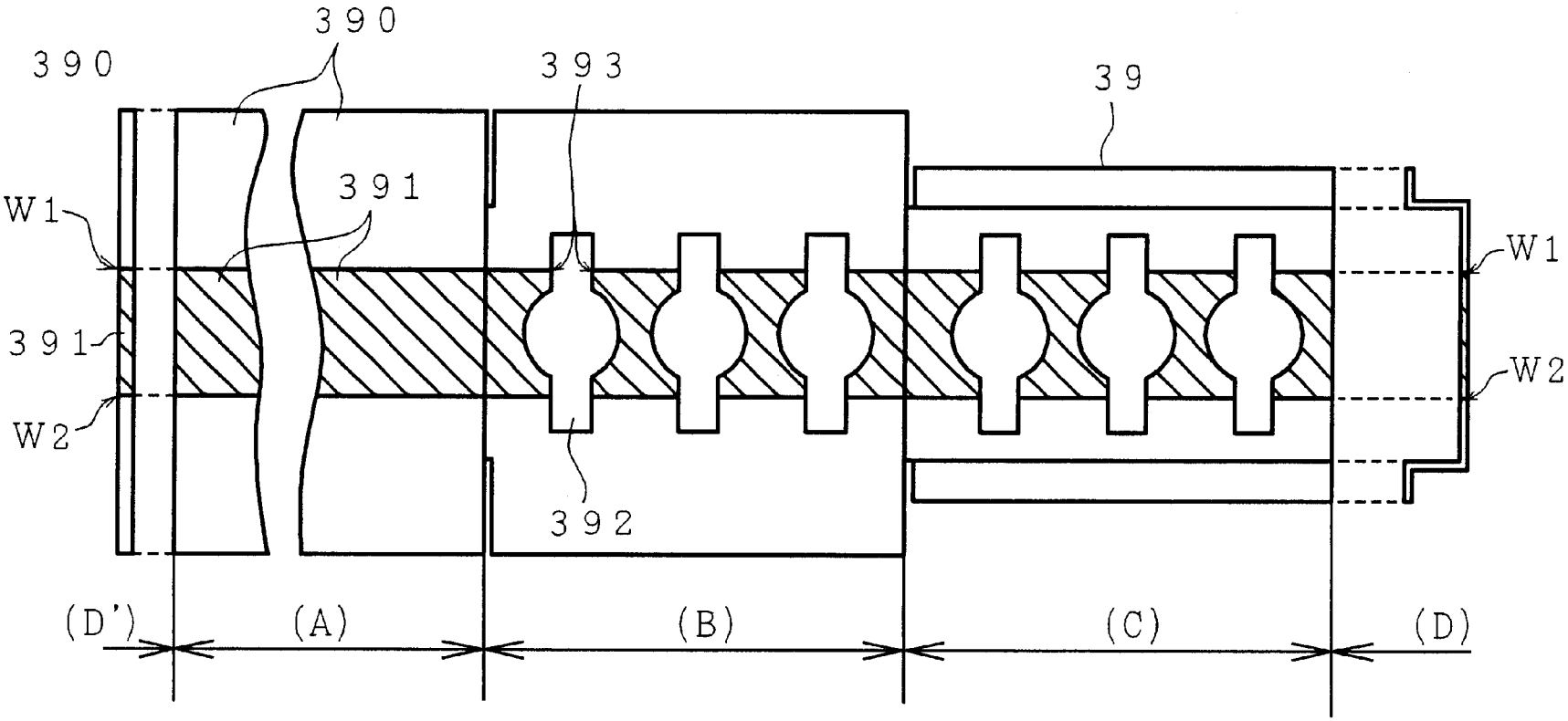
FIG. 29 is a top view illustrating an embodiment of a deflection defocusing correcting member and a manufacturing method thereof of the present invention.

FIG. 29 illustrates a state of a butt-welded sheet formed of a pair of long non-magnetic sheets and a long soft magnetic sheet alternately arranged and welded long-edge to long-edge with each other and a punched state of the butt-welded sheet for one embodiment of the deflection defocusing correcting member of the present invention, the portion "A" illustrates a plan view of part of a butt-welded sheet before processing, the portion "B" illustrates a plan view of the subsequent punched state of a portion corresponding to a piece of the deflection defocusing correcting member, the portion "C" illustrates a plan view of the subsequent press-formed state and the portion "D" illustrates a side view corresponding to the portion "C".

The portion "A" shows, as a composite sheet comprised of a pair of long thin non-magnetic sheets and a long thin soft-magnetic sheet butt-welded between the pair of the non-magnetic sheets long-edge-to-long-edge (hereinafter may be referred to as "composite sheet" only), a pair of long stainless steel sheets 390 and a Permalloy soft-magnetic sheet 391 are butt-welded together. The butt-weld portions are indicated by W1 and W2. The portion "B" shows the electron beam apertures 392 and the pole tip portion 393 are formed by punching. Subsequently the deflection defocusing correcting member 39 is completed by press-forming as shown in the portions "C" and "D". It is possible to punch out the electron beam apertures 392 and the pole tip portions 393 in the portion "B" and to press-form in the portion "C" at the same time.

Figure 30:
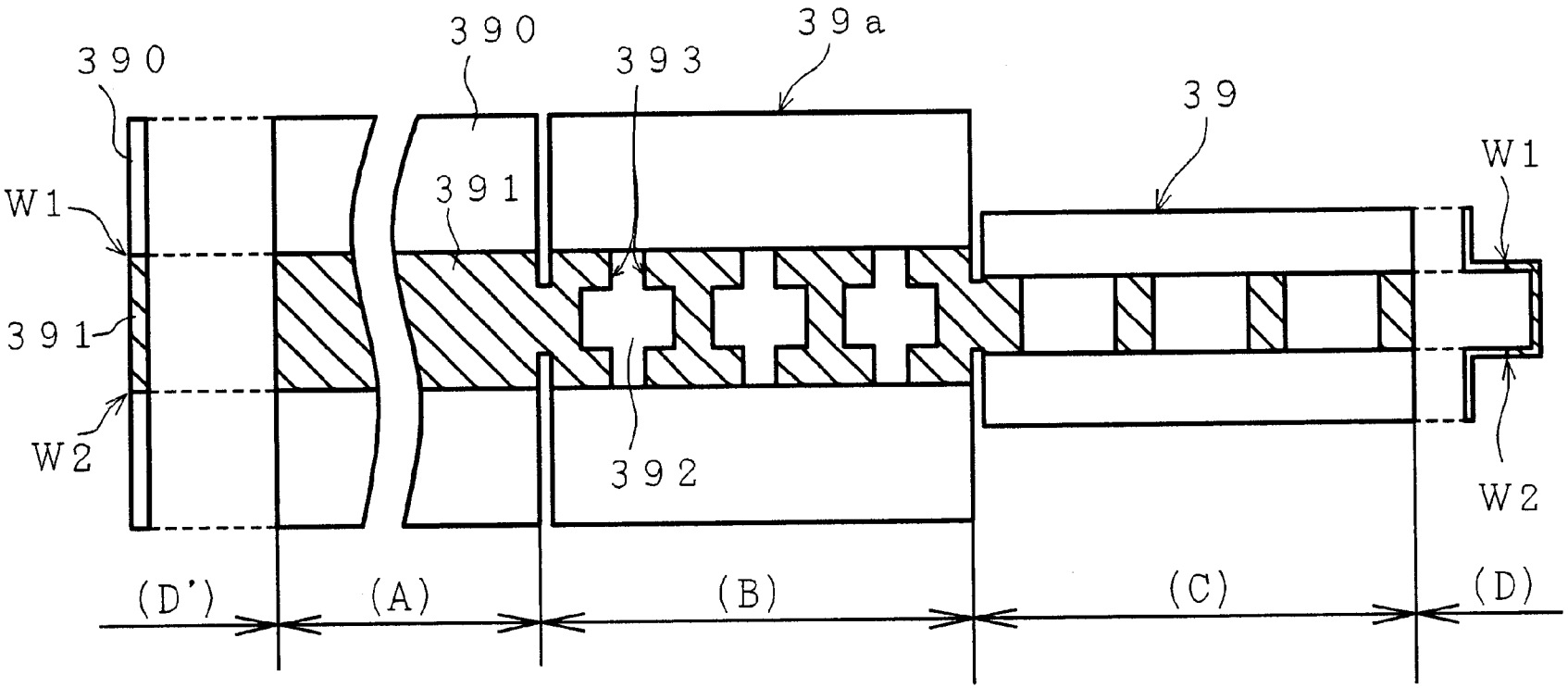
FIG. 30 is a top view illustrating an embodiment of a deflection defocusing correcting member and a manufacturing method thereof of the present invention.

FIG. 30 illustrates a state of a composite sheet and a punched state of the composite sheet for another embodiment of the deflection defocusing correcting member of the present invention, the portion "A" illustrates a plan view of part of the composite sheet before processing, the portion "B" illustrates a plan view of the subsequent punched state of a portion of the composite sheet corresponding to a piece of the deflection defocusing correcting member, the portion "C" illustrates a plan view of the subsequent press-formed state, the portion "D" illustrates a side view corresponding to the portion "C". and the portion "D'" illustrates a side view corresponding to the portion "A". The portion "A" shows, as a composite sheet, a soft-magnetic Permalloy sheet 391 are butt-welded between a pair of long non-magnetic stainless steel sheets 390 as in FIG. 29. The portion "B" shows the electron beam apertures 392 and the pole tip portions 393 are formed by punching. Subsequently the deflection defocusing correcting member 39 is completed by press-forming as shown in the portions "C" and "D". It is possible to punch out the electron beam apertures 392 and the pole tip portions 393 in the portion "B" and to press-form in the portion "C" at the same time.

Figure 31:
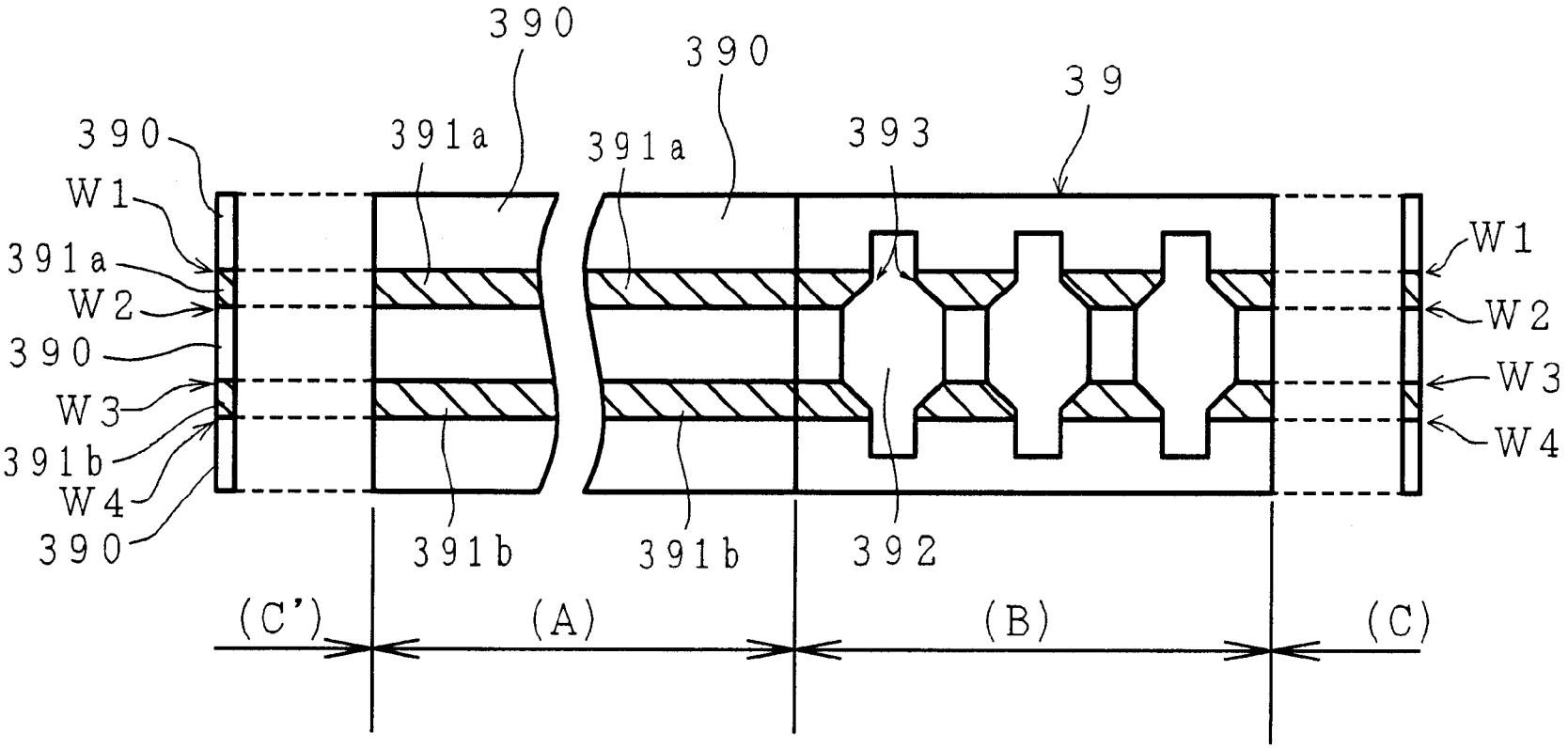
FIG. 31 is a top view illustrating an embodiment of a deflection defocusing correcting member and a manufacturing method thereof of the present invention.

FIG. 31 illustrates a state of a composite sheet and a punched state of the composite sheet for another embodiment of the deflection defocusing correcting member of the present invention, the portion "A" illustrates a plan view of part of the composite sheet before processing, the portion "B" illustrates a plan view of the subsequent punched state of a portion of the composite sheet corresponding to a piece of the deflection defocusing correcting member, the portion "C" illustrates a side view corresponding to the portion "B". and the portion "C'" illustrates a side view corresponding to the portion "A". The portion "A" shows, as a composite sheet, a pair of soft-magnetic Permalloy sheets 391*a* and 391*b* are arranged alternately with and parallel to three long thin non-magnetic stainless steel sheets 390 and butt-welded with each other. The portion "B" shows the electron beam apertures 392 and the pole tip portions 393 are formed by punching. The butt-weld portions are indicated by W1, W2, W3 and W4. The pair of the Permalloy sheets are positioned and butt-welded by choosing proper width of each of the sheets such that the pole tip portions 393 are formed in the Permalloy sheets.

Figure 32A:
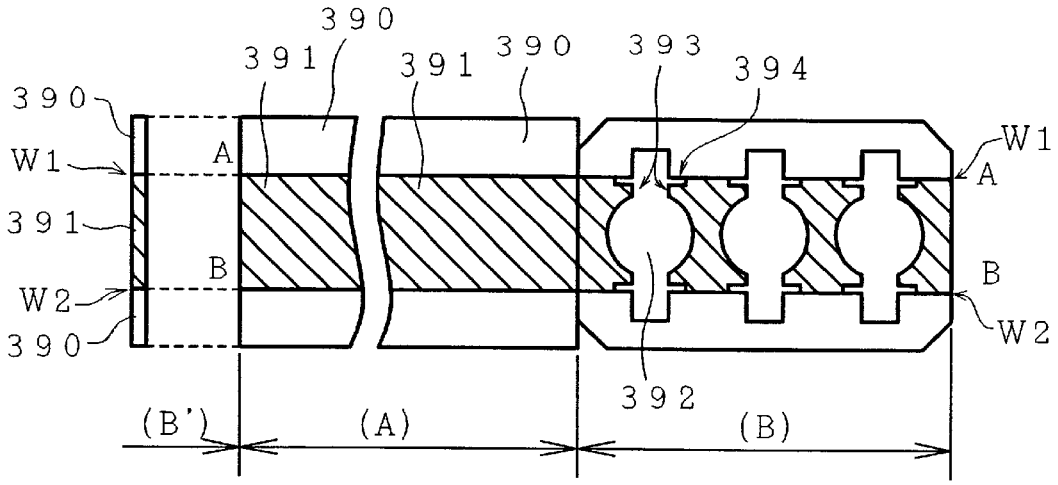
FIG. 32A is a top view illustrating an embodiment of a deflection defocusing correcting member and a manufacturing method thereof of the present invention.

FIG. 32A illustrates a state of a composite sheet and a punched state of the composite sheet for another embodiment of the deflection defocusing correcting member of the present invention, the portion "A" illustrates a plan view of part of the composite sheet before processing, the portion "B" illustrates a plan view of the subsequent punched state of a portion of the composite sheet corresponding to a piece of the deflection defocusing correcting member, the portion "C" illustrates a side view corresponding to the portion "B". and the portion "C'" illustrates a side view corresponding to the portion "A". The portion "A" shows, as a composite sheet, a soft-magnetic Permalloy sheets 391 is arranged between and butt-welded to long sides of a pair of long thin non-magnetic stainless steel sheets 390. The portion "B"

shows the electron beam apertures 392 and the pole tip portions 393 are formed by punching.

The pole tips 393 are positioned spaced from lines passing through long sides A—A and B—B of the Permalloy sheet 391 toward the electron beam apertures 392. This positional relationship eliminates variations of the shape of the pole tips 393 caused by errors in positioning a punching die with respect to the long sides A—A and B—B of the Permalloy sheet 392 in a direction perpendicular to the long sides A—A and B—B.

Figure 32B:
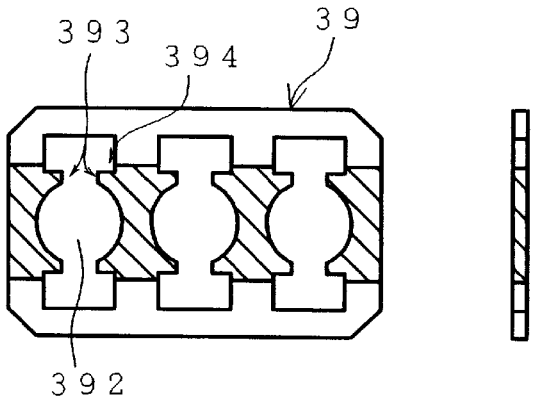
FIG. 32B is a top view of a modification of the deflection defocusing correcting member of FIG. 32A.
Figure 32C:
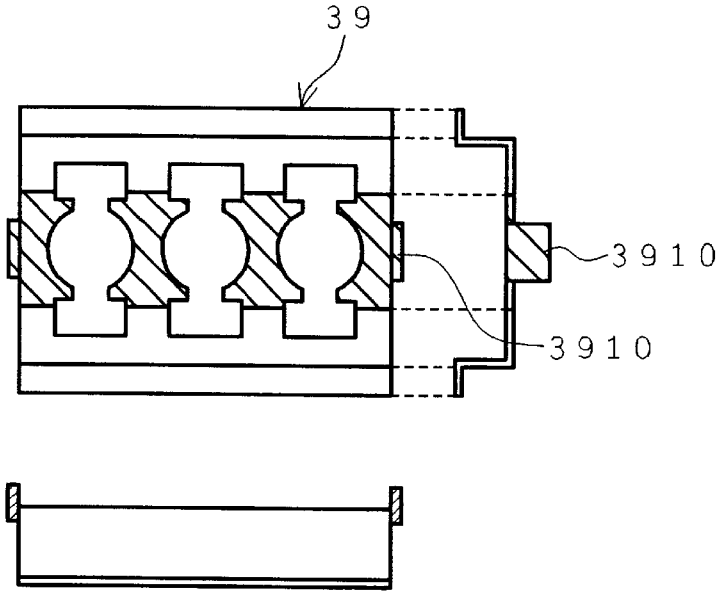
FIG. 32C is a top view of a modification of the deflection defocusing correcting member of FIG. 32B with tongue portions added.

The deflection defocusing correcting member 39 shown in FIG. 32B is a modification of that shown in FIG. 32A with some geometrical changes, and the deflection defocusing correcting member 39 shown in FIG. 32C is a modification of that shown in FIG. 32B with Permalloy tongue portions 3910 extending along a cathode ray tube axis added.

Figure 33:
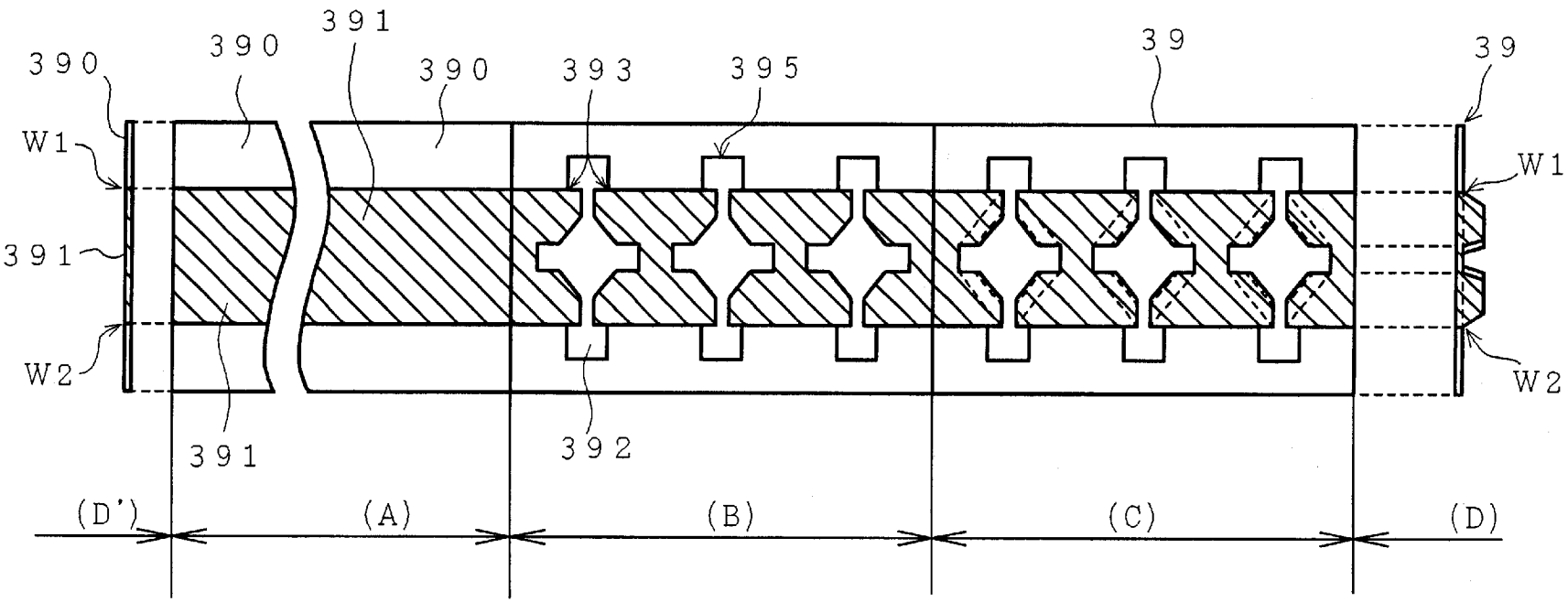
FIG. 33 is a top view illustrating an embodiment of a deflection defocusing correcting member and a manufacturing method thereof of the present invention.

FIG. 33 illustrates a state of a composite sheet and a punched state of the composite sheet for another embodiment of the deflection defocusing correcting member of the present invention, the portion "A" illustrates a plan view of part of the composite sheet before processing, the portion "B" illustrates a plan view of the subsequent punched state of a portion of the composite sheet corresponding to a piece of the deflection defocusing correcting member, the portion "C" illustrates the subsequent press-formed state of the composite sheet, the portion "D" illustrates a side view corresponding to the portion "C", and the portion "D'" illustrates a side view corresponding to the portion "A". The portion "A" shows, as a composite sheet, a soft-magnetic Permalloy sheets 391 is arranged between and butt-welded to long sides of a pair of long thin non-magnetic stainless steel sheets 390. The portion "B" shows the electron beam apertures 392 and the pole tip portions 393 are formed by punching. Subsequently the deflection defocusing correcting member 39 is completed by press-forming the vicinity of the electron beam apertures 392 of the soft magnetic sheet 391 as protruding along the electron gun axis, as shown in the portions "C" and "D". It is possible to punch out the electron beam apertures 392 and the pole tip portions 393 in the portion "B" and to press-form in the portion "C" at the same time.

Figure 50A:
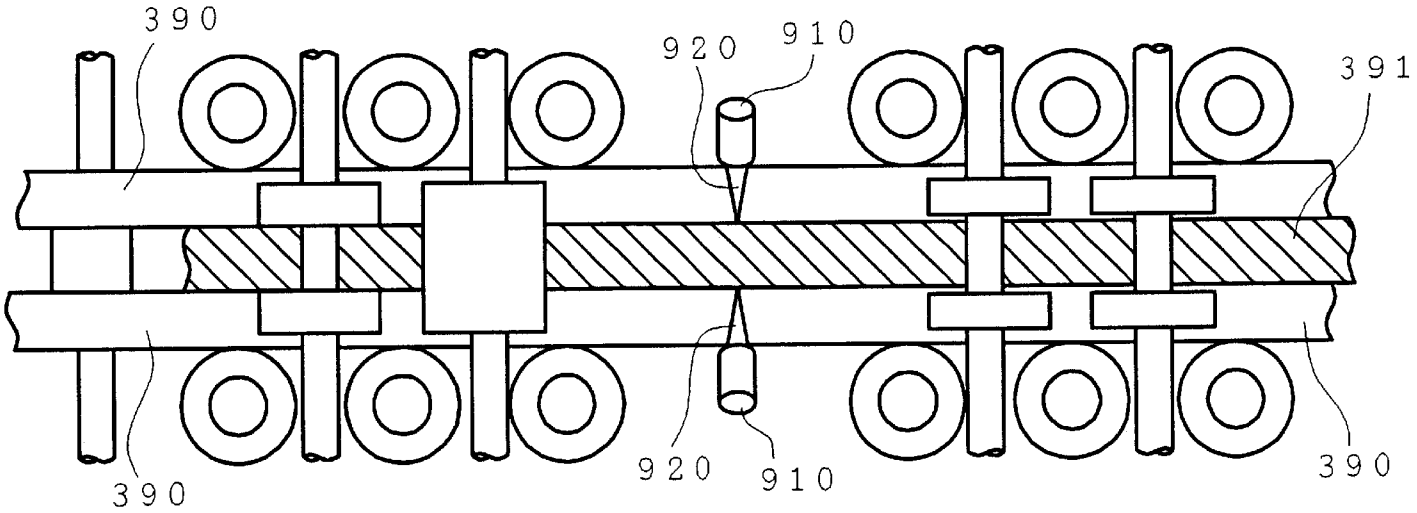
FIGS. 50A and 50B are top and side views of sequences for fabricating sheets jointed edge to edge of the present invention by electron beam welding.
Figure 50B:
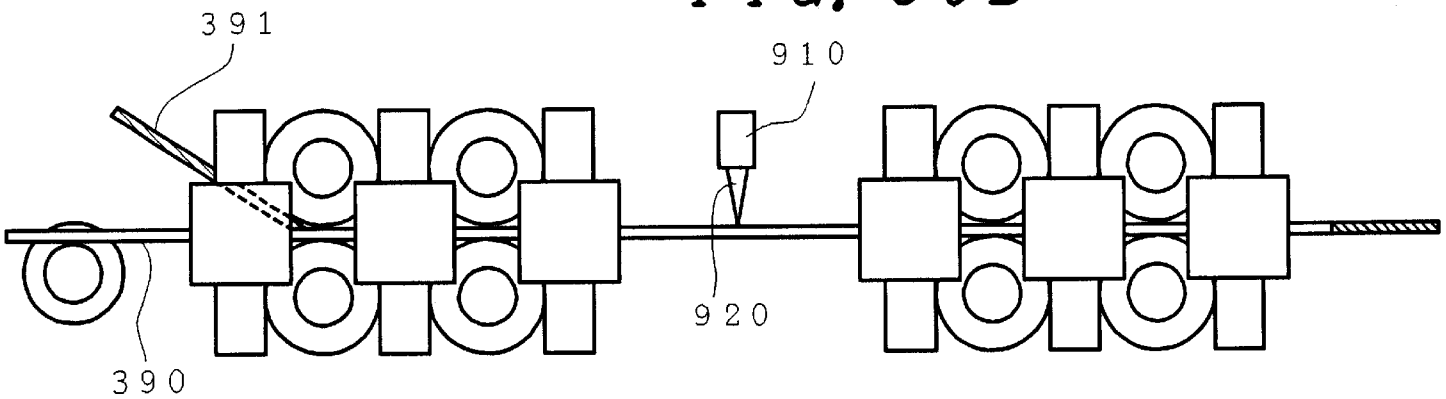

FIGS. 50A and 50B are top and side views for illustrating manufacturing steps for a composite sheet by butt-welding with electron beam, respectively. A long thin soft-magnetic sheet 391 is positioned between and butt-welded to long sides of a pair of long thin non-magnetic sheets 390. The electron beams 920 from the electron guns 910 are projected onto the butting edges of the sheets for welding the sheets.

Figure 34A:
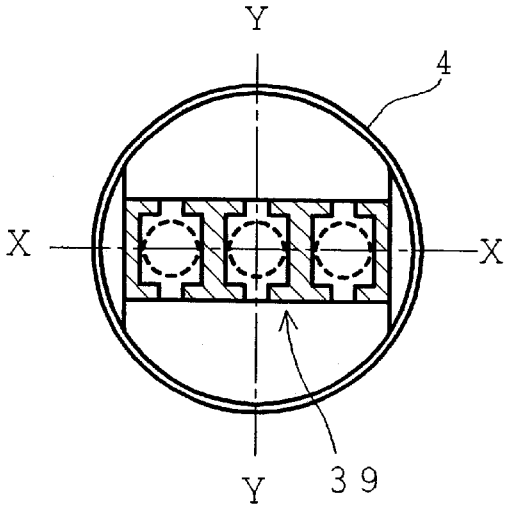
Figure 34B:
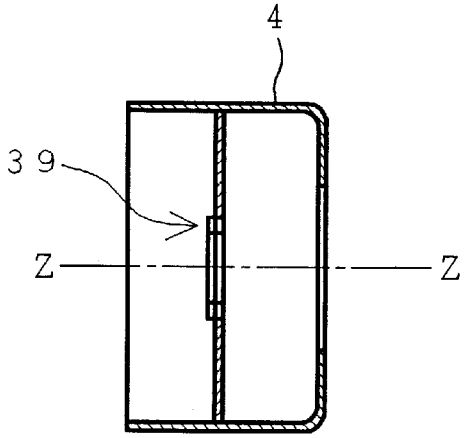
Figure 34C:
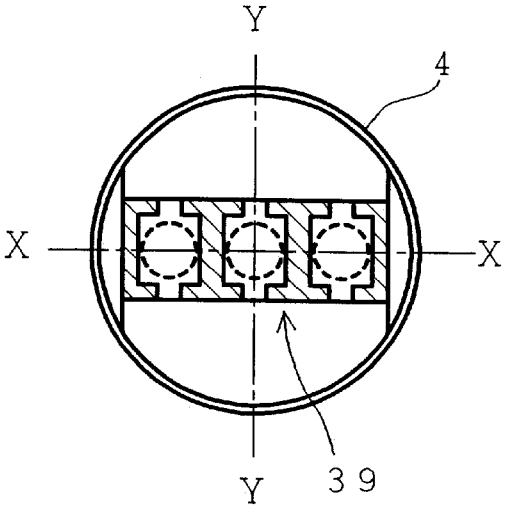
Figure 34D:
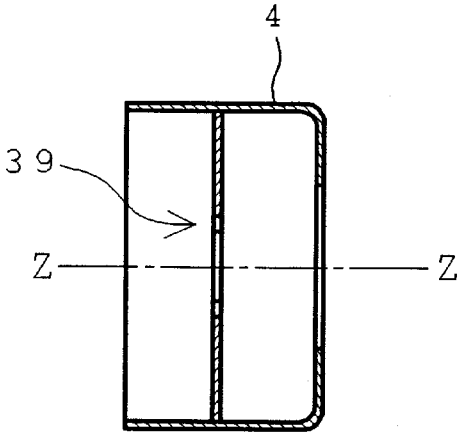

FIGS. 34A and 34B are a front view and a sectional view through an electron gun axis Z—Z of an embodiment of the electron gun employing the deflection defocusing correcting member of the cladding structure of the present invention, respectively, and FIGS. 34C and 34D are a front view and a sectional view through an electron gun axis Z—Z of an embodiment of the electron gun employing the deflection defocusing correcting member of the butt-welded structure of the present invention, respectively. The line X—X indicates the beam inline direction and the line Y—Y indicates a direction perpendicular to the beam inline direction. In these embodiments, the deflection defocusing correcting members 39 are attached inside a shield cup 4 fixed to the final electrode of the electron gun, are located in a deflection magnetic field, and function to correct deflection defocusing of the electron beam corresponding to the varying deflection magnetic field.

Figure 35A:
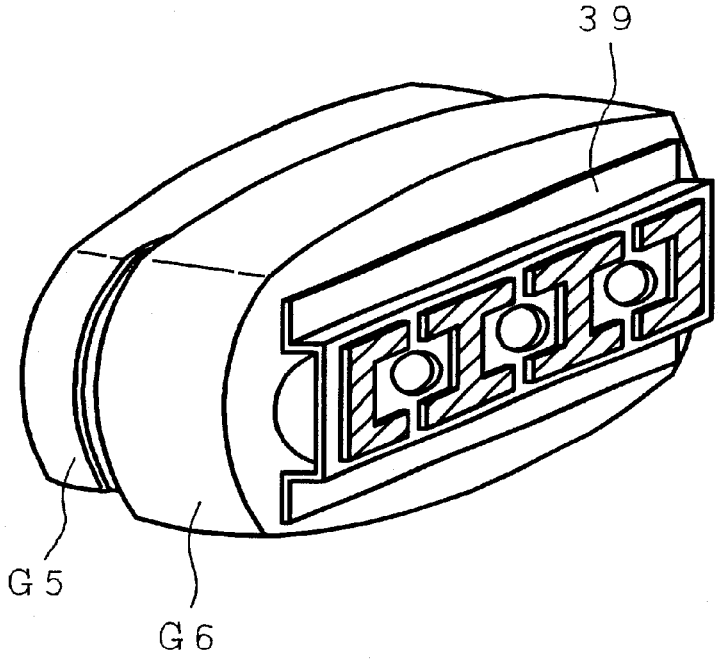
FIGS. 35A and 35B are perspective views of part of other two different electron guns having a deflection defocusing correcting member incorporated therein of the present invention.
Figure 35B:
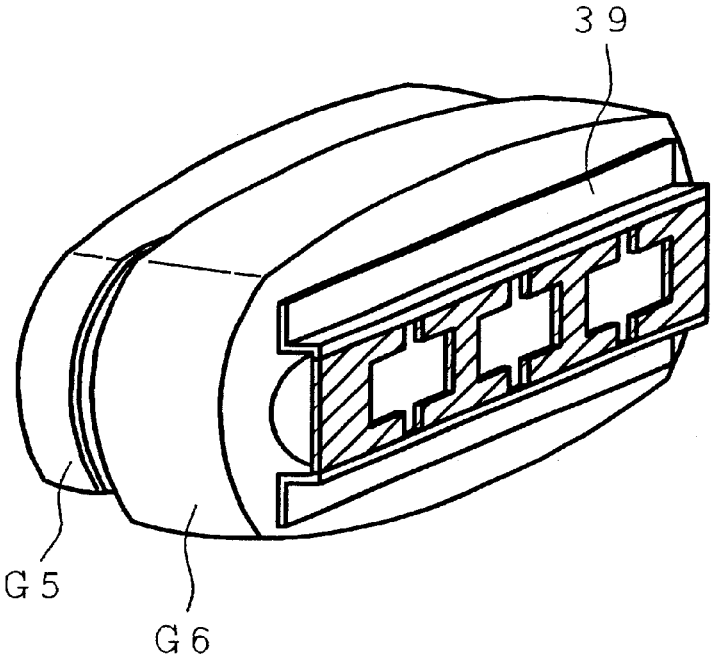

FIGS. 35A and 35B are partial perspective views of other two embodiments of the electron gun employing the deflection defocusing correcting member of the cladding and butt-welded structures of the present invention, respectively. G5, G6 and reference numeral 4 indicate a focus electrode, a final electrode and a shield cup, respectively. In these embodiments the deflection defocusing correcting member 39 are attached to the end faces of the final electrodes G6 and serve as a shield cup.

Figure 36A:
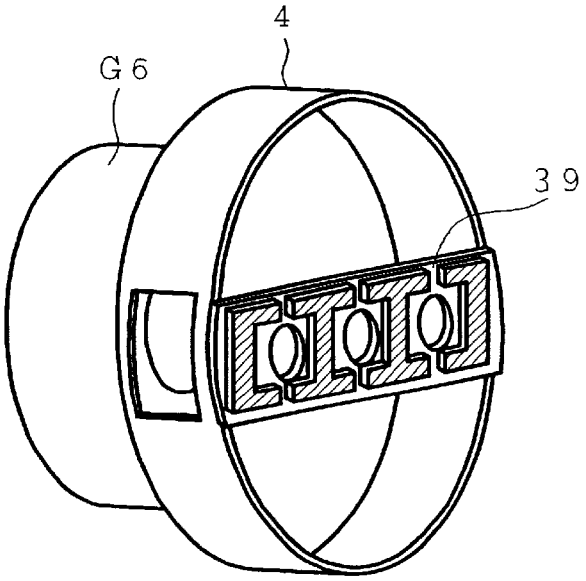
FIGS. 36A and 36B are perspective views of part of other two different electron guns having a deflection defocusing correcting member incorporated therein of the present invention.
Figure 36B:
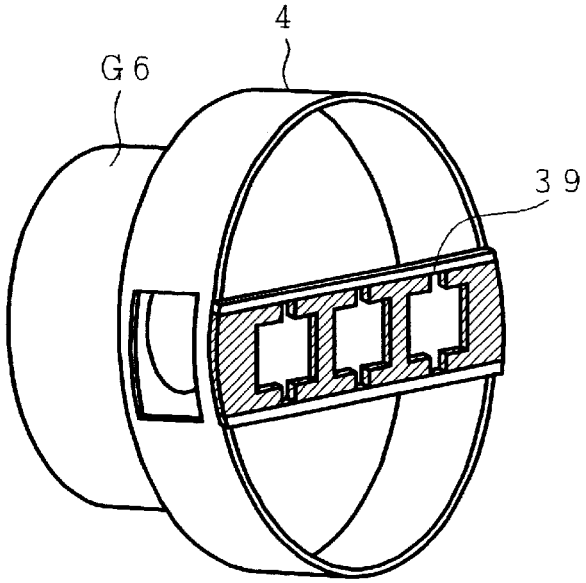

FIGS. 36A and 36B are partial perspective views of other two embodiments of the electron gun employing the deflection defocusing correcting member of the cladding and butt-welded structures of the present invention, respectively. G5, G6 and reference numeral 4 indicate a focus electrode, a final electrode and a shield cup, respectively. In these embodiments the deflection defocusing correcting member 39 are attached to the open end of the final electrodes G6.

In the above embodiments deflection defocusing is corrected with deflection of the electron beam.

(8) Application of the Present Invention to a Single-Beam Cathode Ray Tube

Figure 37A:
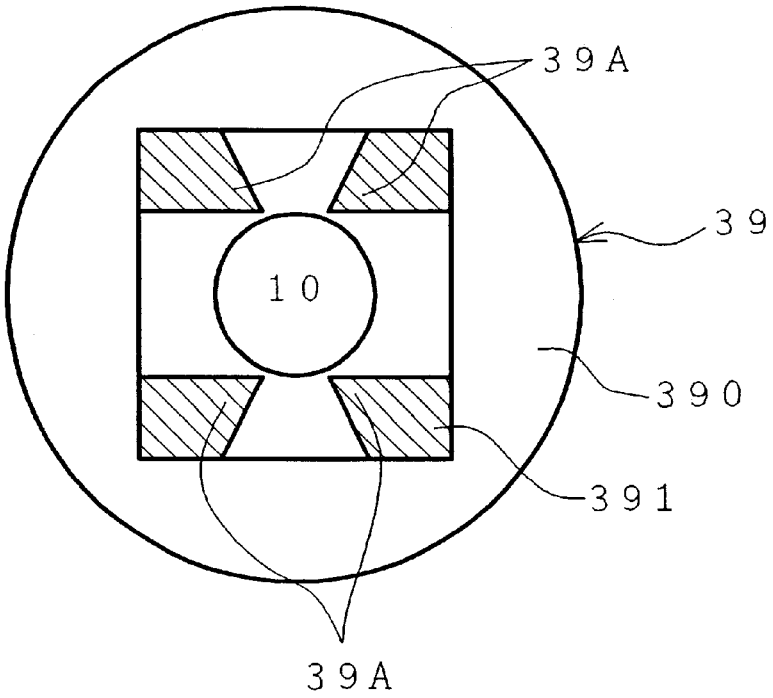
FIGS. 37A and 37B are views showing an essential portion of two further different configuration examples in which the present invention is applied to a single electron beam type electron gun for a cathode ray tube.
Figure 37B:
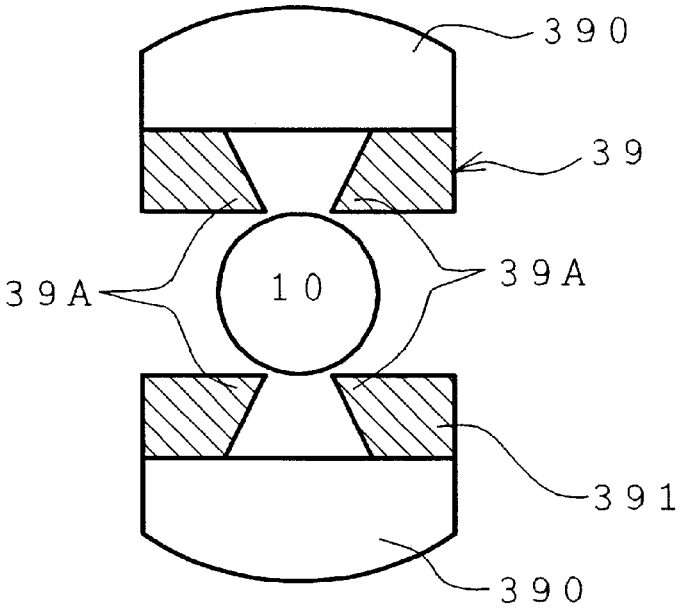

FIGS. 37A and 37B are schematic front views illustrating essential parts of two embodiments of the deflection defocusing correcting members of the cladding and butt-welded structures of the present invention applied to an electron gun for a single-beam cathode ray tube, respectively. The correcting member 39 shown in FIG. 37A is formed of a non-magnetic sheet 390 and 4 soft magnetic sheets 391 laminated on the non-magnetic sheet 390, and the correcting member 39 shown in FIG. 37B is formed of non-magnetic sheets 390 and 4 soft magnetic sheets 391 butt-welded to the non-magnetic sheets 390, and in these embodiments the horizontal gaps between the pole tips 39A can be made small.

With this construction, the deflection defocusing of the vertically deflected electron beam 10 can be corrected. These single-beam cathode ray tube are suitable for a projection type cathode ray tube.

The pole pieces (Permalloy portions) constituting these deflection defocusing correcting members 39 applicable to a single-beam electron gun is formed by punching a composite sheet formed of non-magnetic thin sheets such as stainless steel sheets and magnetic thin sheets such as Permalloy sheets, butt-welded together with each other. This applies to the embodiments of the single-beam electron gun of the present invention to be described hereinafter.

Figure 38A:
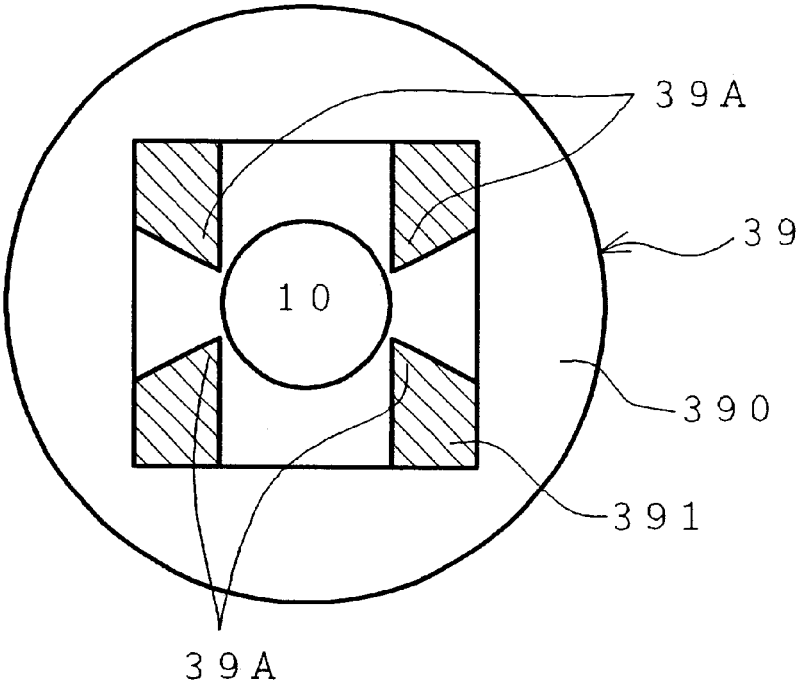
FIGS. 38A and 38B are views showing an essential portion of two further different configuration examples in which the present invention is applied to a single electron beam type electron gun for a cathode ray tube.
Figure 38B:
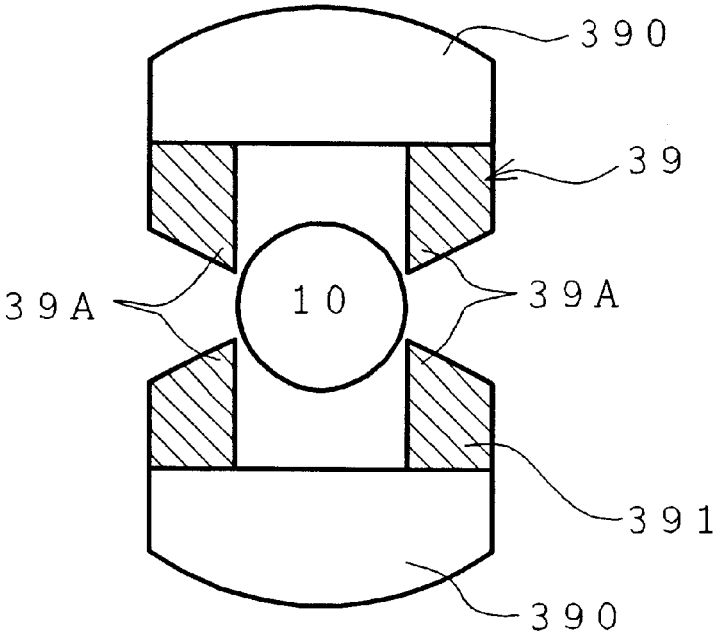

FIGS. 38A and 38B are schematic front views illustrating essential parts of two embodiments of the deflection defocusing correcting members of the cladding and butt-welded structures of the present invention applied to an electron gun for a single-beam cathode ray tube, respectively. The correcting member 39 shown in FIG. 38A is formed of a non-magnetic sheet 390 and 4 soft magnetic sheets 391 laminated on the non-magnetic sheet 390, and the correcting member 39 shown in FIG. 38B is formed of non-magnetic sheets 390 and 4 soft magnetic sheets 391 butt-welded to the non-magnetic sheets 390, and in these embodiments the vertical gaps between the pole tips 39A can be made small. With this construction, the deflection defocusing of the horizontally deflected electron beam 10 can be corrected. These single-beam cathode ray tubes are suitable for a projection type cathode ray tube.

The poles pieces shown in FIGS. 37A and 37B and those in FIGS. 38A and 38B may be combined with each other in accordance with horizontal and vertical magnetic field distributions to correct deflection defocusing in both the horizontal and vertical directions.

Figure 39A:
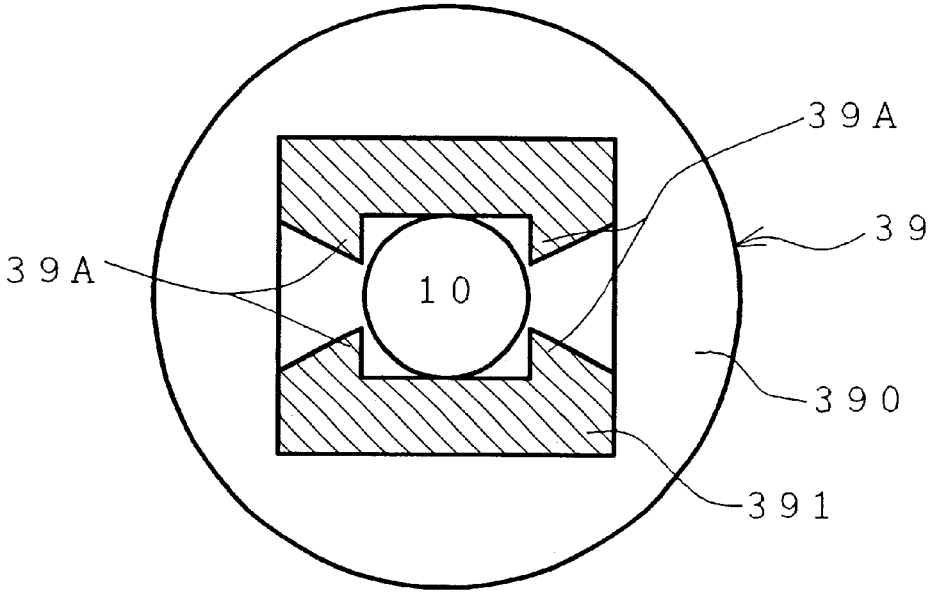
FIGS. 39A and 39B are views showing an essential portion of two further different configuration examples in which the present invention is applied to a single electron beam type electron gun for a cathode ray tube.
Figure 39B:
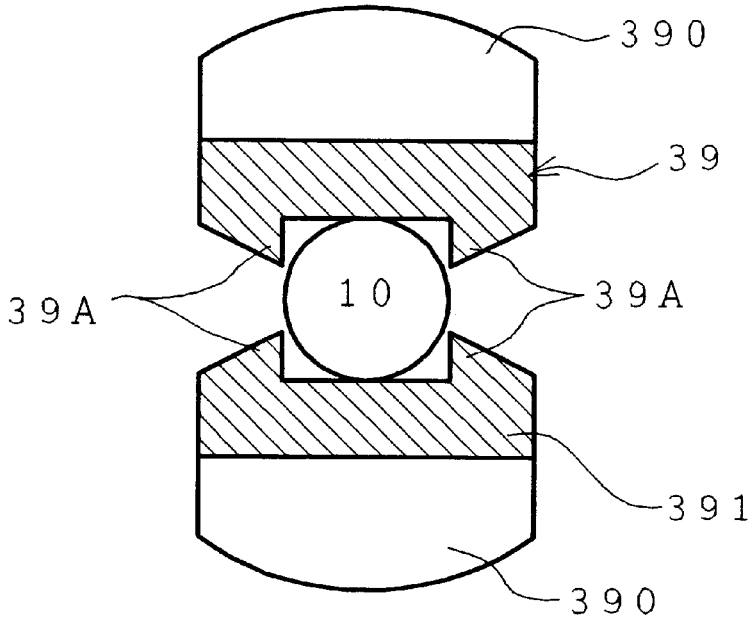

FIGS. 39A and 39B are schematic front views illustrating essential parts of two embodiments of the deflection defocusing correcting members of the cladding and butt-welded structures of the present invention applied to an electron gun for a single-beam cathode ray tube, respectively. The correcting member 39 shown in FIG. 39A is formed of a non-magnetic sheet 390 and two soft magnetic sheets 391 laminated on the non-magnetic sheet 390, and the correcting member 39 shown in FIG. 39B is formed of non-magnetic sheets 390 and two soft magnetic sheets 391 butt-welded to the non-magnetic sheets 390, and in these embodiments the vertical gaps between the pole tips 39A can be made small to correct deflection defocusing of the horizontally deflected electron beam, and the horizontal length of the pole pieces can be made large to collect more horizontal magnetic fluxes compared with the construction in FIGS. 38A and 38B.

Figure 40A:
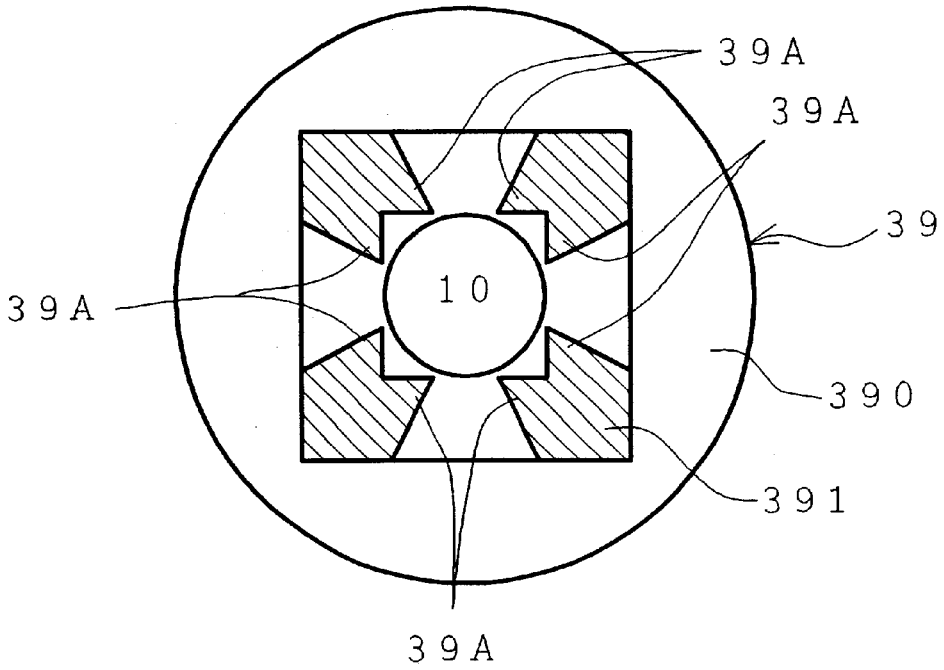
FIGS. 40A and 40B are views showing an essential portion of two further different configuration examples in which the present invention is applied to a single electron beam type electron gun for a cathode ray tube.
Figure 40B:
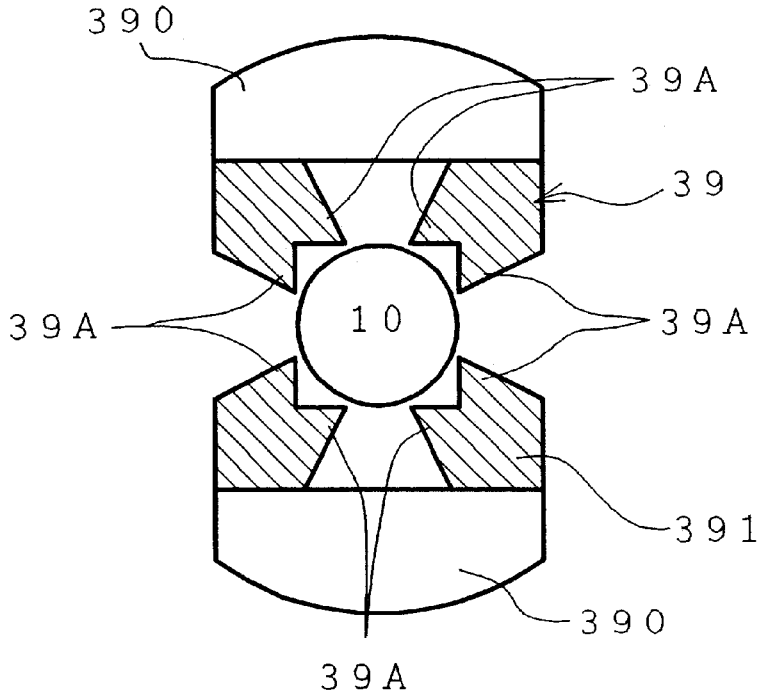

FIGS. 40A and 40B are schematic front views illustrating essential parts of two embodiments of the deflection defocusing correcting members of the cladding and butt-welded structures of the present invention applied to an electron gun for a single-beam cathode ray tube, respectively. The correcting member 39 shown in FIG. 40A is formed of a non-magnetic sheet 390 and four soft magnetic sheets 39I laminated on the non-magnetic sheet 390, and the correcting member 39 shown in FIG. 40B is formed of non-magnetic sheets 390 and four soft magnetic sheets 391 butt-welded to the non-magnetic sheets 390, and these embodiments can correct deflection defocusing of the horizontally and vertically deflected electron beam.

Figure 41:
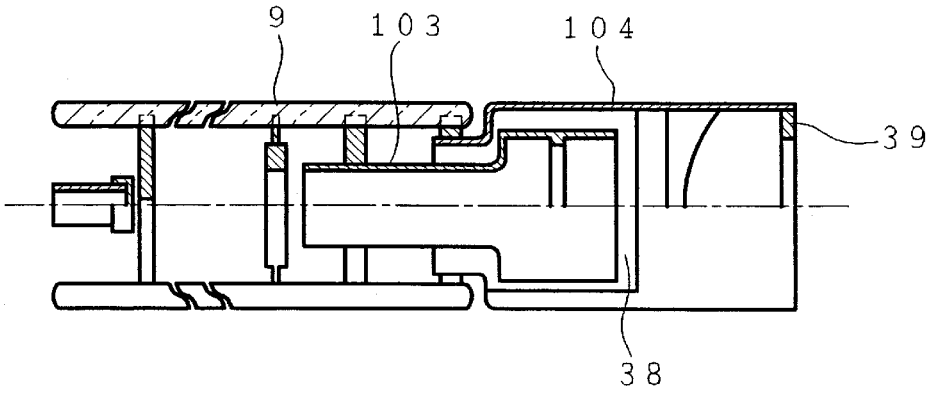
FIG. 41 is a partial sectional view of a three inline beam type electron gun for a cathode ray tube to which the present invention is applied.

FIG. 41 is a partial sectional view of an electron gun for a single-beam cathode ray tube and the deflection defocusing correcting members 39 described referring to FIGS. 37A to 40B are attached to the end face of the final electrode 4 to correct deflection defocusing of deflected electron beams.

As described above, the deflection defocusing correcting members of the present invention correct deflection defocusing over the entire display screen of a cathode ray tube without the need for dynamic focusing correction and provide high resolution image display.

In general, in a color TV receiver set and a terminal display system of a computer, the depth of a cabinet is dependent on the total length L10 of a cathode ray tube. In particular, the recent color TV reliever set has a tendency that the screen size is increased to the extent that the depth of the cabinet is not negligible when disposed in a home. When the color TV receiver set is disposed in parallel to the other furniture, only the depth several tens mm becomes inconvenient. As a result, the shortening of the depth of the cabinet is significantly effective in terms of ease of use.

According to the embodiments of the present invention, there can be provided a color TV receiver set and a terminal display system of a computer in which the depth of a cabinet can be significantly shortened as compared with the prior art cabinet without harming the focus characteristics by shortening the total length of the cathode ray tube.

Figure 42A:
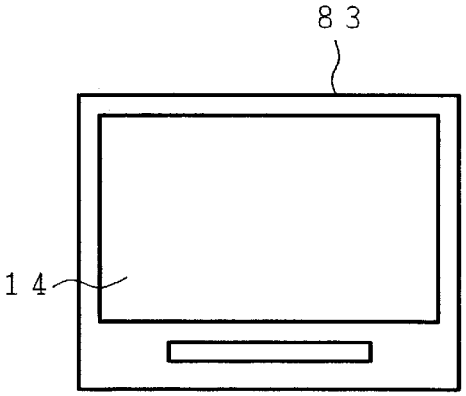
FIGS. 42A and 42B are a front view and a side view of an image display system of the present invention, respectively.

FIGS. 42A to 423D are views illustrating the comparison in dimension between the image display system employing a cathode ray tube of the present invention and a prior image display system.

Figure 42B:
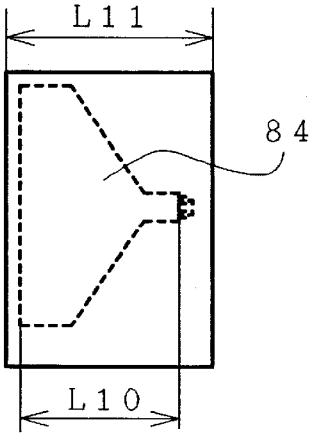
Figure 42C:
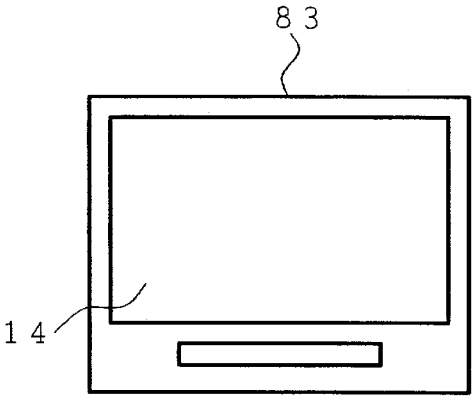
FIGS. 42C and 42D are a front view and a side view of a related art image display system, respectively.
Figure 42D:
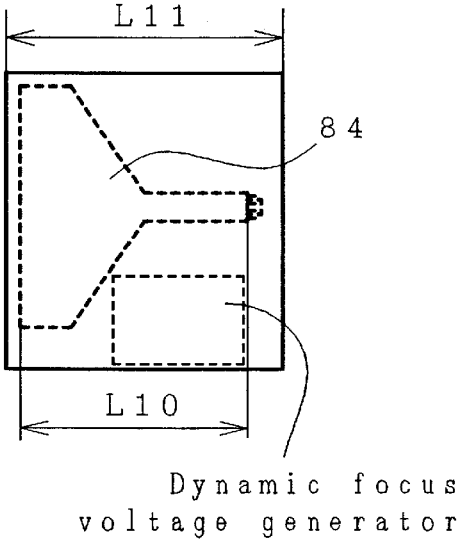

FIGS. 42A and 42B shows the image display system using a cathode ray tube of the present invention; wherein FIGS. 42A is a front view and FIG. 42B is a side view. As seen from these figures, the depth of the image display system can be shortened because the total length L10 of the cathode ray tube can be shortened, FIGS. 42C and 42D show the image display using a prior art cathode ray tube; wherein FIG. 42C is a front view, and FIG. 42D is a side view. As seen from these figures, the depth of the image display system cannot be shortened because the total length of the cathode ray tube cannot be shortened.

In general, a color TV receiver set, a finished cathode ray tube, and parts for a cathode ray tube such as a funnel are significantly larger in volume than an electronic part such as a semiconductor element, and consequently, a transportation cost per unit number becomes high. In particular, when a transportation path is longer such as for overseas, this is not negligible. According to the embodiment of the present invention, since a color TV receiver set in which the total length of a cathode ray tube is shortened and the depth of a cabinet is also shortened can be provided, the transportation cost can be saved.

As described above, the present invention provides a cathode ray tube capable of correcting deflection defocusing and providing desired resolution over the entire screen and over the entire beam current region, particularly, without dynamic focusing, also capable of reducing moire in a small-current region.

What is claimed is:

1. A cathode ray tube including an electron gun comprising a cathode and a plurality of electrodes and for generating an electron beam, a phosphor screen and an electron beam deflection device, wherein said cathode ray tube includes a deflection-defocusing correcting member comprising laminated nonmagnetic and magnetic materials disposed in a deflection magnetic field produced by said electron beam deflection device for establishing at least one non-uniform magnetic field, and said magnetic materials are disposed at sides of said electron beam where a magnetic flux density of said deflection magnetic field is more than five percent of a maximum magnetic flux density of said deflection magnetic field.

2. A cathode ray tube according to claim 1, wherein said magnetic materials are a soft magnetic material and said non-magnetic material is a stainless steel.

3. A cathode ray tube according to claim 2, wherein said soft magnetic material is permalloy.

4. A cathode ray tube according to claim 1, wherein said electron gun has a shield cup attached to a final electrode of said plurality of electrodes on a phosphor screen side of said final electrode, and said deflection-defocusing correcting member is fixed to said shield cup.

5. A cathode ray tube including an electron gun comprising a cathode and a plurality of electrodes and for generating an electron beam, a phosphor screen and an electron beam deflection device, wherein said cathode ray tube includes a deflection-defocusing correcting member comprising laminated non-magnetic and magnetic materials disposed in a deflection magnetic field produced by said electron beam deflection device for establishing at least one non-uniform magnetic field, and said magnetic materials are disposed above and below a path of said electron beam where a magnetic flux density of said deflection magnetic field is more than five percent of a maximum magnetic flux density of said deflection magnetic field.

6. A cathode ray tube according to claim 5, wherein said magnetic materials are a soft magnetic material and said non-magnetic material is a stainless steel.

7. A cathode ray tube according to claim 6, wherein said soft magnetic material is permalloy.

8. A cathode ray tube according to claim 5, wherein said electron gun has a shield cup attached to a final electrode of said plurality of electrodes on a phosphor screen side of said final electrode, and said deflection-defocusing correcting member is fixed to said shield cup.

9. A cathode ray tube including an electron gun comprising a cathode and a plurality of electrodes and for generating an electron beam, a phosphor screen and an electron beam deflection device, wherein said cathode ray tube includes a deflection-defocusing correcting member comprising non-magnetic and magnetic sheets joined edge to edge and disposed in a deflection magnetic field produced by said electron beam deflection device for establishing at least one non-uniform magnetic field, and said magnetic materials are disposed at sides of said electron beam where a magnetic flux density of said deflection magnetic field is more than five percent of a maximum magnetic flux density of said deflection magnetic field.

10. A cathode ray tube according to claim 9, wherein said magnetic materials are a soft magnetic material and said non-magnetic material is a stainless steel.

11. A cathode ray tube according to claim 10, wherein said soft magnetic material is permalloy.

12. A cathode ray tube according to claim 9, wherein said electron gun has a shield cup attached to a final electrode of said plurality of electrodes on a phosphor screen side of said final electrode, and said deflection-defocusing correcting member is fixed to said shield cup.

13. A cathode ray tube including an electron gun comprising a cathode and a plurality of electrodes and for generating an electron beam, a phosphor screen and an electron beam deflection device, wherein said cathode ray tube includes a deflection-defocusing correcting member comprising non-magnetic and magnetic sheets joined edge to edge and disposed in a deflection magnetic field produced by said electron beam deflection device for establishing at least one non-uniform magnetic field, and said magnetic materials are disposed above and below a path of said electron beam where a magnetic flux density of said deflection magnetic field is more than five percent of a maximum magnetic flux density of said deflection magnetic field.

14. A cathode ray tube according to claim 13, wherein said magnetic materials are a soft magnetic material and said non-magnetic material is a stainless steel.

15. A cathode ray tube according to claim 14, wherein said soft magnetic material is permalloy.

16. A cathode ray tube according to claim 13, wherein said electron gun has a shield cup attached to a final electrode of said plurality of electrodes on a phosphor screen side of said final electrode, and said deflection-defocusing correcting member is fixed to said shield cup.

* * * * *